US008795933B2

(12) United States Patent
Doi et al.

(10) Patent No.: US 8,795,933 B2
(45) Date of Patent: Aug. 5, 2014

(54) ELECTROPHOTOGRAPHIC PHOTOCONDUCTOR, METHOD FOR PREPARING THE SAME, PROCESS CARTRIDGE, AND IMAGE FORMING APPARATUS

(75) Inventors: Takatsugu Doi, Kanagawa (JP); Wataru Yamada, Kanagawa (JP); Yuko Iwadate, Kanagawa (JP); Katsumi Nukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 486 days.

(21) Appl. No.: 12/910,397

(22) Filed: Oct. 22, 2010

(65) Prior Publication Data

US 2011/0318676 A1 Dec. 29, 2011

(30) Foreign Application Priority Data

Jun. 28, 2010 (JP) ..... 2010-146982

(51) Int. Cl.

| | |
|---|---|
| ***G03G 15/00*** | (2006.01) |
| ***G03G 5/07*** | (2006.01) |
| ***G03G 5/147*** | (2006.01) |
| ***G03G 5/05*** | (2006.01) |
| ***G03G 5/06*** | (2006.01) |

(52) U.S. Cl.

CPC ..... *G03G 15/751* (2013.01); *G03G 5/071* (2013.01); *G03G 5/14708* (2013.01); *G03G 5/0532* (2013.01); *G03G 5/0614* (2013.01); *G03G 5/0525* (2013.01); *G03G 5/0596* (2013.01); *G03G 5/0592* (2013.01)

USPC ..... 430/58.7; 430/50; 430/56

(58) Field of Classification Search

USPC ..... 430/56, 58.65, 60, 64, 50, 58.7

See application file for complete search history.

(56) References Cited

U.S. PATENT DOCUMENTS

| | | | | |
|---|---|---|---|---|
| 5,411,827 | A | 5/1995 | Tamura et al. | |
| 5,456,989 | A | 10/1995 | Nogami et al. | |
| 2004/0191656 | A1 | 9/2004 | Ishiyama et al. | |
| 2007/0212626 | A1 * | 9/2007 | Toshine et al. | 430/58.7 |
| 2008/0107991 | A1 | 5/2008 | Hamano | |
| 2009/0162763 | A1 * | 6/2009 | Li et al. | 430/58.2 |
| 2009/0318613 | A1 | 12/2009 | Ageishi et al. | |

FOREIGN PATENT DOCUMENTS

| | | | |
|---|---|---|---|
| CN | 1532636 | A | 9/2004 |
| CN | 101174112 | A | 5/2008 |
| CN | 101539727 | A | 9/2009 |
| CN | 101607490 | A | 12/2009 |
| JP | A-62-251757 | | 11/1987 |

(Continued)

OTHER PUBLICATIONS

Dec. 16, 2013 Chinese Office Action issued in Chinese Patent Application No. CN 201010590777.X (with English-language Translation).

*Primary Examiner* — Mark F Huff
*Assistant Examiner* — Rashid Alam
(74) *Attorney, Agent, or Firm* — Oliff PLC

(57) ABSTRACT

An electrophotographic photoconductor includes a conductive substrate and an outermost surface layer on the conductive substrate. The outermost surface layer contains a copolymer (a) derived from a reactive monomer having charge transport property and a reactive monomer having no charge transport property, and a polymer prepared by polymerizing, in the presence of the copolymer (a), a reactive monomer (b) that has a solubility parameter (SP value) different from a solubility parameter (SP value) of the reactive monomer having no charge transport property by about 2 $(cal/cm^3)^{1/2}$ or less.

15 Claims, 5 Drawing Sheets

(56) References Cited

FOREIGN PATENT DOCUMENTS

| | | |
|---|---|---|
| JP | A-05-256428 | 10/1993 |
| JP | A-05-331238 | 12/1993 |
| JP | A-07-072640 | 3/1995 |
| JP | A-09-012630 | 1/1997 |
| JP | A-2000-019749 | 1/2000 |
| JP | A-2000-206715 | 7/2000 |
| JP | A-2000-206717 | 7/2000 |
| JP | A-2002-082469 | 3/2002 |
| JP | B2-3287678 | 3/2002 |
| JP | A-2004-012986 | 1/2004 |
| JP | A-2004-302450 | 10/2004 |
| JP | A-2005-002291 | 1/2005 |
| JP | A-2006-084711 | 3/2006 |

* cited by examiner

ELECTROPHOTOGRAPHIC PHOTOCONDUCTOR, METHOD FOR PREPARING THE SAME, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-146982 filed Jun. 28, 2010.

BACKGROUND (i) Technical Field

The present invention relates to an electrophotographic photoconductor, a method for preparing the same, a process cartridge, and an image forming apparatus.

(ii) Related Art

Electrophotographic photoconductors help achieve high print quality and high printing rates and thus are widely used in the fields of copy machines and laser beam printers. Currently, the mainstream of the electrophotographic photoconductors used in such image forming apparatuses is those that use organic photoconductive materials which are superior to conventional electrophotographic photoconductors that use inorganic photoconductive materials such as selenium, selenium-tellurium alloy, selenium-arsenic alloy, cadmium sulfide, or the like, in terms of cost, manufacturability, and disposability.

Although a corona charging technique using a corona discharger has been used as a charging technique, a contact charging technique that generates less ozone and requires low power is increasingly put into practical use. The contact charging technique involves bringing a conductive member as a charging member into contact or in close proximity with a surface of a photoconductor and applying a voltage to the charging member to charge the surface of the photoconductor. The voltage may be applied to the charging member through a DC method by which only DC voltage is applied or through an AC superimposition method by which AC voltage is superimposed on DC voltage and applied. According to the contact charging technique, the size of the apparatus is reduced and less toxic gas such as ozone is generated. However, since direct discharge occurs at the surface of the photoconductor, deterioration and wear of the photoconductor tend to occur.

The mainstream of the transfer technique has been to directly transfer images onto paper. However, recently, use of intermediate transfer bodies has increased since the flexibility of choosing paper onto which transfer is conducted is high.

SUMMARY

According to an aspect of the invention, there is provided an electrophotographic photoconductor including a conductive substrate and an outermost surface layer on the conductive substrate, the outermost surface layer containing a copolymer (a) derived from a reactive monomer having charge transport property and a reactive monomer having no charge transport property, and a polymer prepared by polymerizing, in the presence of the copolymer (a), a reactive monomer (b) that has a solubility parameter (SP value) different from a solubility parameter (SP value) of the reactive monomer having no charge transport property by about 2 $(cal/cm^3)^{1/2}$ or less.

BRIEF DESCRIPTION OF THE DRAWINGS

Exemplary embodiments of the present invention will be described in detail based on the following figures, wherein.

DETAILED DESCRIPTION

Figure 1:
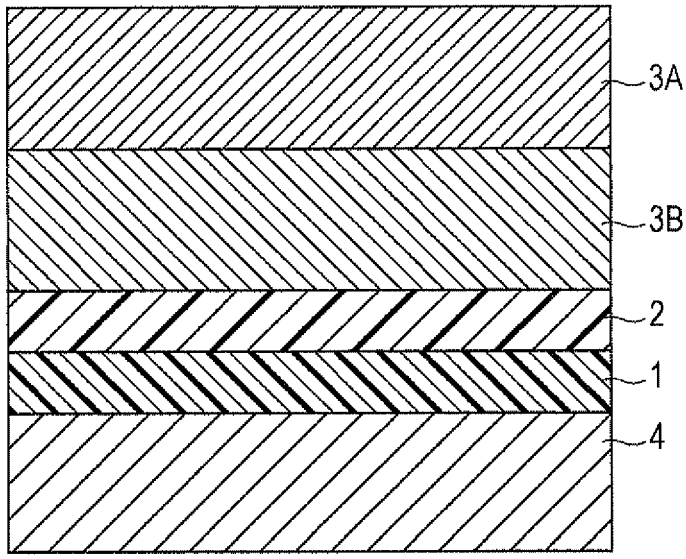
FIG. 1 is a schematic partial cross-sectional view showing an example of the layer configuration of an electrophotographic photoconductor according to an exemplary embodiment.

Exemplary embodiments will now be described with reference to the drawings. In the drawings, same or equivalent parts are referenced by the same reference characters and the descriptions therefor are omitted to avoid redundancy.

When a reactive charge transport material (low molecular weight) and a (meth)acrylate or the like that does not have a charge transport property are polymerized on a substrate to form a photosensitive layer of a photoconductor and this photosensitive layer is has a crosslinked structure, the photosensitive layer presumably has many cross-linking points and forms a three-dimensional network. Such a photoconductor tends to have poor electrical characteristics although it has high mechanical strength. Although the mechanism of deterioration of the electrical characteristics is not clear, one of the possible causes may be the deterioration of charge transport property by immobilization of charge hopping sites caused by crosslinking. According to a photoconductor prepared by polymerization on a substrate, the polymerization reaction is generally conducted without any solvent. Thus, presumably, the distance between the reactive group and the charge transport skeleton is small, and side reactions between the radicals generated on the reactive group and the electron transport skeleton occur. As a result, presumably, the charge transport property is degraded and this may be one of the causes for the deterioration of the electrical characteristics.

The mechanical strength may be enhanced by preliminarily polymerizing the charge transport material. However, in general, when a polymeric transfer material is used, a one-dimensional polymer is formed. Thus, in terms of crosslinking points, such a polymer is poor compared to cured products of the (meth)acrylate and the reactive charge transport material described above. Accordingly, when a polymeric charge transport material is used, the mechanical strength is low compared to when a cured product of the reactive charge transport material and the (meth)acrylate is used. However, the electrical characteristics tend to be better. This is probably because charge hopping sites tend to remain unrestrained.

Since it is difficult to obtain sufficient mechanical strength by the characteristics of the polymeric charge transport material, the polymeric charge transport material may be cured together with a reactive acrylate to improve the mechanical strength. However, since the two materials have low compatibility to each other, they do not mix with each other homogeneously and it is difficult to form a photoconductor. Moreover, the electrical characteristics may deteriorate because of the low compatibility.

Under such circumstances, the inventors have continued studies and found that when an electrophotographic photoconductor (may be referred to as "photoconductor" hereinafter) that contains a polymer obtained by polymerizing a reactive acrylate in the presence of a polymeric charge transport material, the mechanical strength is improved, the environmental dependency is suppressed even when repeatedly used, and stable images is obtained. Further studies have found that when a photosensitive layer, which is the outermost surface layer, contains a copolymer (a) derived from a reactive monomer having charge transport property and a reactive monomer having no charge transport property (hereinafter this copolymer is simply referred to as "copolymer (a)"), and a polymer prepared by polymerizing, in the presence of the copolymer (a), a reactive monomer (b) that has a solubility parameter (SP value) different from the solubility parameter (SP value) of the reactive monomer having no charge transport property, i.e., a constitutional unit of the copolymer (a), by 2 $(cal/cm^3)^{1/2}$ or less or about 2 $(cal/cm^3)^{1/2}$ or less, stable images are obtained.

Note that the solubility parameter (SP value) of the reactive monomer in this exemplary embodiment is a value calculated from the equation of Fedors below based on the evaporation energy (Δei) and molar volume (Δvi) of the atoms or atomic groups of the chemical structure:

$$[\text{SP value}=(\Sigma\Delta ei/\Sigma\Delta vi)^{1/2}] \quad \text{Equation}$$

Although the mechanism therefor is not necessarily clear, the following is presumed.

When the difference between the solubility parameter (SP value) of the reactive monomer having no charge transport property, which is a constitutional unit of the copolymer (a), and the solubility parameter (SP value) of the reactive monomer (b) is 2 $(cal/cm^3)^{1/2}$ or less or about 2 $(cal/cm^3)^{1/2}$ or less, the compatibility between the copolymer (a) and the reactive monomer (b) is improved, and a photosensitive layer in which separation of the copolymer (a) and the reactive monomer (b) is suppressed is formed. As a result, presumably, while sufficient mechanical strength is obtained by polymerizing the charge transport material, the charge transport material becomes sufficiently dispersed in the photosensitive layer, thereby improving the electrical characteristics.

In contrast, when a polymeric charge transport material is prepared in advance and polymerization between the polymeric charge transport material and a reactive monomer is performed on a substrate, the number of reactive groups involved in the polymerization decreases during the polymerization on the substrate. Thus, presumably, side reactions between the radicals on the reactive groups and the electron transport skeleton is suppressed, thereby improving the electrical characteristics.

The layer configuration of the electrophotographic photoconductor used in this exemplary embodiment will now be described.

Figure 2:
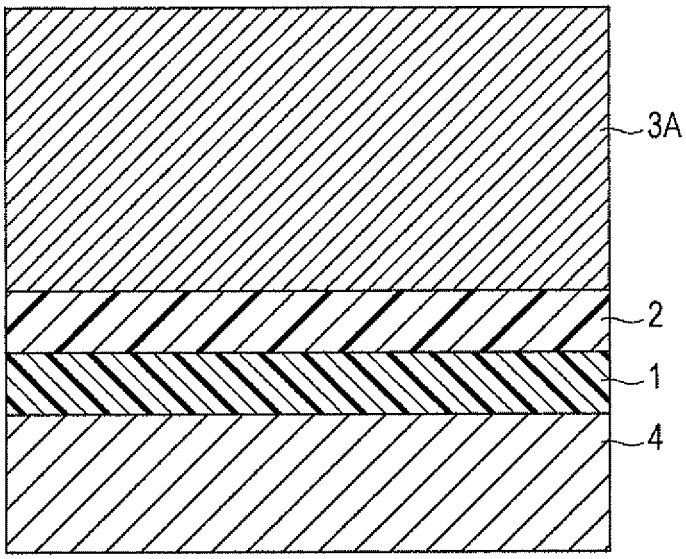
FIG. 2 is a schematic partial cross-sectional view showing another example of the layer configuration of an electrophotographic photoconductor according to an exemplary embodiment.

FIGS. 1 and 2 are schematic cross-sectional views showing examples of the layer configuration of the electrophotographic photoconductor of this exemplary embodiment. In FIG. 1, an undercoat layer 1 is formed on a conductive substrate 4, and a charge generation layer 2 and then charge transport layers 3A and 3B are formed on the undercoat layer 1. In the electrophotographic photoconductor having this structure, the outermost surface layer is the charge transport layer 3A.

In FIG. 2, an undercoat layer 1 is formed on a conductive substrate 4, and a charge generation layer 2 and then a charge transport layer 3A are formed on the undercoat layer 1. In the electrophotographic photoconductor having this structure, the outermost surface layer is the charge transport layer 3A.

In the examples shown in FIGS. 1 and 2, the undercoat layer 1 may be provided if necessary.

The individual layers will now be described by using the electrophotographic photoconductor having a structure shown in FIG. 1 as a representative example.

<Charge Transport Layer 3A>

The charge transport layer 3A constituting the outermost surface layer is first described. The charge transport layer 3A which constitutes the outermost surface layer of the electrophotographic photoconductor of this exemplary embodiment contains a copolymer (a) derived from a reactive monomer having charge transport property and a reactive monomer having no charge transport property, and a polymer prepared by polymerizing, in the presence of the copolymer (a), a reactive monomer (b) that has a solubility parameter (SP value) different from the solubility parameter (SP value) of the reactive monomer having no charge transport property, i.e., a constitutional unit of the copolymer (a), by 2 $(cal/cm^3)^{1/2}$ or less or about 2 $(cal/cm^3)^{1/2}$ or less. The charge transport layer 3A may contain other materials.

In this exemplary embodiment, a monomer having two or more chain polymerizable groups may be used as the reactive monomer (b). The chain polymerizable groups may be functional groups including any one of an acryl group, a methacryl group, a styryl group, and derivatives thereof from the viewpoints of ease of synthesizing the compounds and high reactivity. When polyfunctional monomers are used, the compatibility between the copolymer (a) and the reactive monomer (b) is high, and thus it is assumed that the resulting structure has the copolymer (a) within the crosslinked structure of the reactive monomer (b). Accordingly, it is presumed that the synergy of the strength-improving effect achieved by the use of the copolymer (a) and the strength-improving effect achieved by the crosslinked structure of the polyfunctional reactive monomer (b) further enhances mechanical strength.

In typical crosslinked photoconductors, the electrical characteristics tend to be poor. However, molecules of the copolymer (a) are allowed to move freely within the crosslinked structure derived from the reactive monomer (b) and the degree of freedom of hopping sites is enhanced. Moreover, it is assumed that since the copolymer (a) is dispersed in the crosslinked structure of the reactive monomer (b), sufficient electrical characteristics are ensured.

The reactive monomer having no charge transport property, which is a constitutional unit of the copolymer (a), may have the same structure as the reactive monomer (b) from the viewpoint of the compatibility between the copolymer (a) and the reactive monomer (b). When monomers of the same structure are used, the effect of improving both the mechanical strength and the electrical characteristics is enhanced further.

When the reactive monomer (b) and the reactive monomer having no charge transport property and constituting the copolymer (a) are not of the same type, the effect of achieving both sufficient mechanical strength and electrical characteristics are obtained if both the reactive monomer (b) and the reactive monomer having no charge transport property and constituting the copolymer (a) have an alkylene oxide group, a bisphenol skeleton, or an alkyl group having 6 or more carbon atoms.

In particular, when both monomers have an alkylene oxide group, not only the compatibility between the monomers is improved but also polymer entanglement is enhanced.

Although both mechanical strength and electrical characteristics are improved, incorporation of the alkylene oxide group is particularly favorable in terms of mechanical strength.

It is assumed that when both monomers have a bisphenol skeleton, the compatibility between the monomers is enhanced and the mechanical strength and electrical characteristics are improved.

In particular, when both monomers have an alkyl group having 6 or more carbon atoms, not only the compatibility between the monomers is improved but also polymer entanglement is enhanced. In particular, electrical characteristics are improved.

In this exemplary embodiment, the reactive monomer having no charge transport property and being a constitutional unit of the copolymer (a) may be a polyfunctional (meth) acrylate and the ratio of the reactive monomer having no charge transport property may be 10 mass % or less or about 10 mass % or less. This improves the mechanical strength in particular. When a polyfunctional (meth)acrylate is used, the number of cross-linking points increases and the mechanical strength is improved. Moreover, because the ratio of the reactive monomer having no charge transport property is 10 mass % or less or about 10 mass % or less in the copolymer (a), sufficient dissolution (dispersion) is maintained and deterioration of the electrical characteristics is suppressed.

In this exemplary embodiment, the reactive group may be selected from the group consisting of an acryl group, a methacryl group, a styryl group, and derivatives thereof.

(Reactive Monomer Having Charge Transport Property)

The reactive monomer having charge transport property, which is a constitutional unit of the copolymer (a) will now be described in detail. In this exemplary embodiment, the "reactive monomer having charge transport property" means a monomer having a charge mobility of $1\times10^{-10}$ $cm^2/V\cdot s$ or more at a field intensity of 10 V/μm measured by a time-of-flight (TOF) technique, and the "reactive monomer having no charge transport property" means a monomer having a charge mobility of less than $1\times10^{-10}$ $cm^2/V\cdot s$ under the same conditions.

The reactive monomers constituting the copolymer (a) may be any material as long as it is a compound having both a reactive group and an organic group having a charge transport skeleton within a molecule.

Specific examples of the reactive monomer having charge transport property used in this exemplary embodiment include monomers represented by general formula (1-2) below:

General formula (1-2)

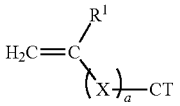

In general formula (1-2), $R^1$ represents hydrogen or an alkyl group having 1 to 4 carbon atoms, X represents a divalent organic group having 1 to 10 carbon atoms, a represents 0 or 1, and CT represents an organic group having a charge transport skeleton. X may contain at least one substituent selected from the group consisting of a carbonyl group, an ester group, and an aromatic ring and may contain an alkyl group, preferably, an alkyl group having 1 to 4 carbon atoms, in a side chain.

Compounds represented by general formula (A) below are more preferable. Hereinafter, a charge transport material having a reactive group is described by using a compound represented by general formula (A) as an example.

(A)

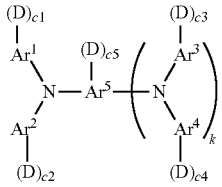

In general formula (A), $Ar^1$ to $Ar^4$ may be the same or different and each independently represent a substituted or unsubstituted aryl group; $Ar^5$ represents a substituted or unsubstituted aryl group or a substituted or unsubstituted arylene group; D represents a side chain having a reactive group; c1 to c5 each independently represent an integer of 0 to 2; k represents 0 or 1; and the total number of D is 1 to 6.

In this exemplary embodiment, the total number of D may be 1. When the total number of D is 2 or more, the high molecular copolymer forms a three-dimensional crosslinked structure and the compatibility with the reactive monomer (b) may be lowered. When a reactive monomer with two or more D is used, the ratio of the reactive monomer with two or more D in the copolymer may be lowered.

In general formula (A), $Ar^1$ to $Ar^4$ may each be one of compounds (1) to (7) below:

(1)

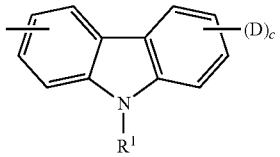

(2)

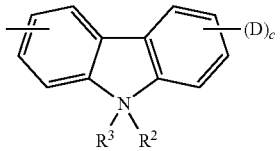

(3)

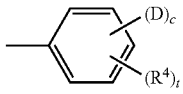

(4)

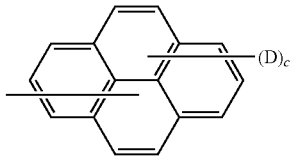

(5)

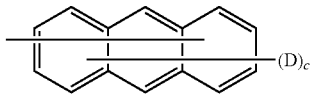

(6)

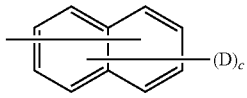

-continued $$-Ar-(Z')_s-Ar-(D)_c \quad (7)$$

In (1) to (7), $R^1$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^2$ to $R^4$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; Z' represents a divalent organic linking group; D represents a side chain having a reactive group; c represents an integer of 0 to 2; s represents 0 or 1; and t represents an integer of 0 to 3.

Ar in (7) may be represented by chemical formula (8) or (9) below.

(8)

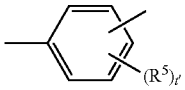

(9)

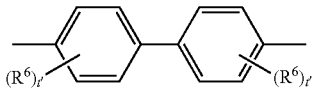

In formulae (8) and (9), $R^5$ and $R^6$ each independently represent one selected from the group consisting of a hydrogen atom, an alkyl group having 1 to 4 carbon atoms, an alkoxy group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms, and a halogen atom; and t' represents an integer of 1 to 3.

In formula (7), Z' represents a divalent organic linking group and may be one of groups represented by formulae (10) to (17) below:

(10)

$$-(CH_2)_q- \quad (10)$$

(11)

$$-(CH_2CH_2O)_r- \quad (11)$$

(12)

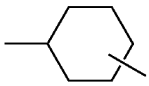

(13)

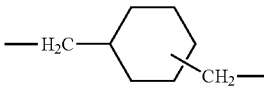

(14)

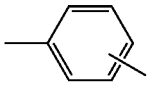

-continued (15)

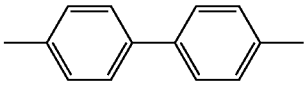

(16)

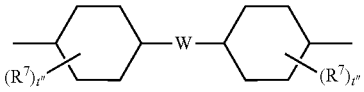

(17)

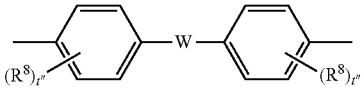

In formulae (10) and (17), $R^7$ and $R^8$ each independently represent one selected from the group consisting of a hydrogen atom, an alkyl group having 1 to 4 carbon atoms, an alkoxy group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms, and a halogen atom; W represents a divalent group; q and r each independently represent an integer of 1 to 10; and t" represents an integer of 0 to 3.

In formulae (16) and (17), W may be one of the divalent groups represented by formulae (18) to (26) below. In formula (25), u represents an integer of 0 to 3.

(18)

$$-CH_2- \quad (18)$$

(19)

$$-C(CH_3)_2- \quad (19)$$

(20)

$$-O- \quad (20)$$

(21)

$$-S- \quad (21)$$

(22)

$$-C(CF_3)_2- \quad (22)$$

(23)

$$-Si(CH_3)_2- \quad (23)$$

(24)

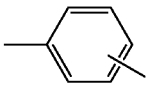

(25)

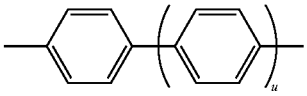

(26)

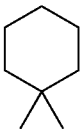

In general formula (A), $Ar^5$ represents a substituted or unsubstituted aryl group when k is 0. Examples of the aryl group are the same as those previously described in connection with $Ar^1$ to $Ar^4$. $Ar^5$ is a substituted or unsubstituted arylene group when k is 1. Examples of the arylene group are those groups obtained by removing one hydrogen atom from the previously described examples of the aryl groups for $Ar^1$ to $Ar^4$.

Specific examples of the reactive monomer constituting the high molecular copolymer (a) are described below. It should be noted that the reactive monomer is not limited to these examples.

First, the following compounds are given as examples of the reactive monomer having charge transport property and one reactive group.
i-1
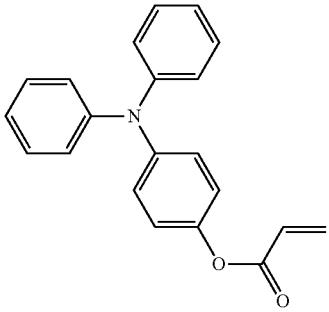
i-2
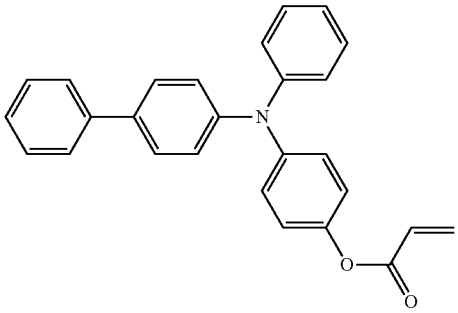
i-3
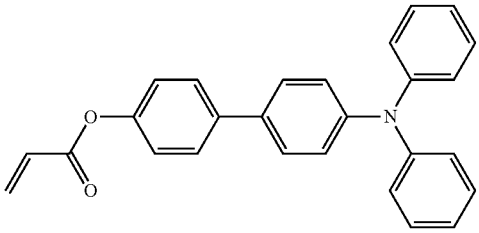
i-4
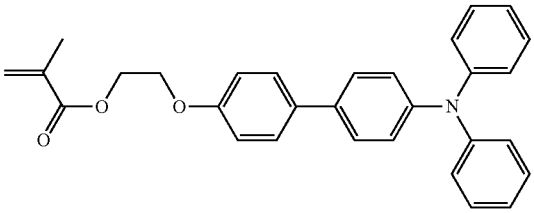
i-5
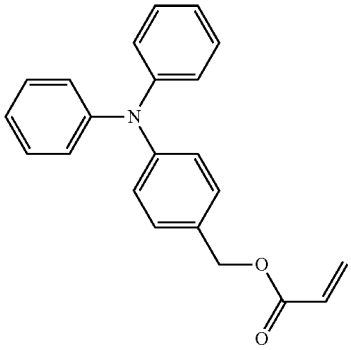
-continued
i-6
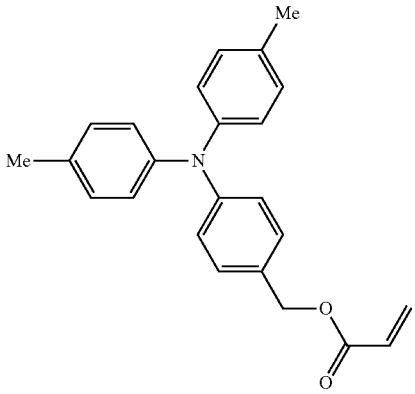
i-7
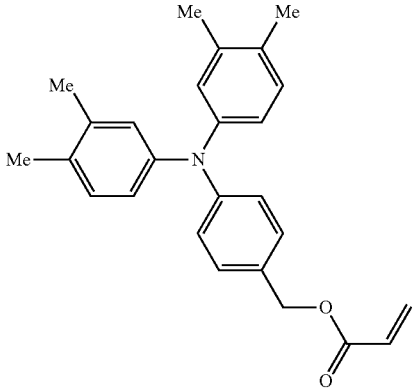
i-8
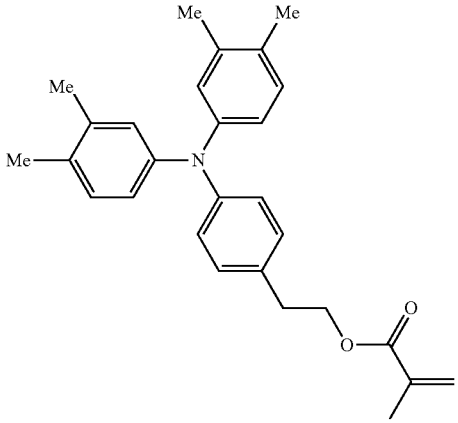
i-9
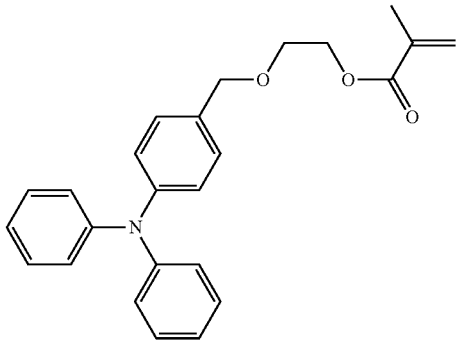

-continued
i-10
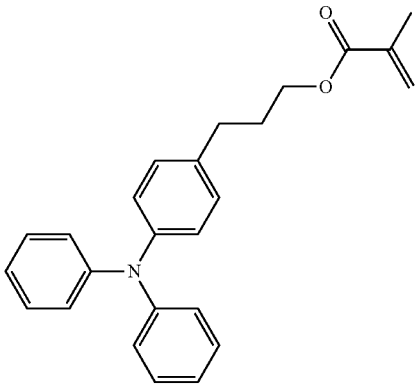
i-11
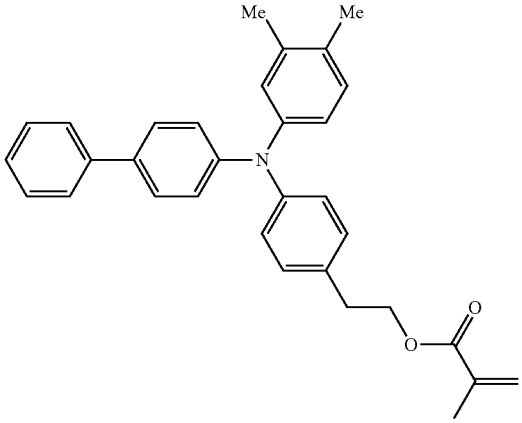
i-12
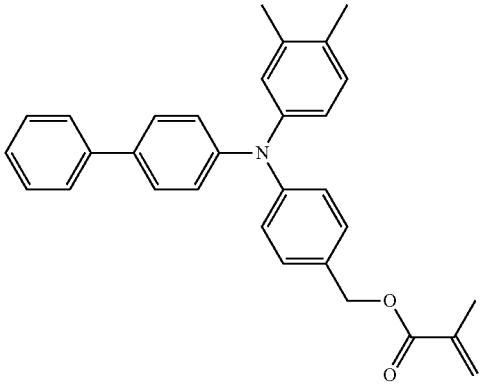
-continued
i-13
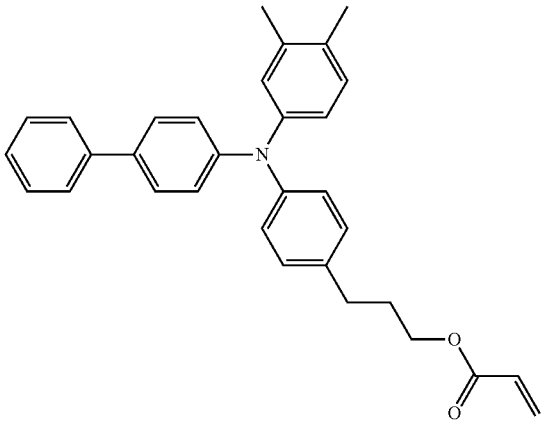
i-14
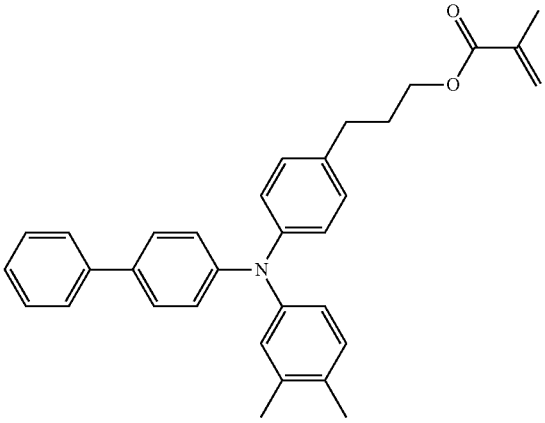
i-15
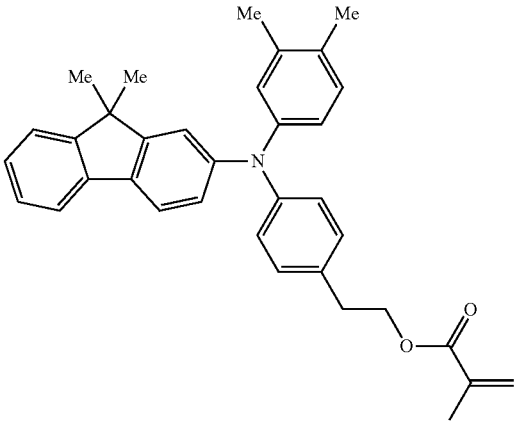

-continued
i-16
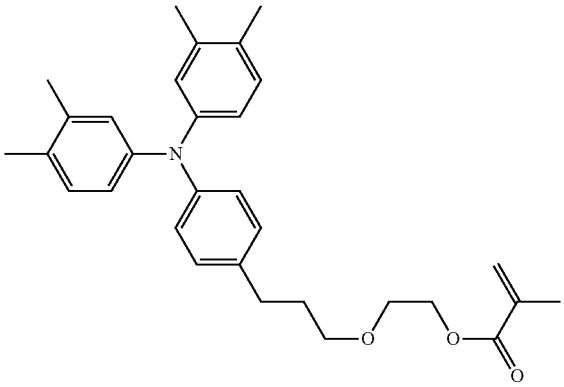
i-17
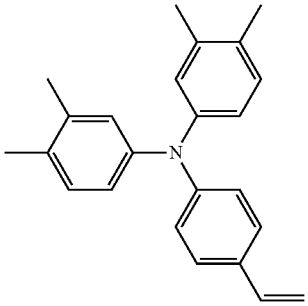
i-18
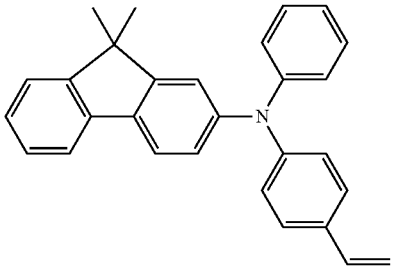
i-19
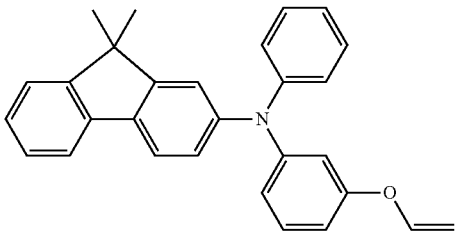
-continued
i-20
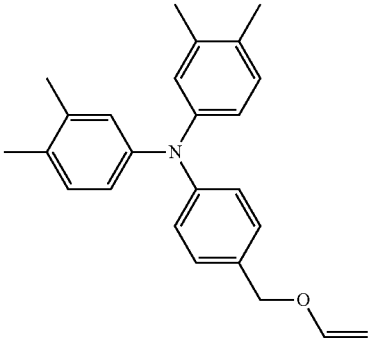
i-21
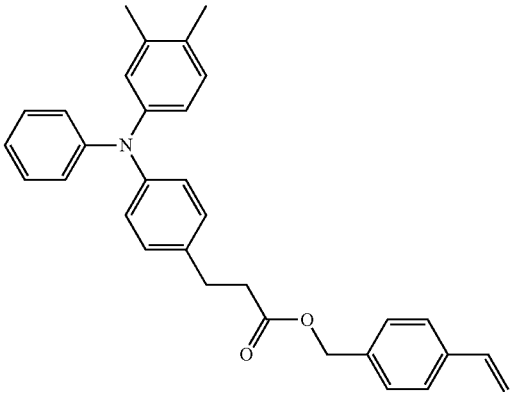
i-22
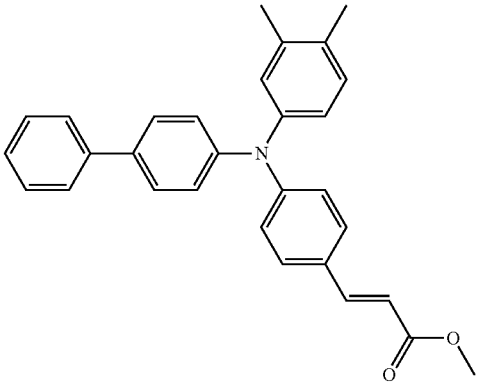
i-23
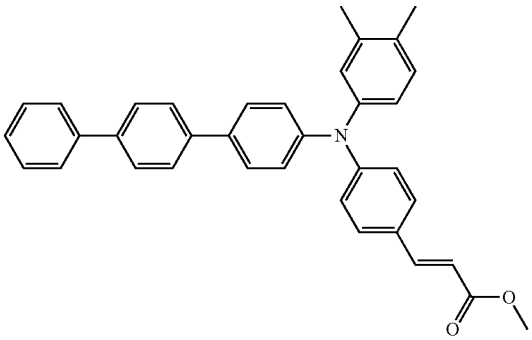

-continued
i-24
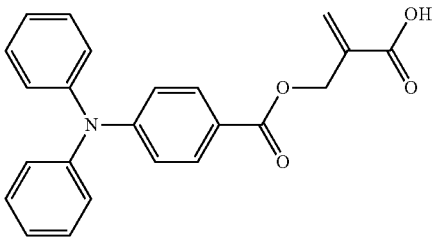
i-25
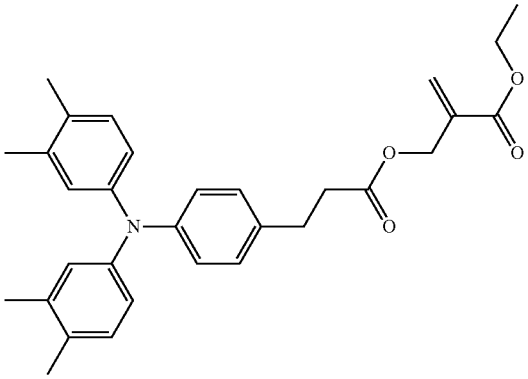
-continued
i-26
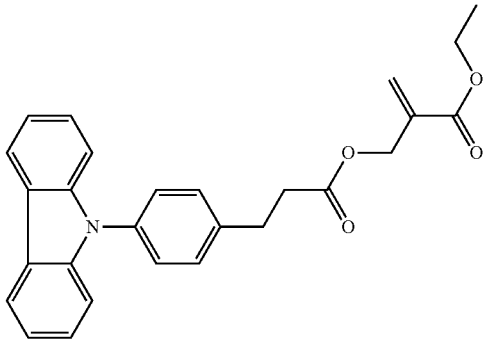
i-27
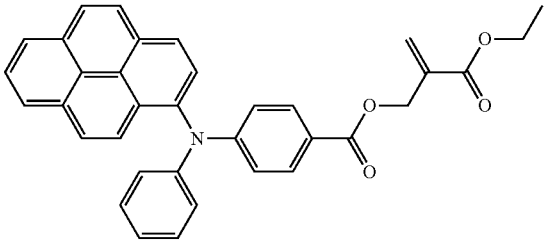
The following compounds are given as non-limiting examples of the reactive monomer having charge transport property and two reactive groups.
ii-1
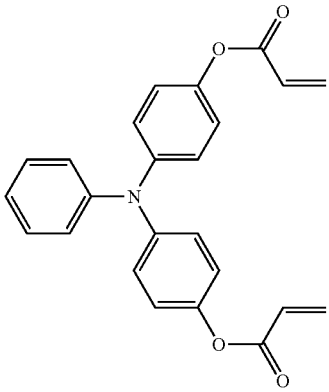
ii-2
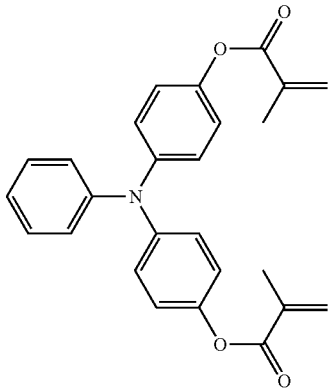
ii-3
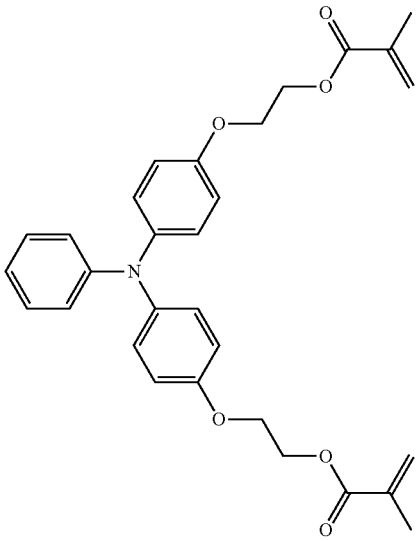
ii-4
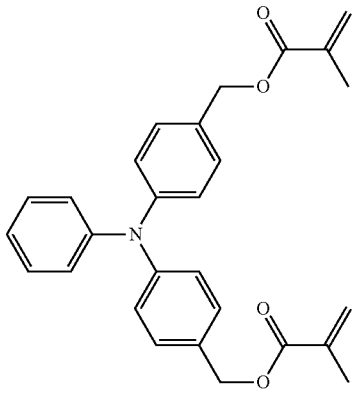

-continued
ii-5
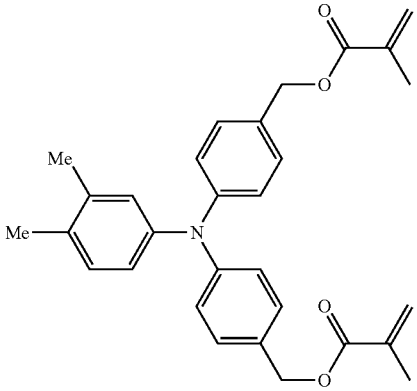
ii-6
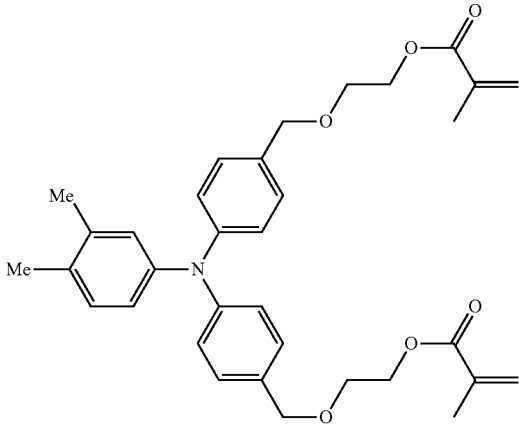
ii-7
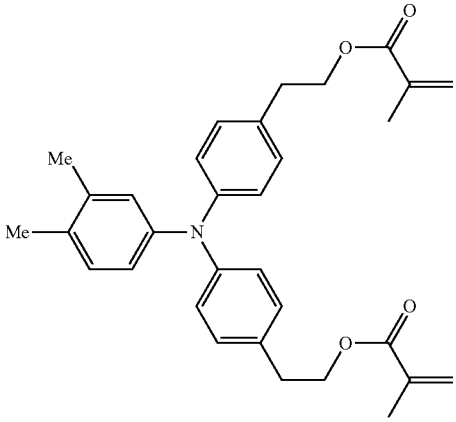
ii-8
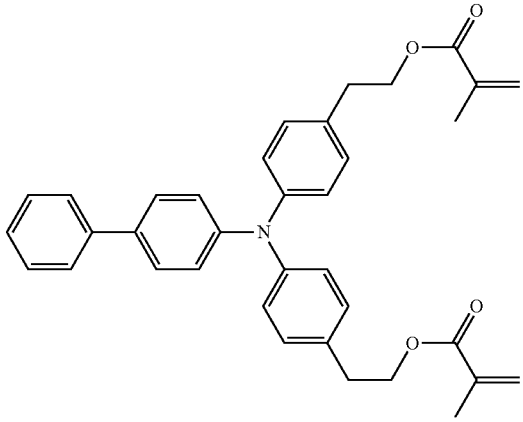
ii-9
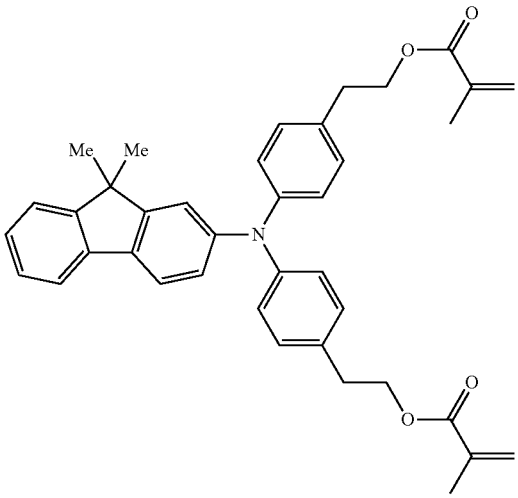

-continued
ii-10
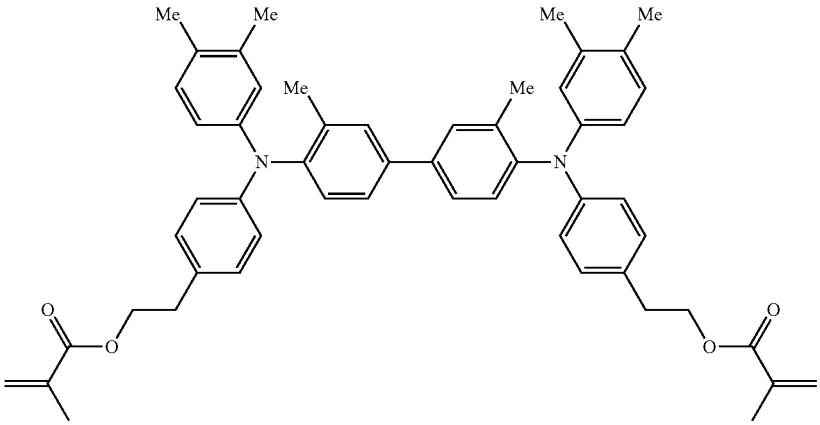
ii-11
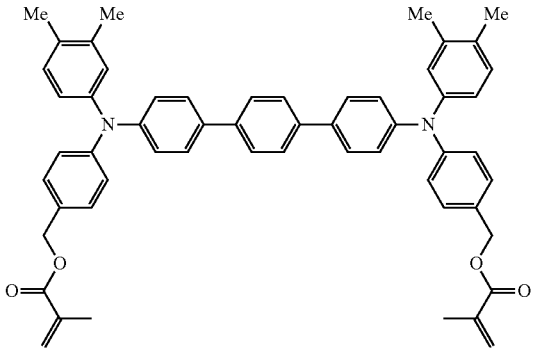
ii-12
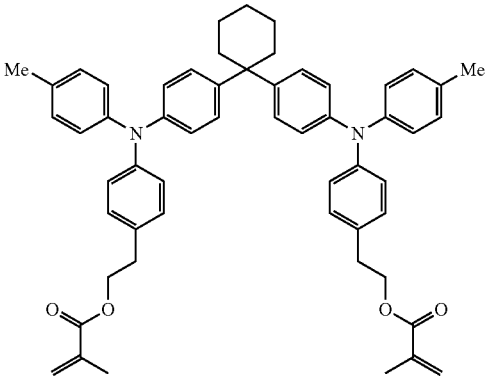
ii-13
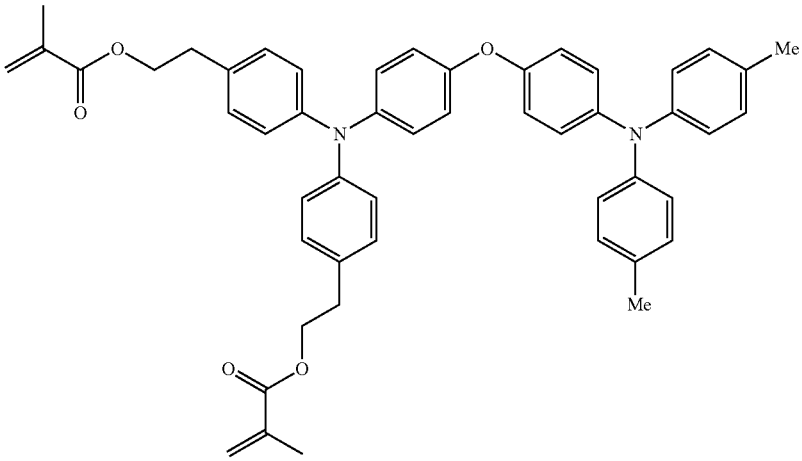

-continued
ii-14
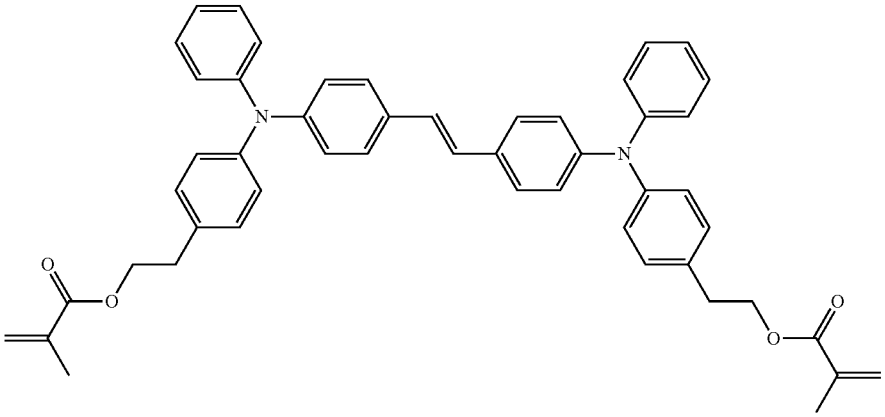
ii-15
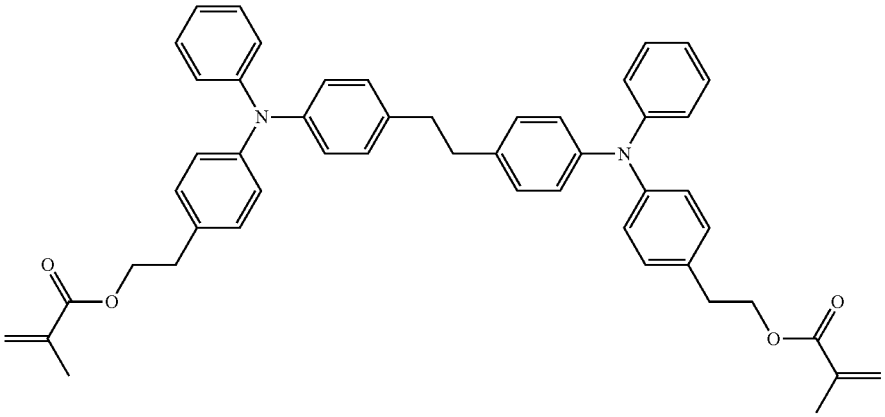
ii-16
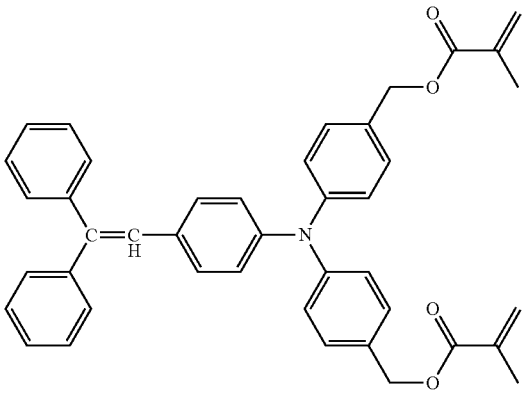
ii-17
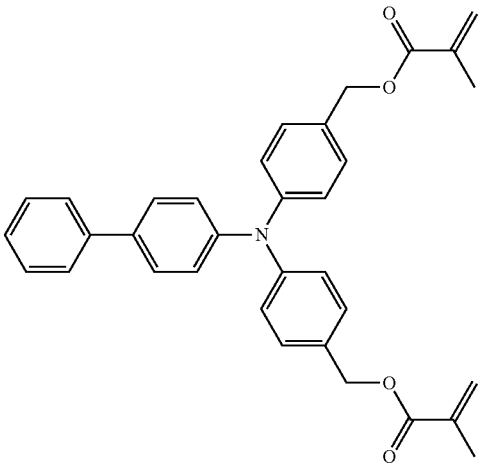

-continued
ii-18
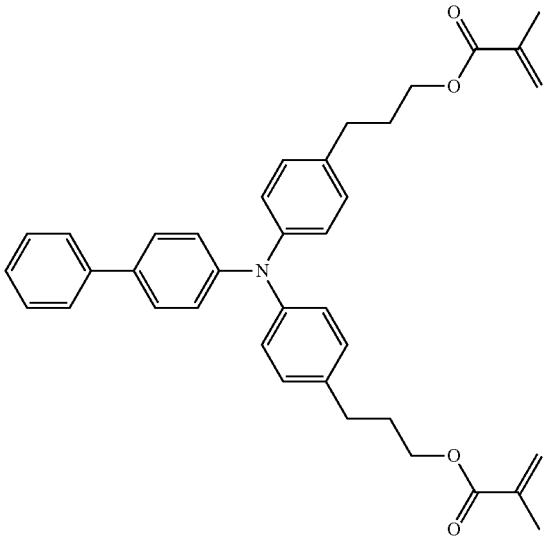
ii-19
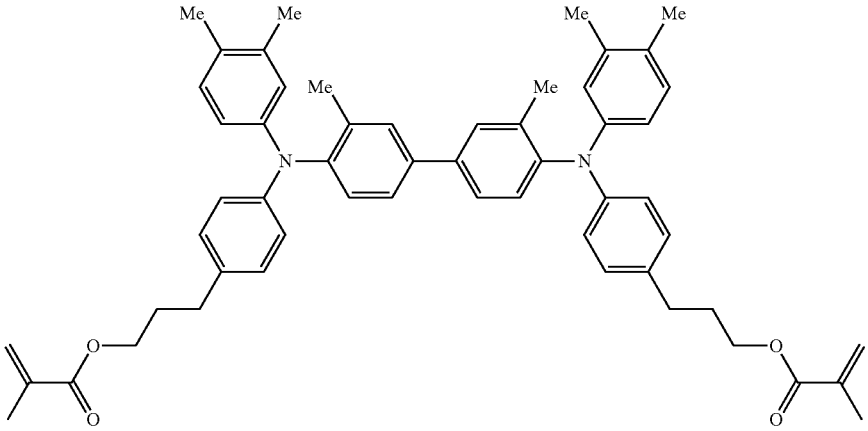
ii-24
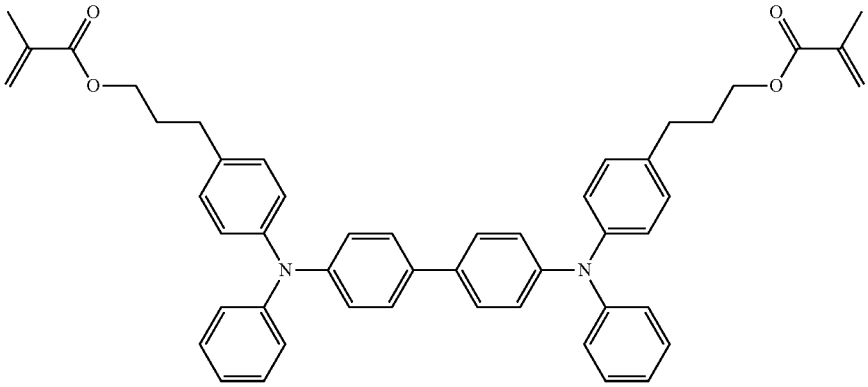

-continued
ii-25
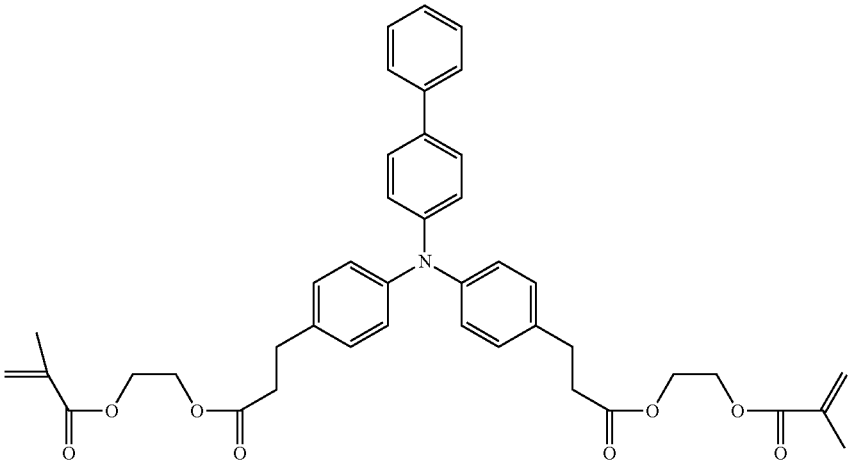
ii-26
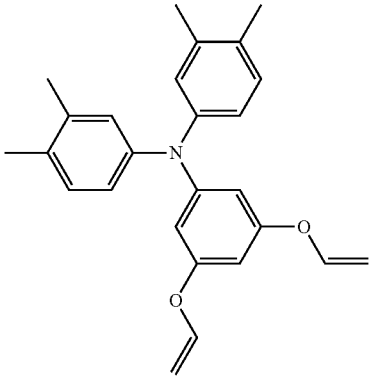
ii-27
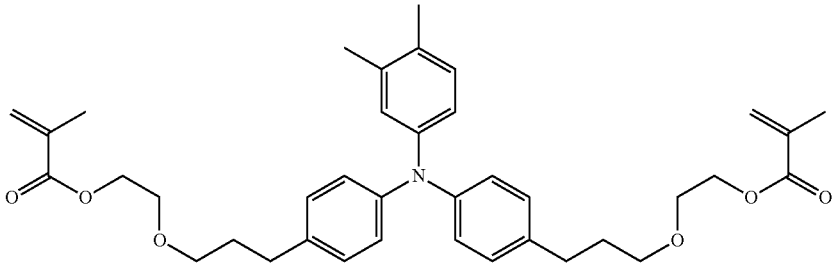
ii-28
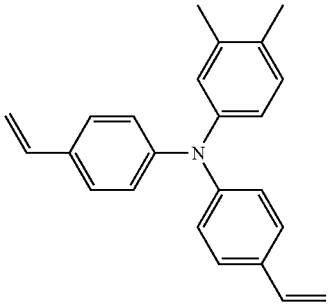
ii-29
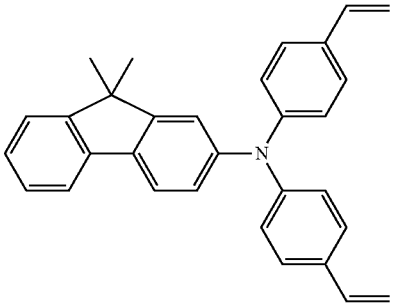

-continued
ii-30
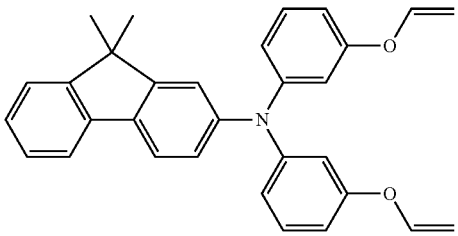
ii-31
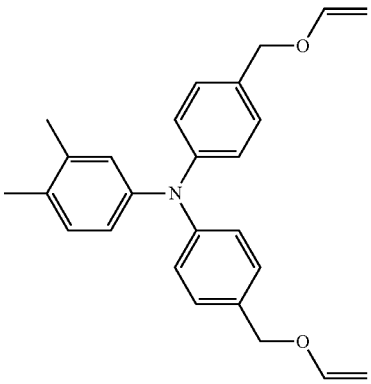
ii-32
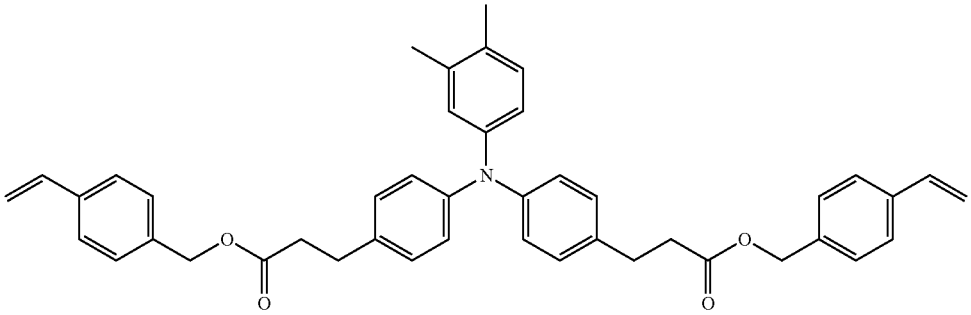
ii-33
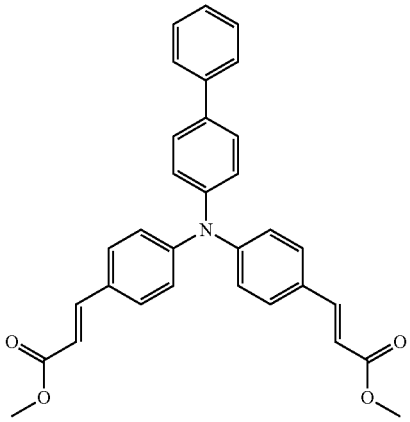
ii-34
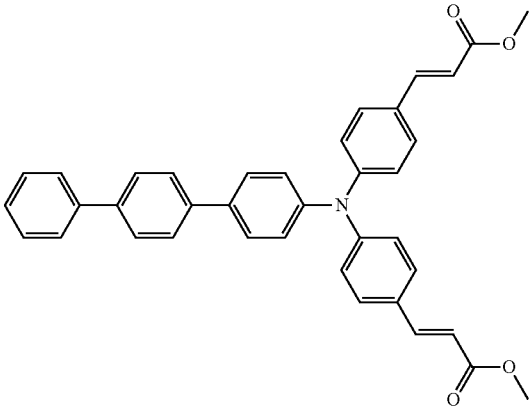
ii-35
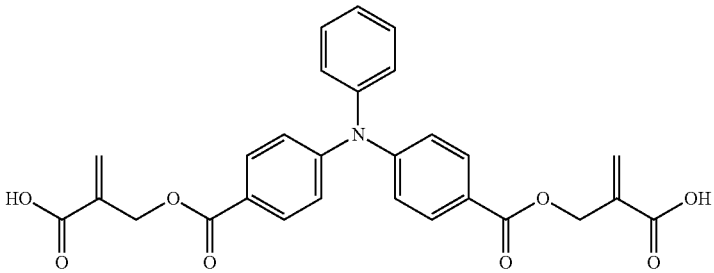

-continued
ii-36
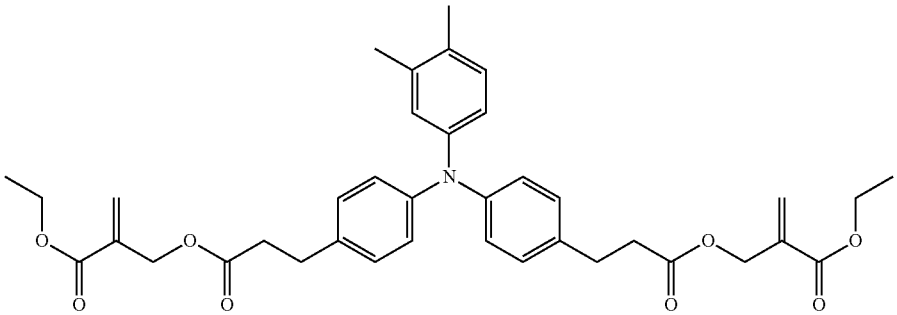
ii-37
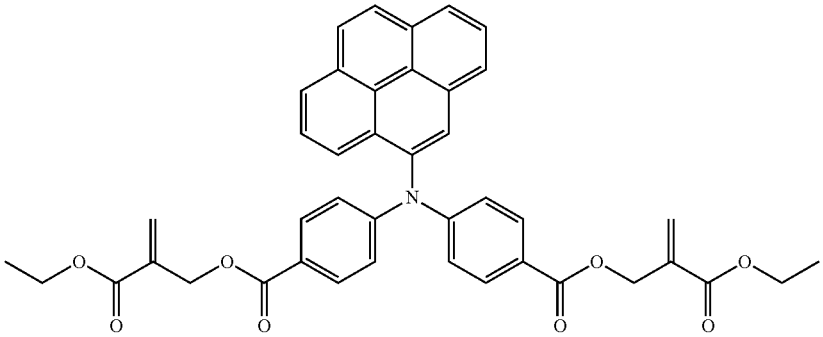
ii-38
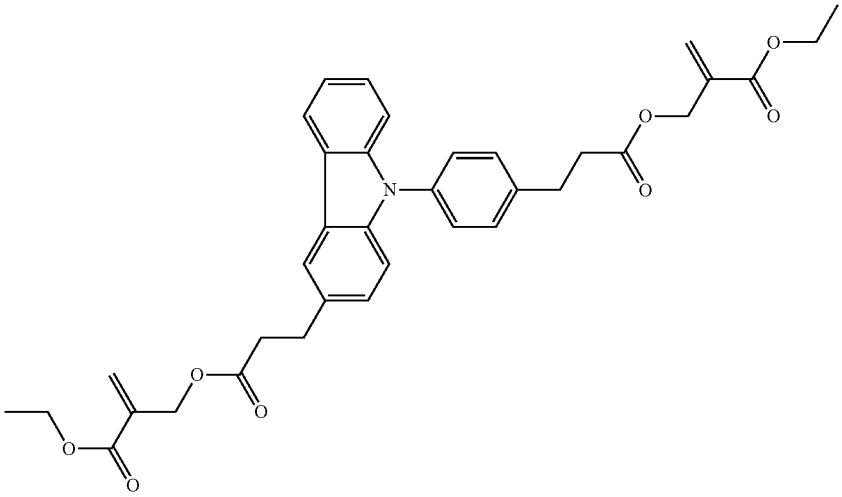
ii-39
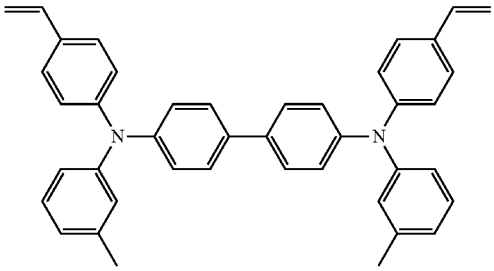
ii-40
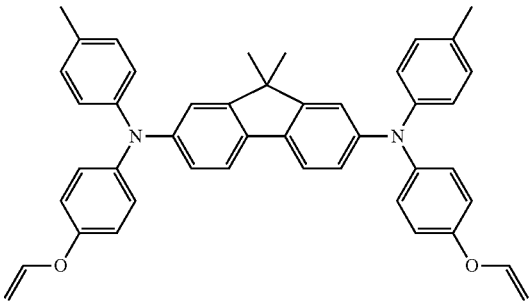

-continued
ii-41
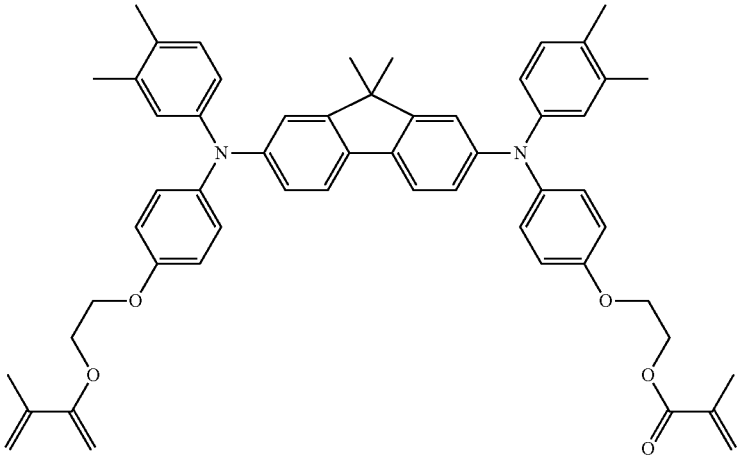
ii-42
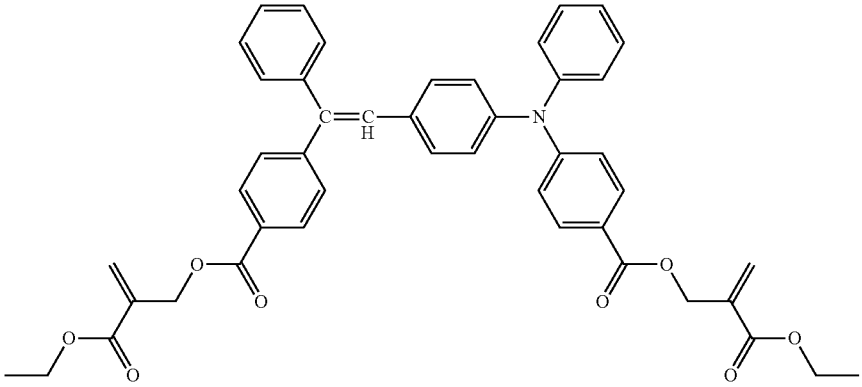
ii-43
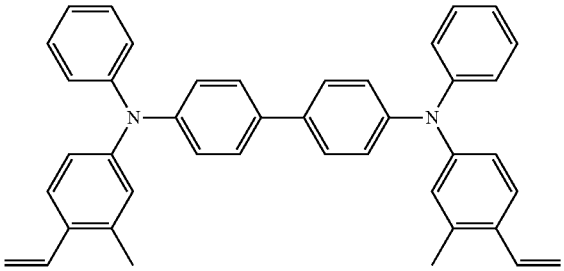
ii-44
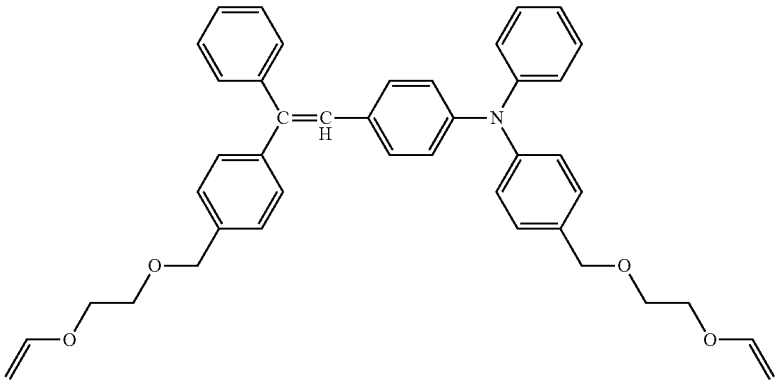

-continued
ii-45
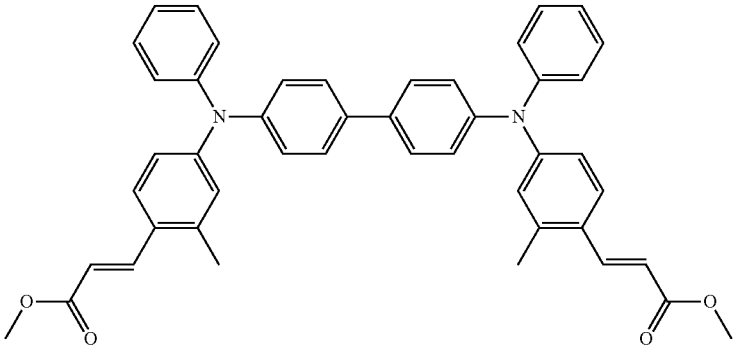
ii-46
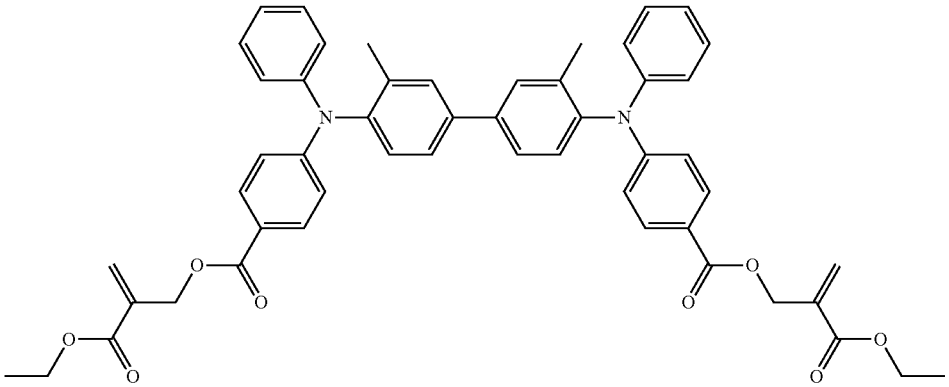
ii-47
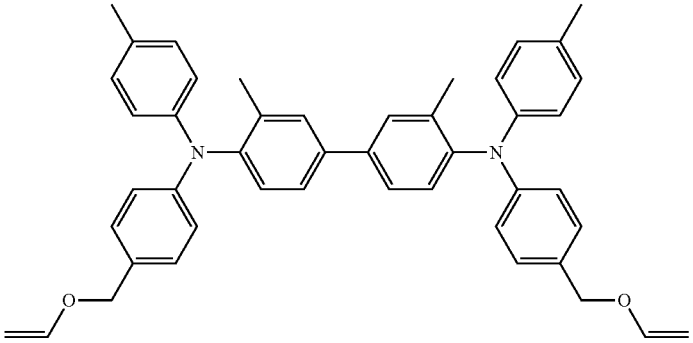
ii-48
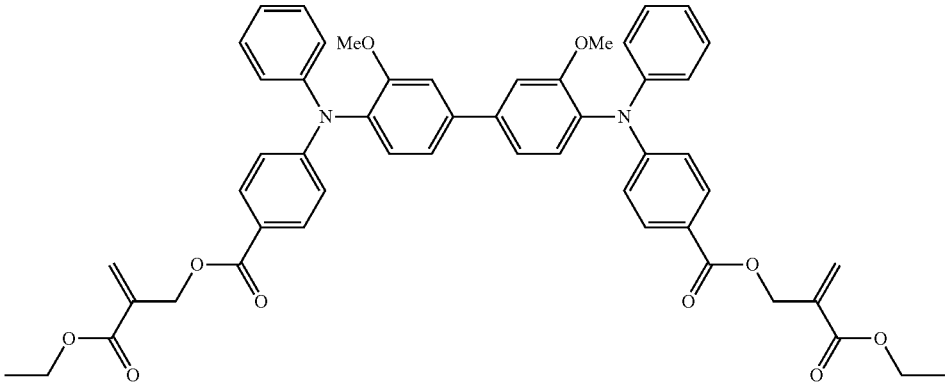

-continued
ii-49
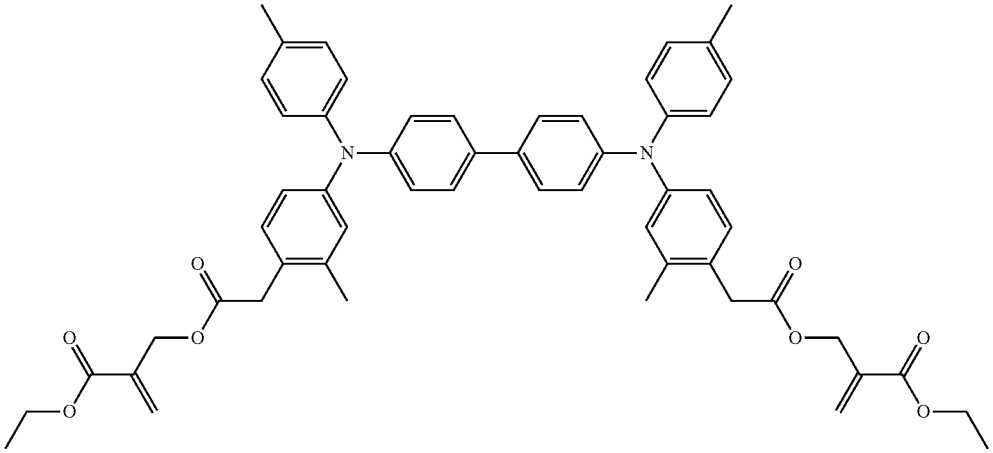
ii-50
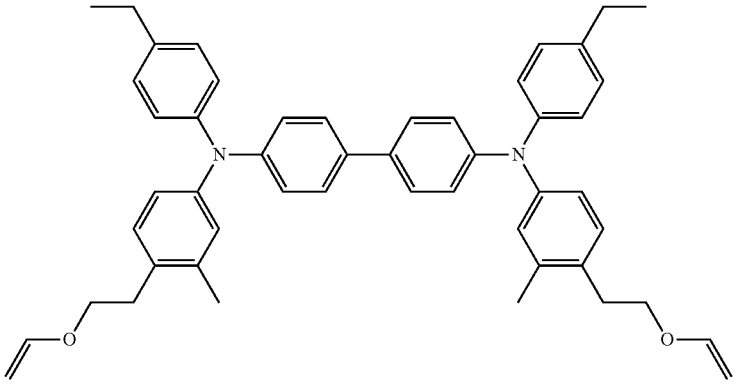
ii-51
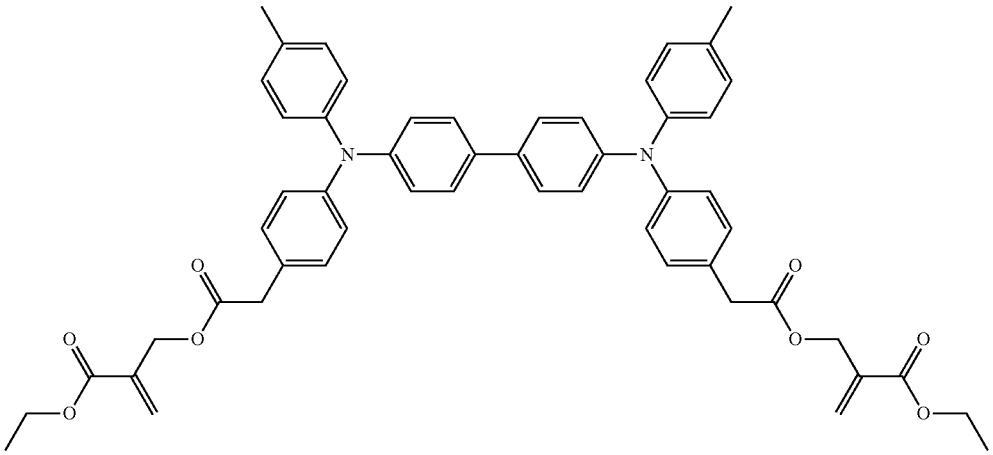

-continued
ii-52
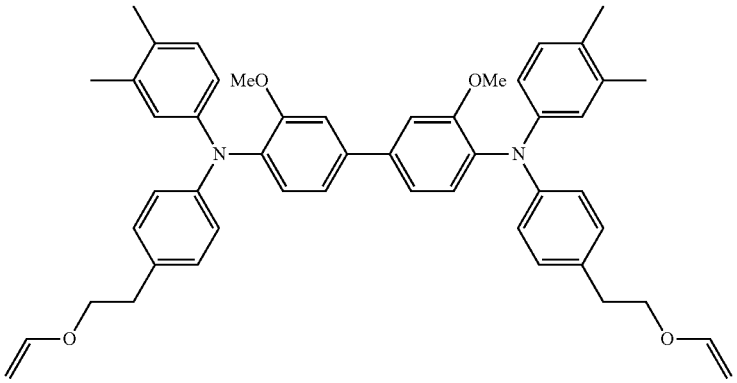
ii-53
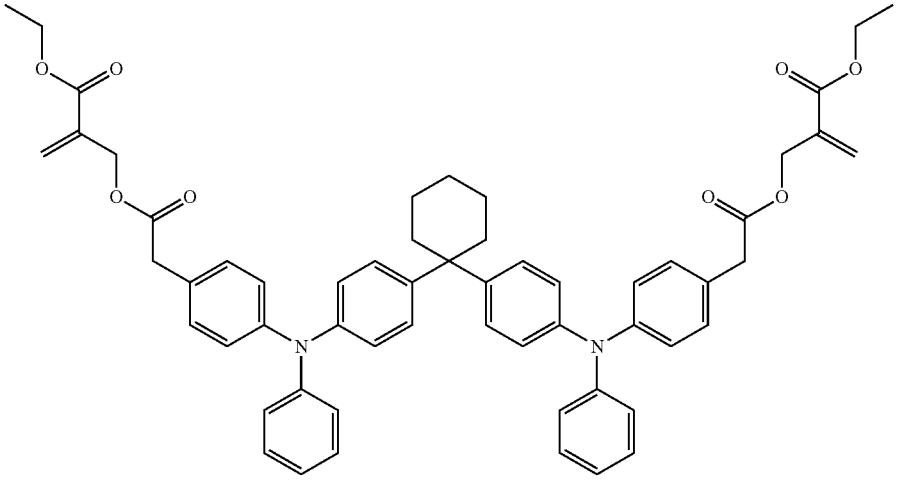
ii-54
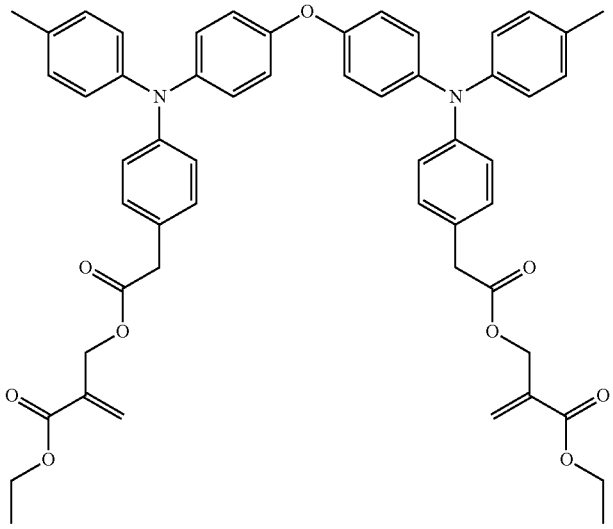

-continued
ii-55
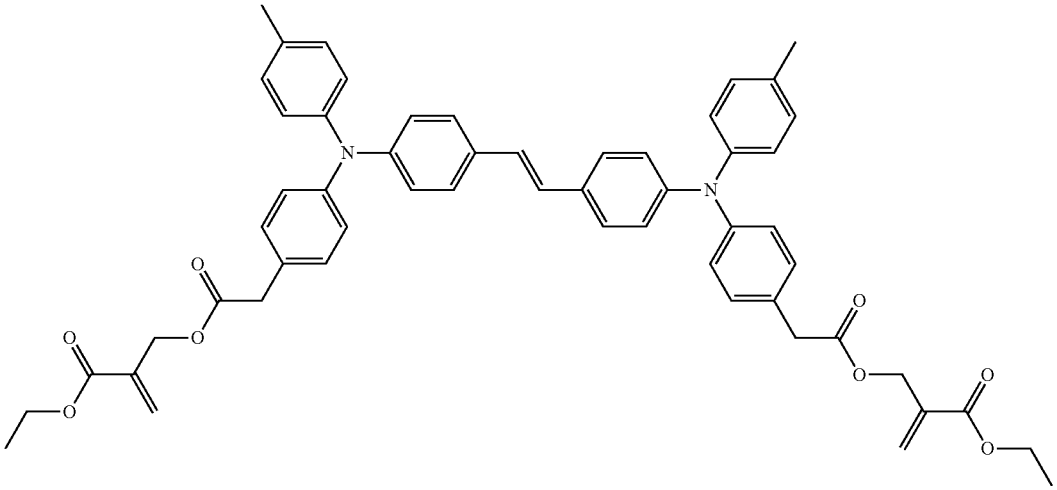
ii-56
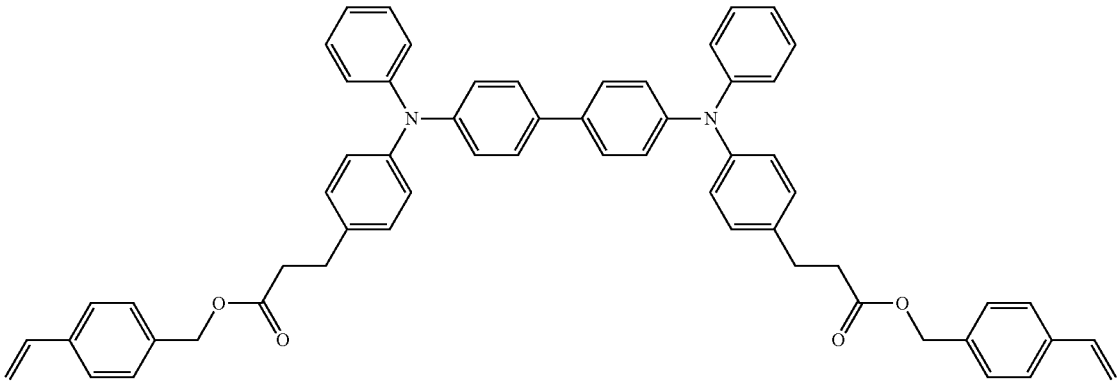
Next, the following compounds are given as non-limiting examples of the reactive monomer having charge transport property and three reactive groups.
iii-1
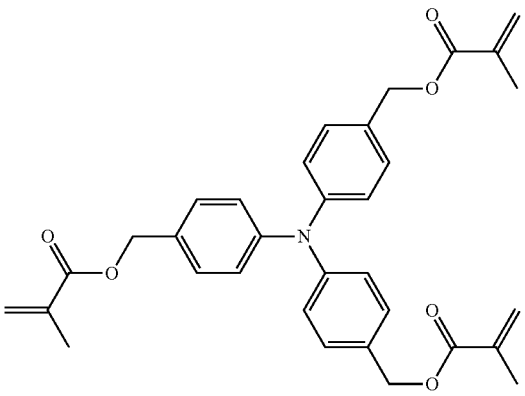
iii-2
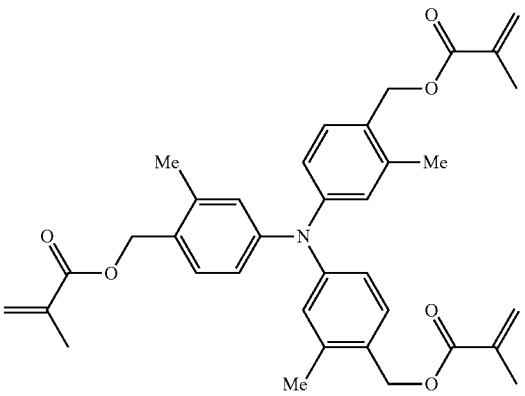

-continued
iii-3
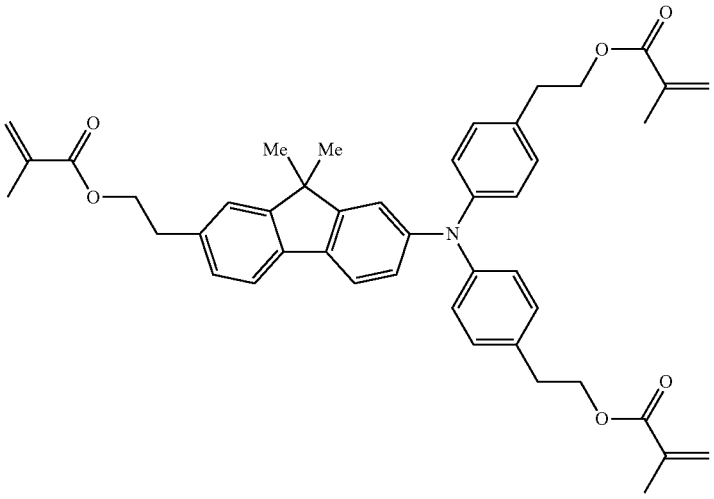
iii-4
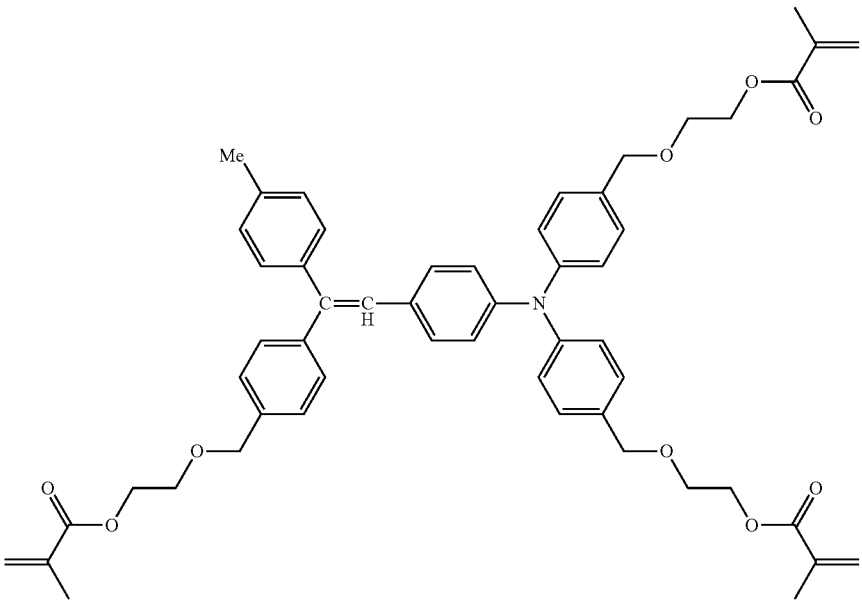

-continued
iii-5
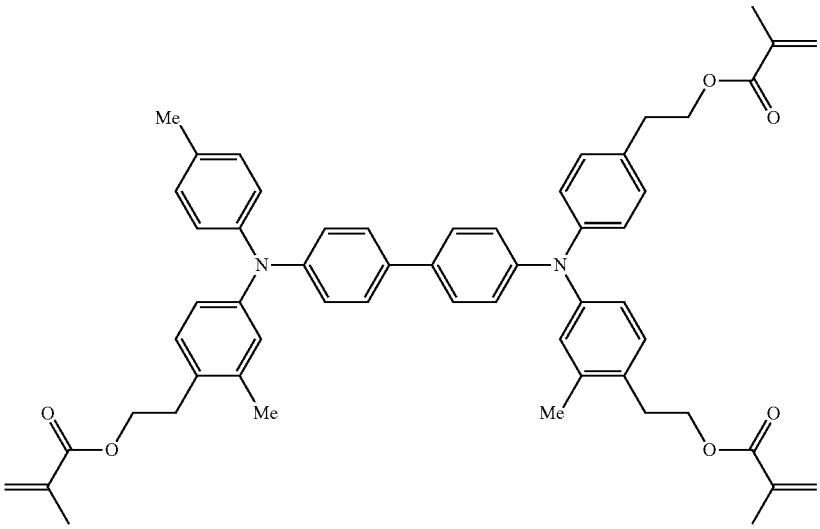
iii-6
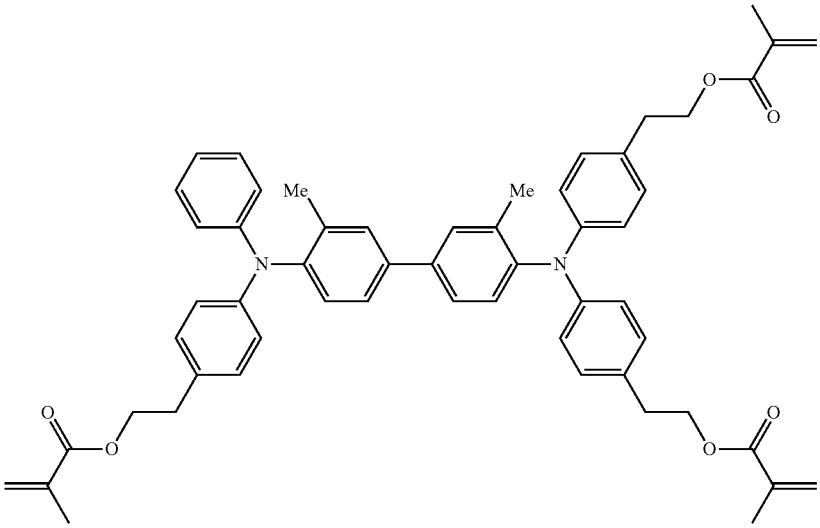
iii-7
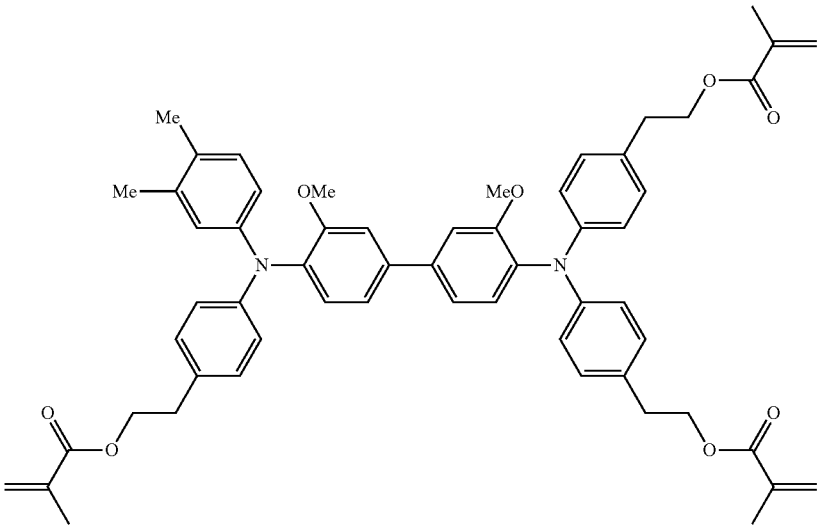

-continued
iii-8
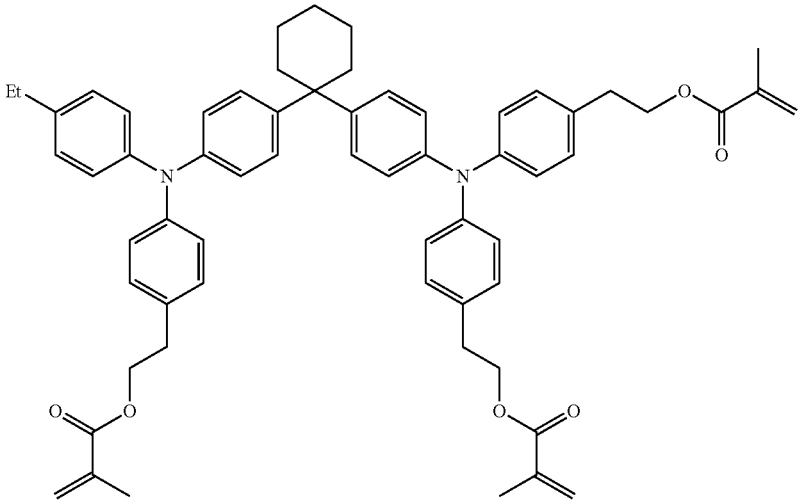
iii-9
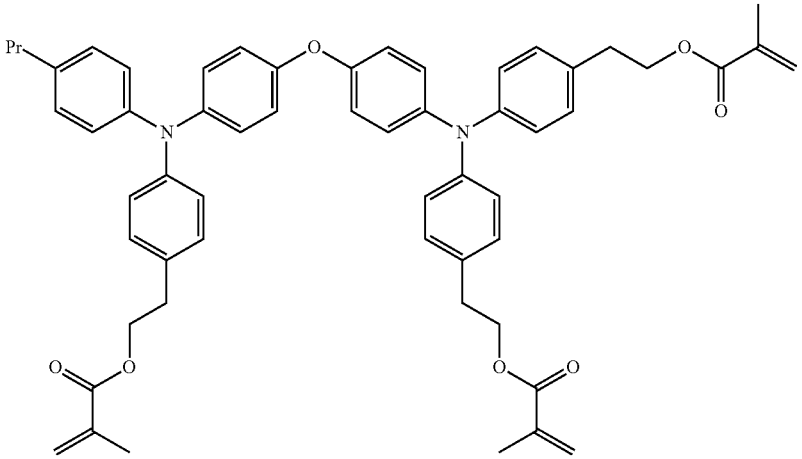
iii-10
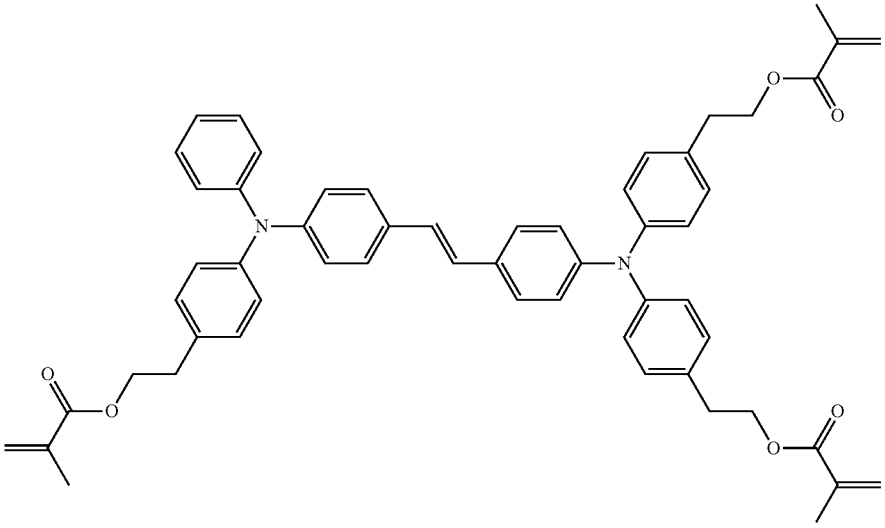

-continued
iii-11
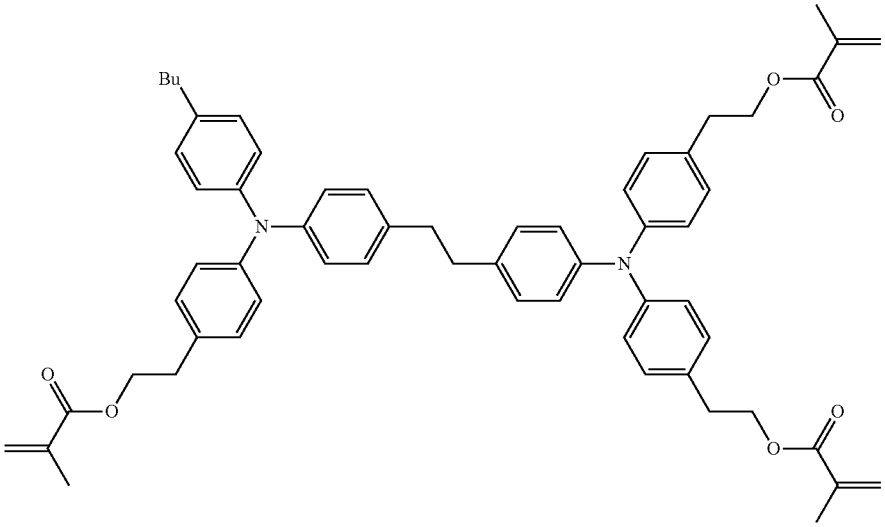
iii-12
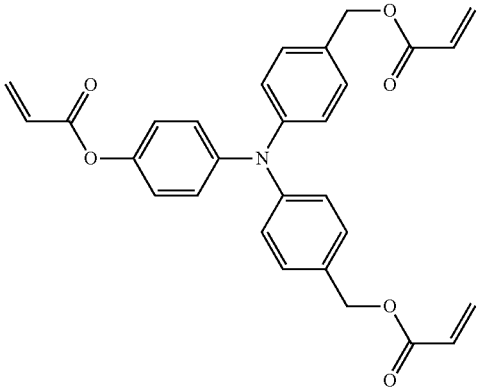
iii-13
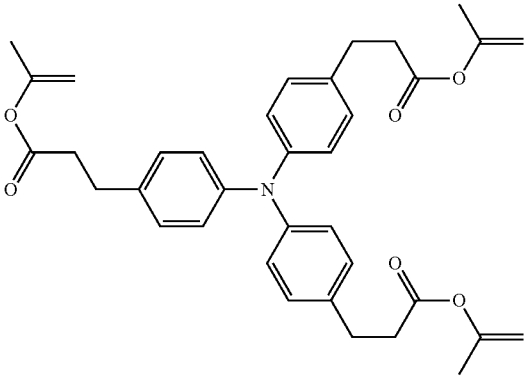
iii-14
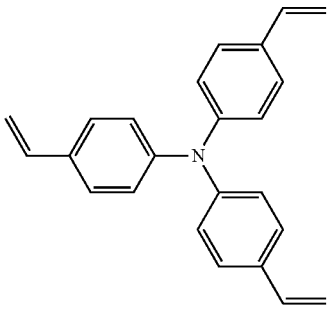
iii-15
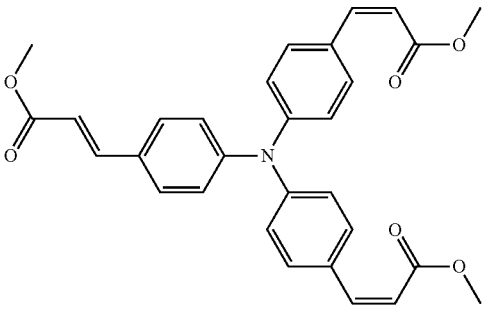
iii-16
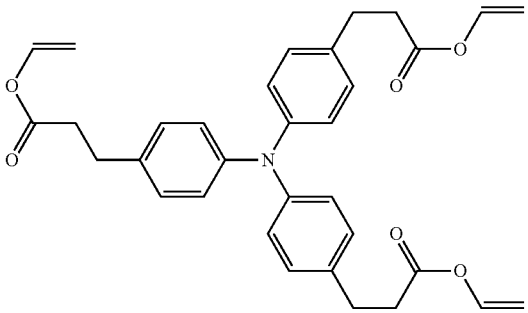

-continued
iii-17
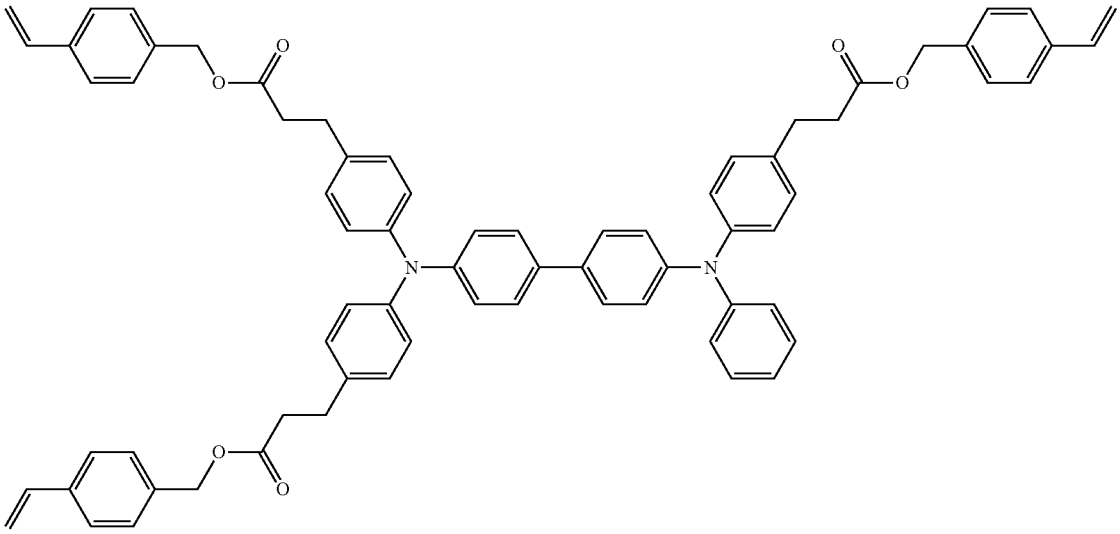
iii-18
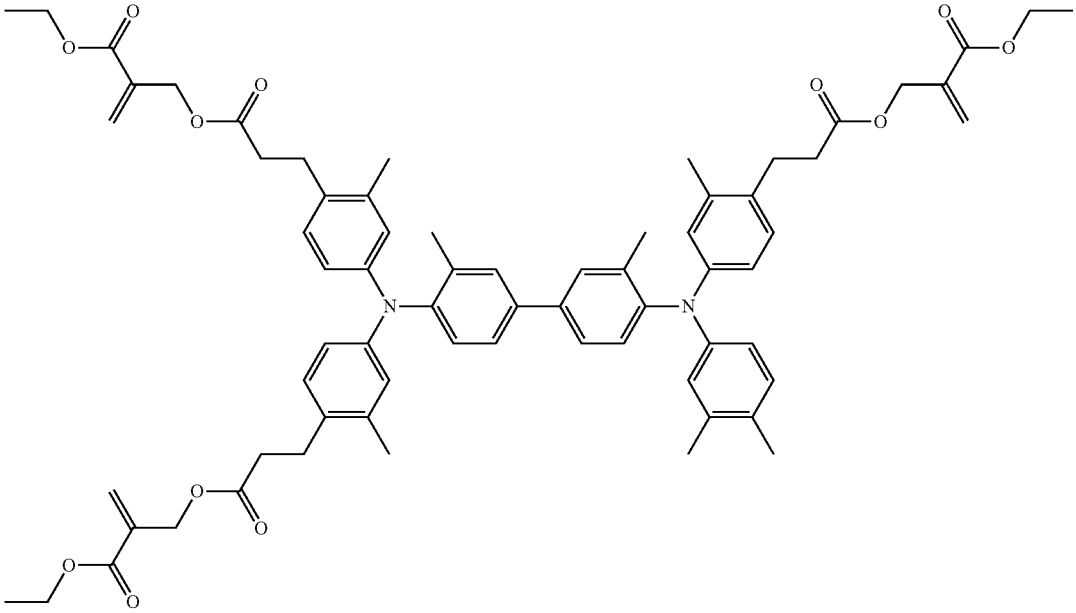

-continued
iii-19
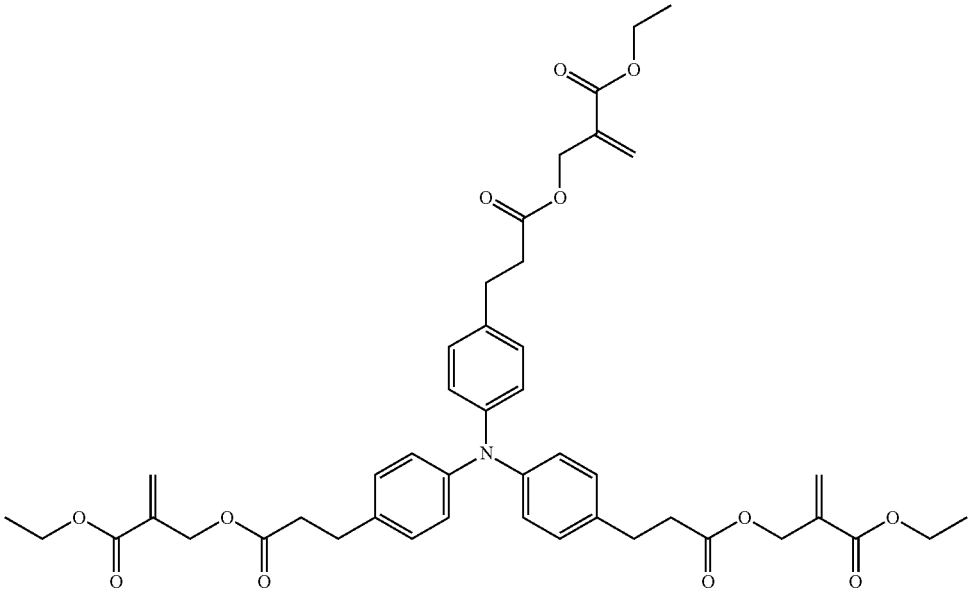
The following compounds are given as non-limiting examples of the reactive monomer having charge transport property and four reactive groups.
iv-1
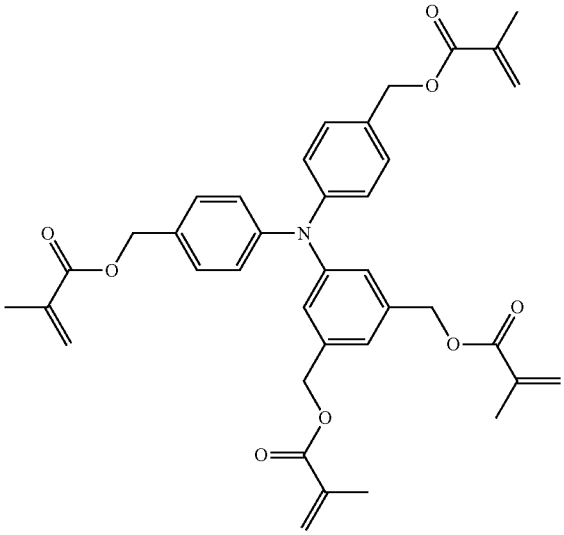

-continued
iv-2
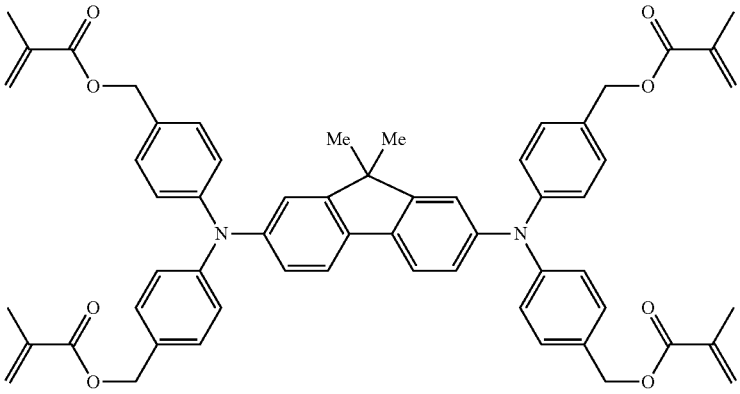
iv-3
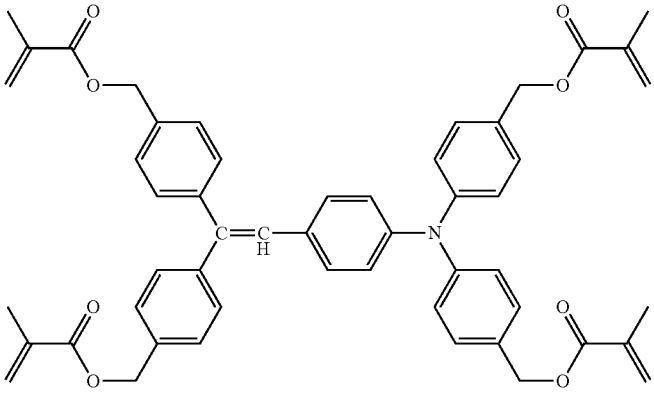
iv-4
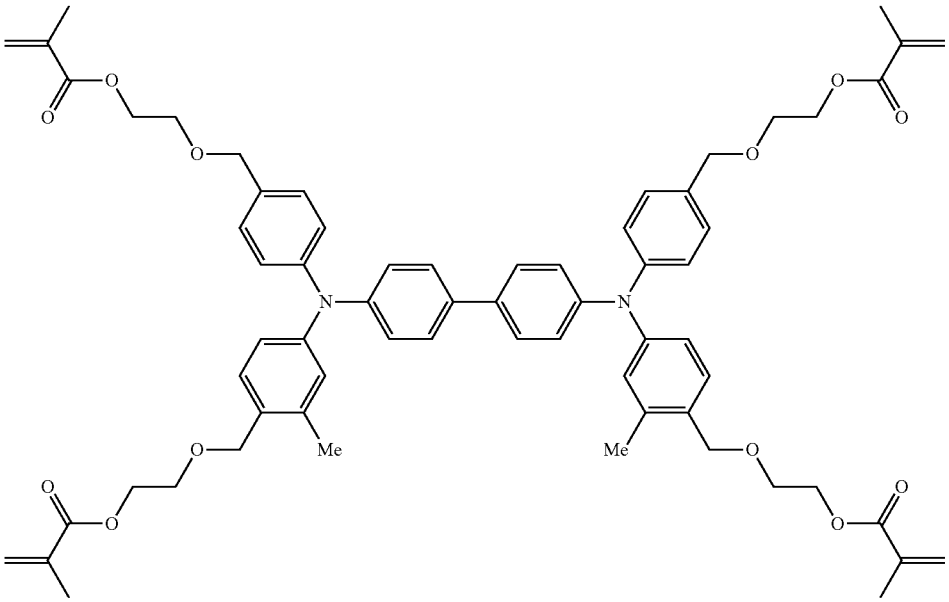

-continued
iv-5
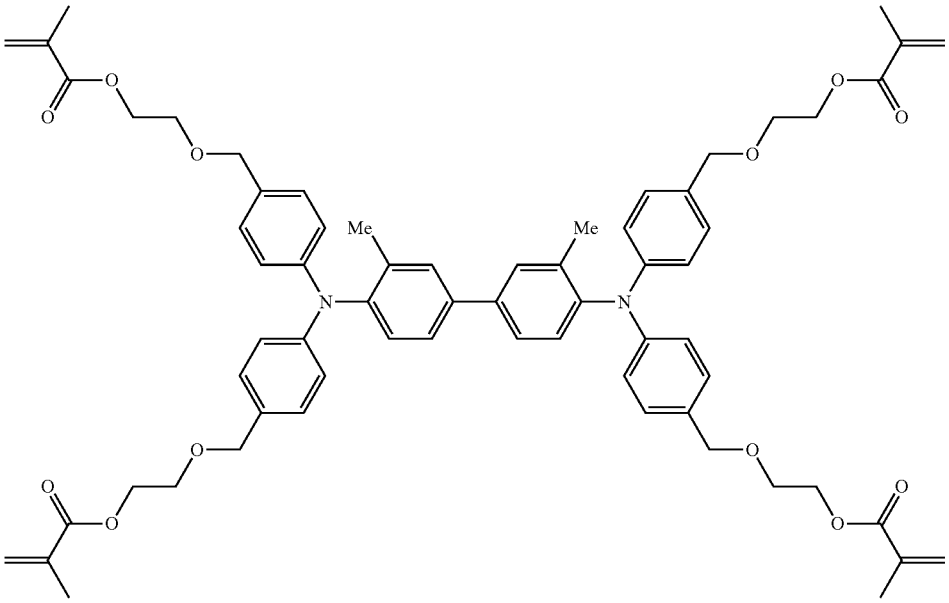
iv-6
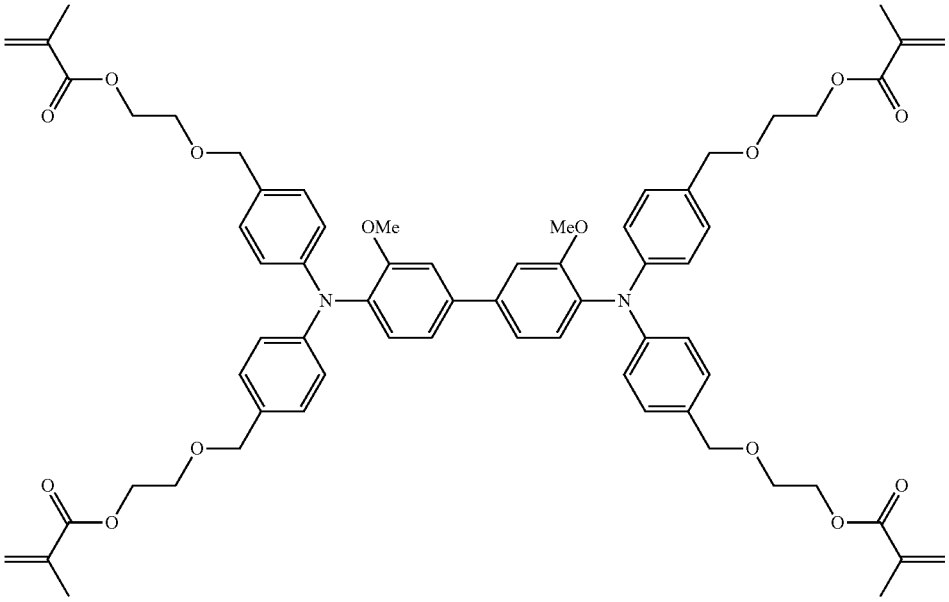

-continued
iv-7
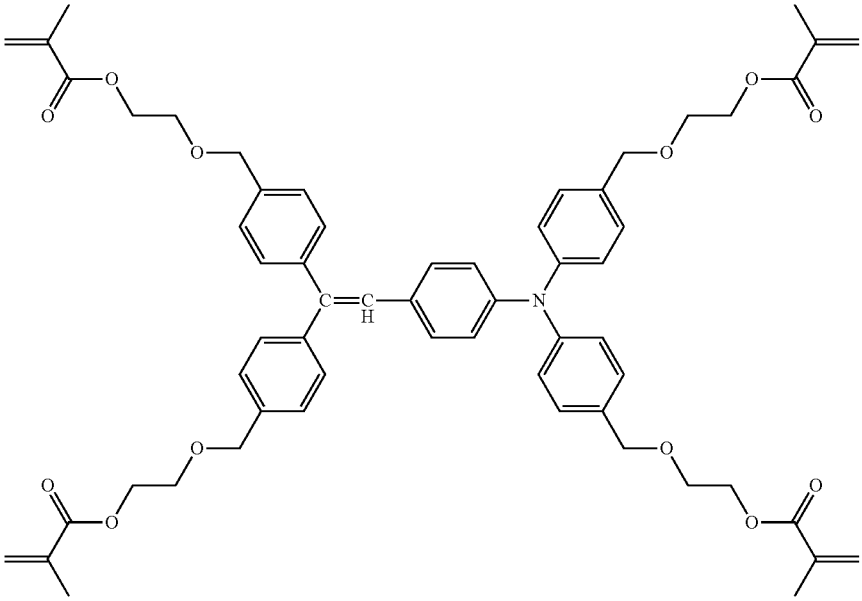
iv-8
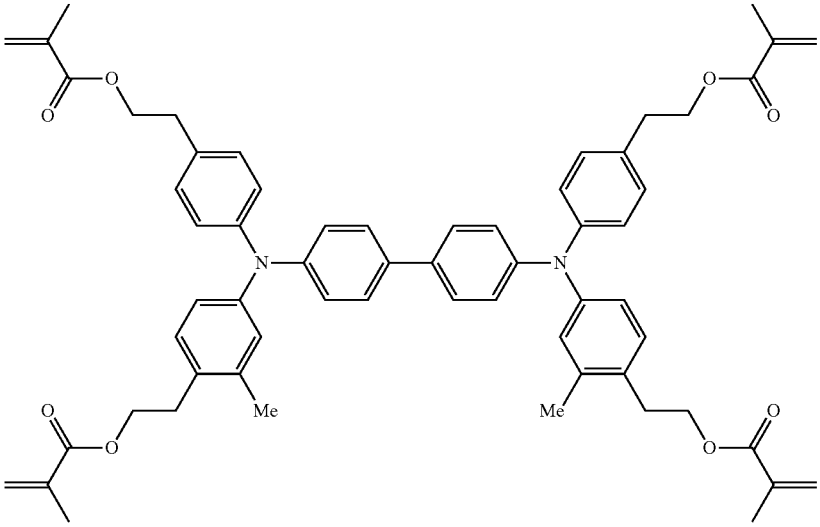
iv-9
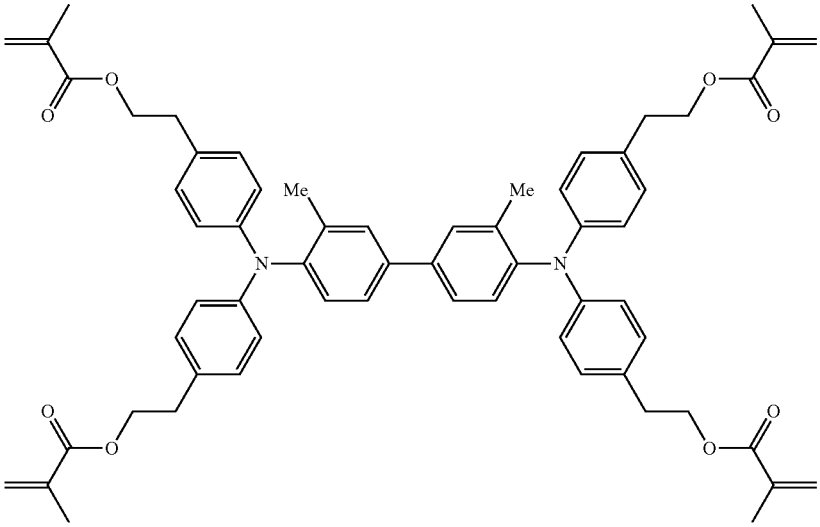

-continued
iv-10
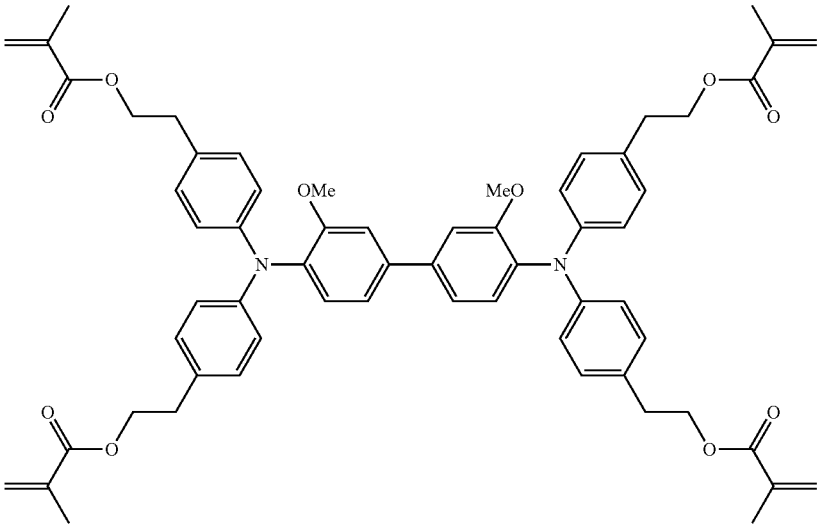
iv-11
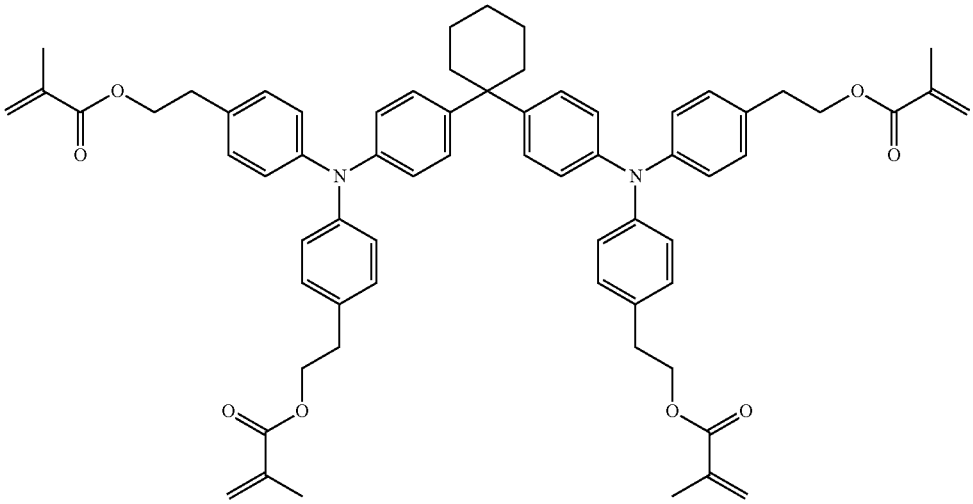
iv-12
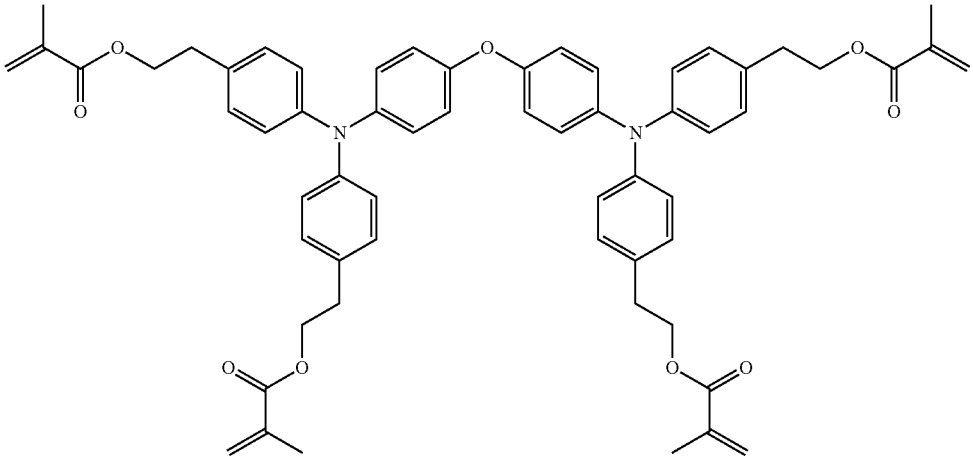

-continued
iv-13
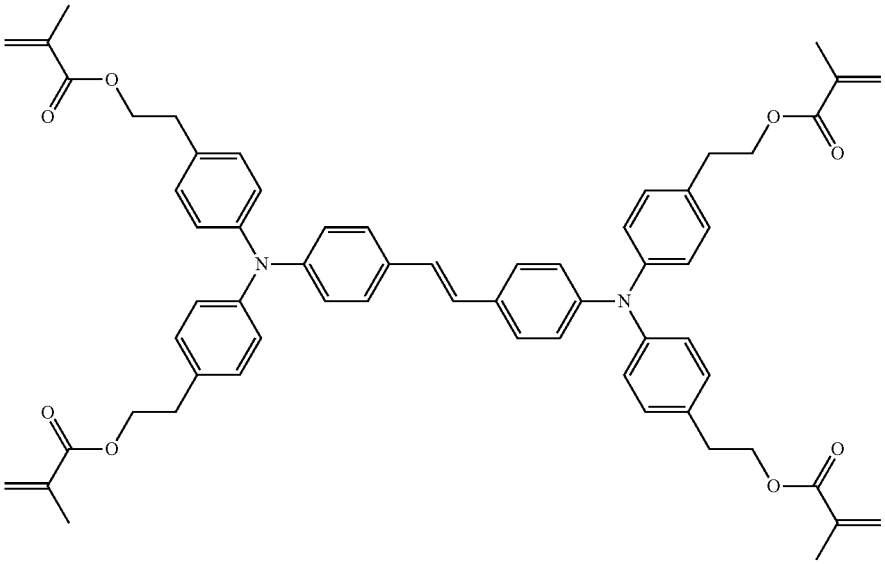
iv-14
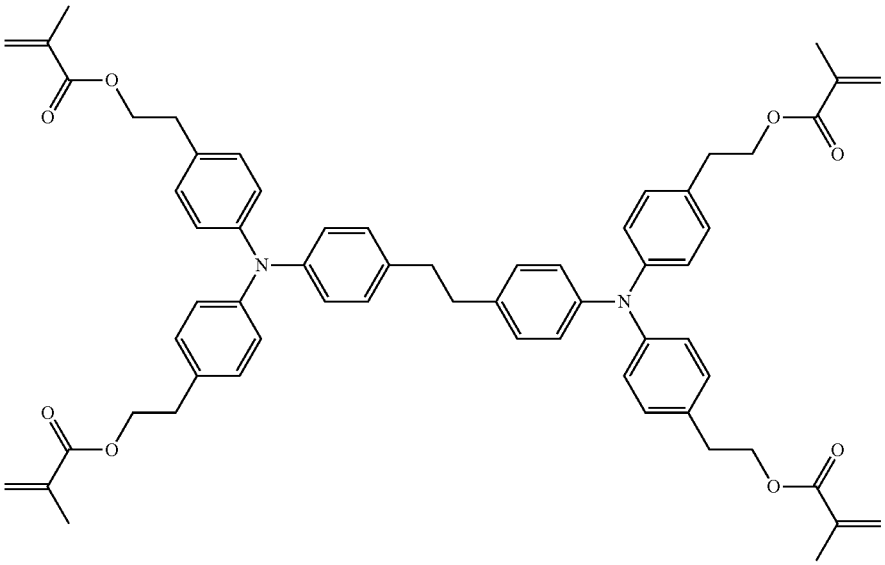
iv-15
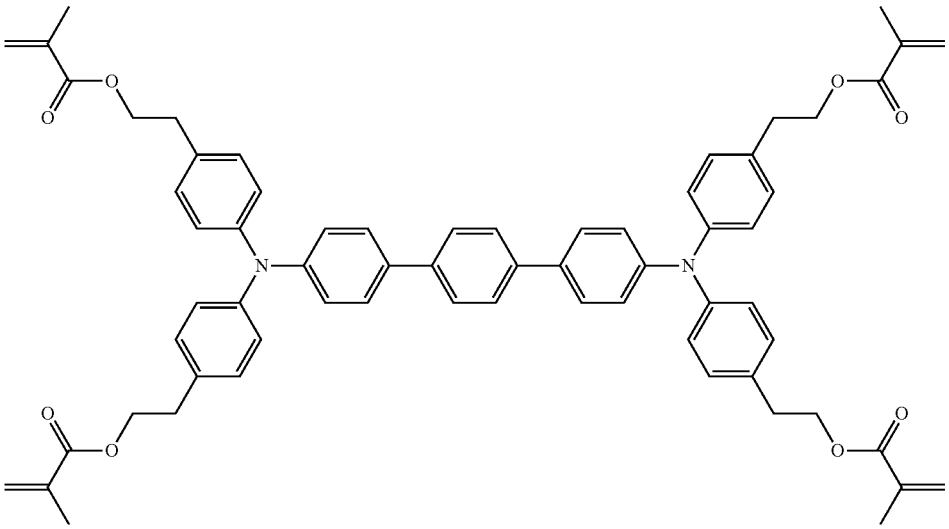

-continued
iv-16
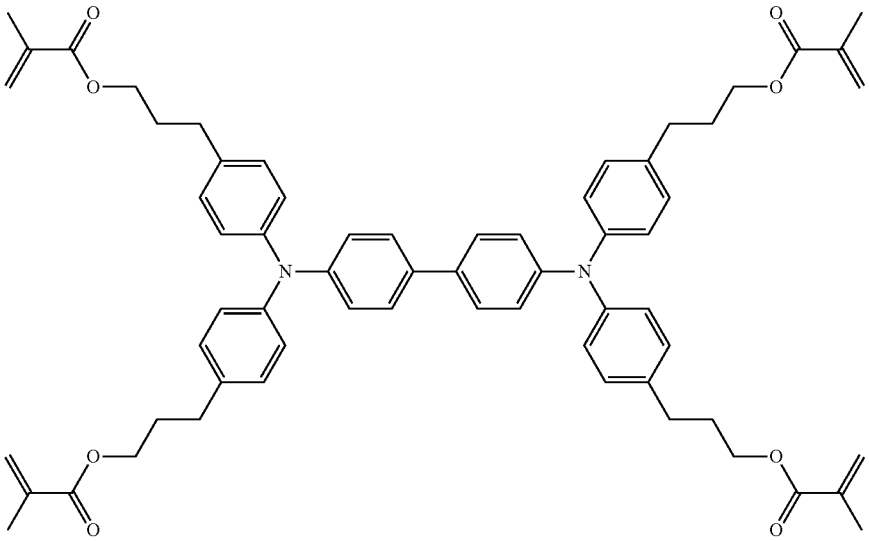
iv-17
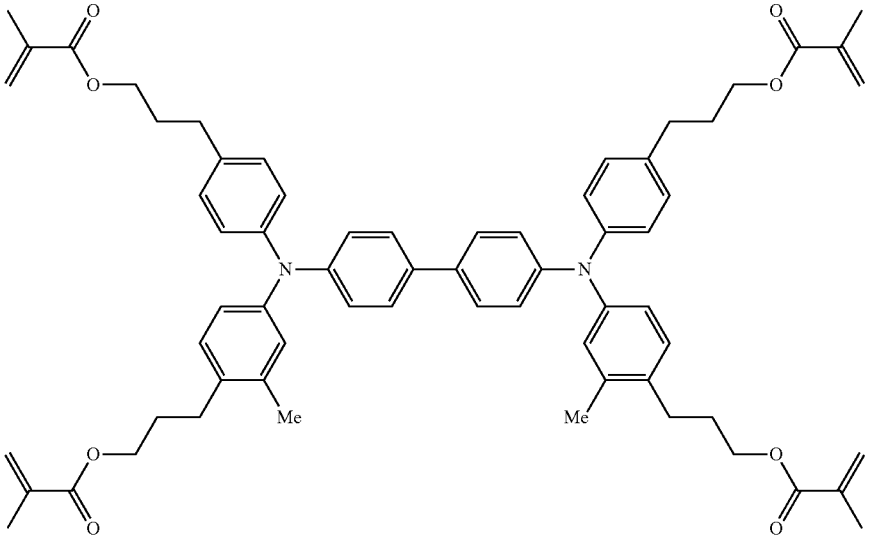
iv-18
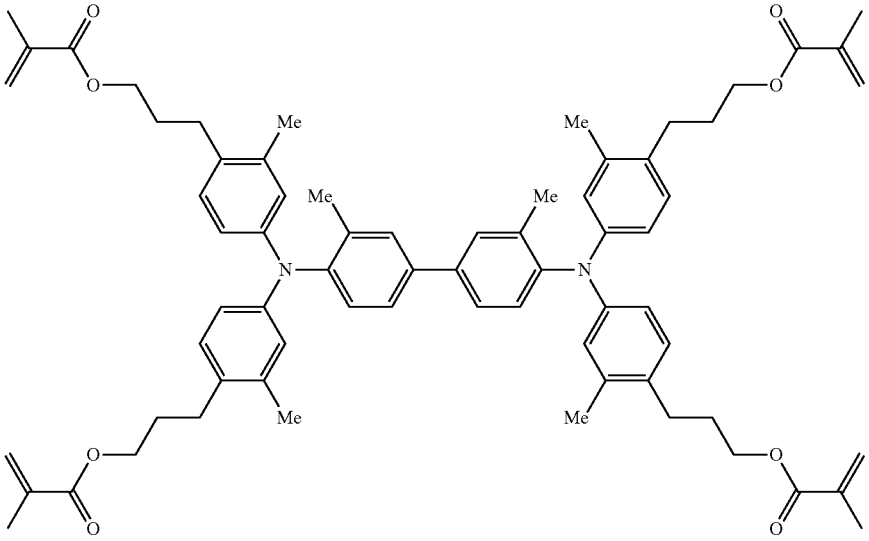

-continued
iv-19
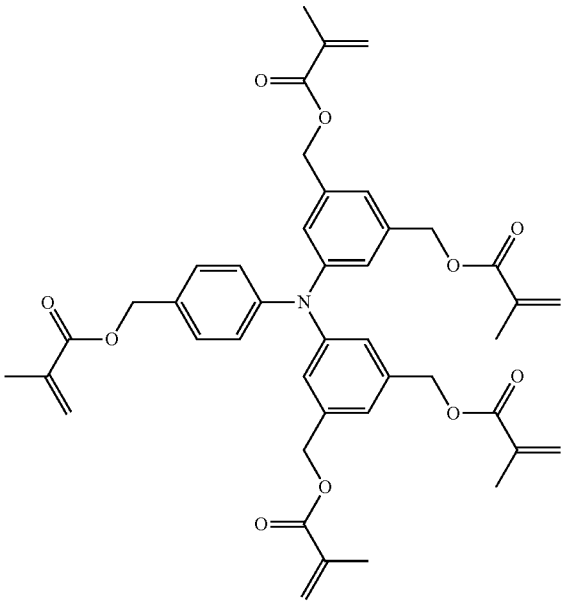
iv-20
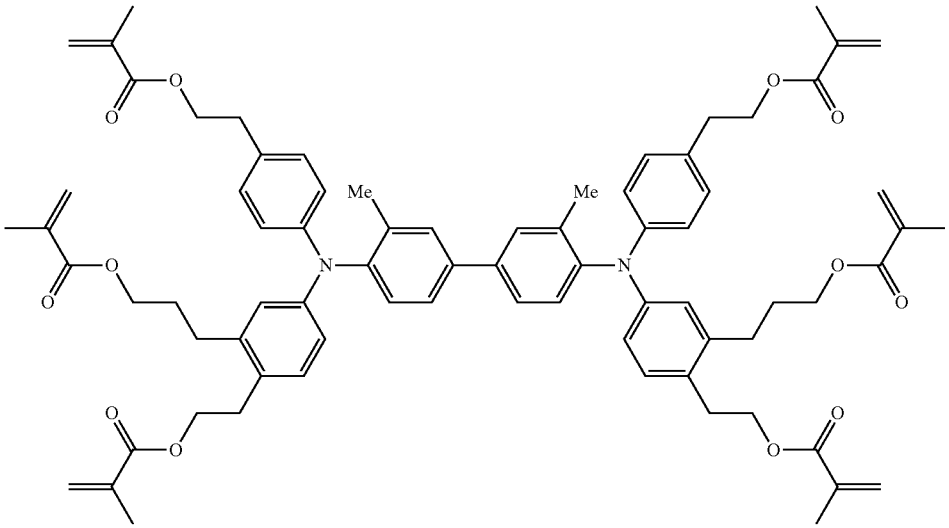

-continued
iv-21
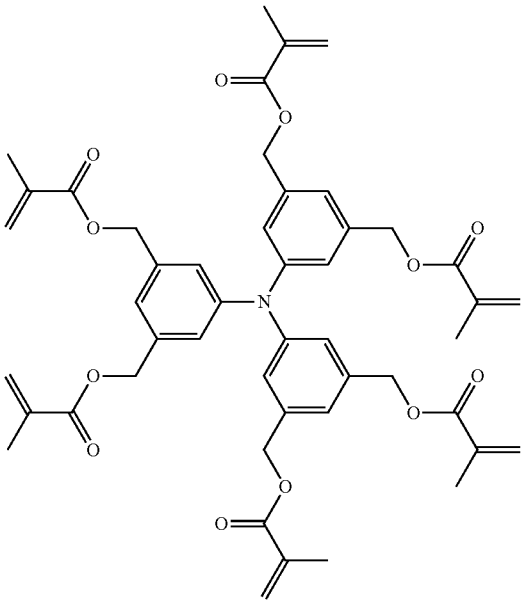
iv-22
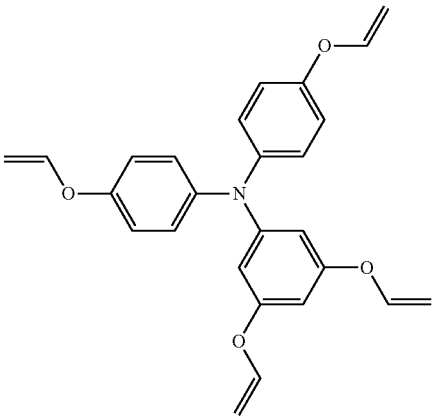
iv-23
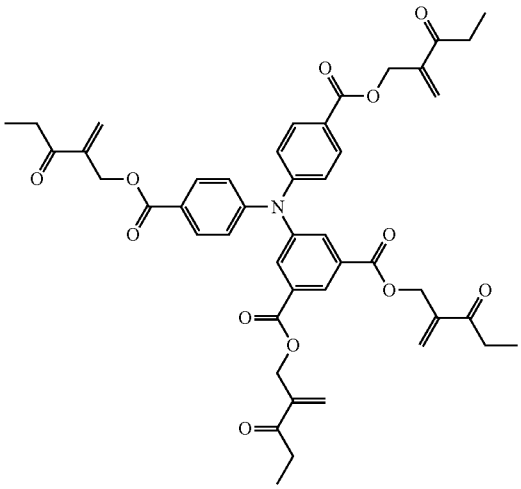
iv-24
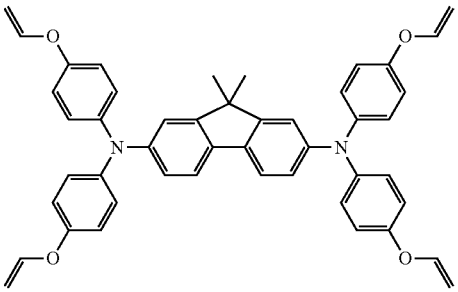

-continued
iv-25
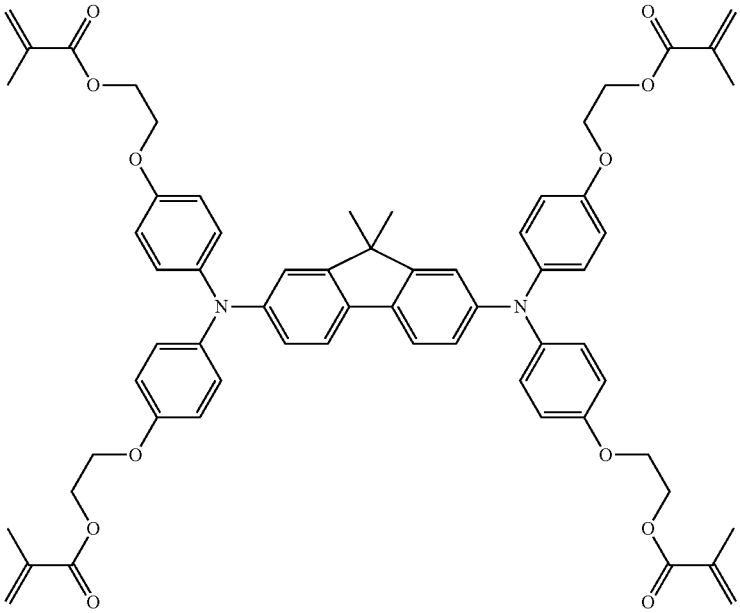
iv-26
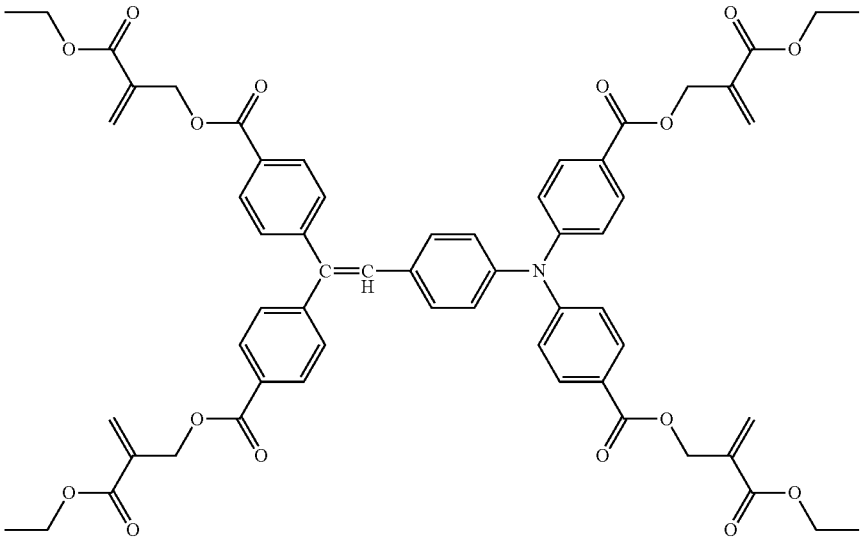

-continued
iv-27
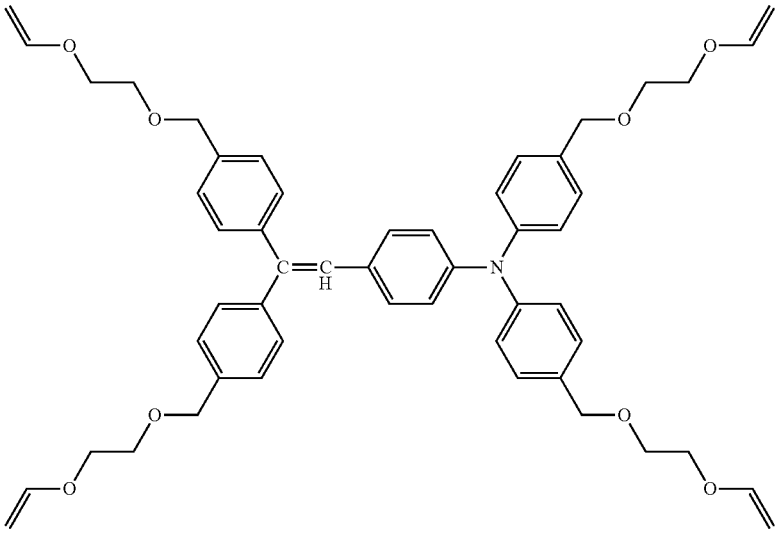
iv-28
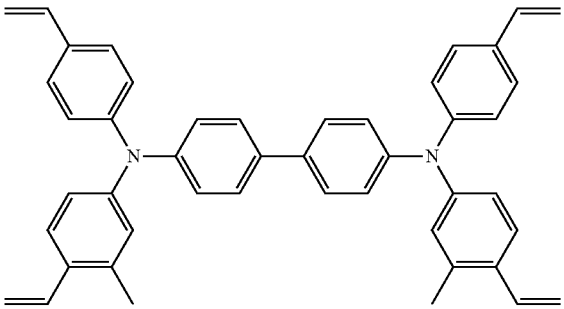
iv-29
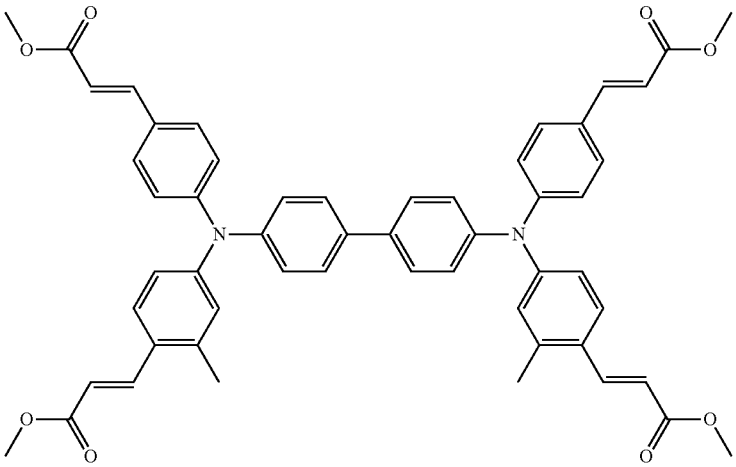

-continued
iv-30
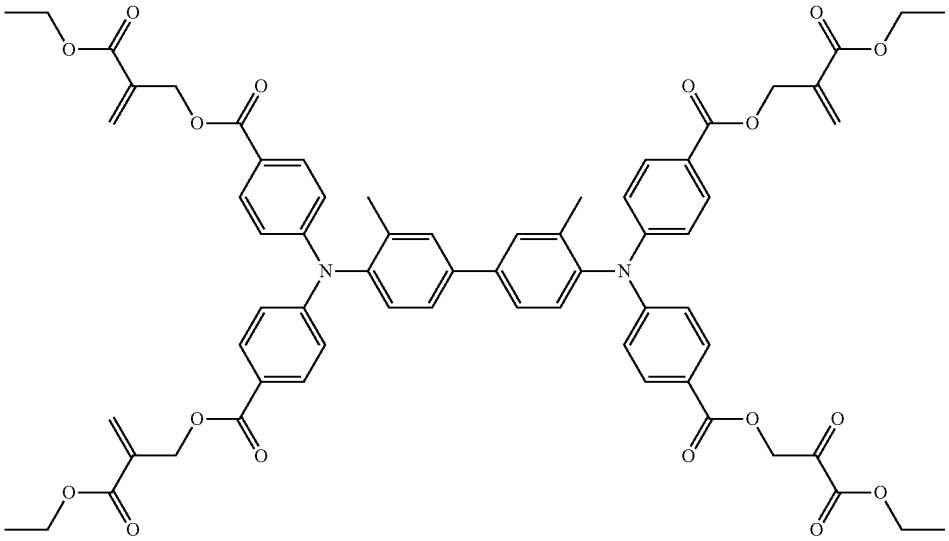
iv-31
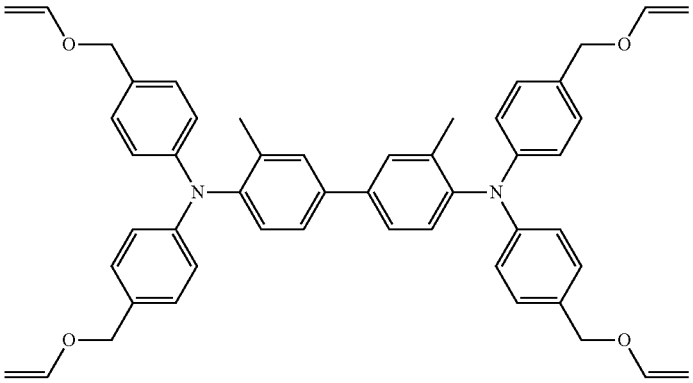
iv-32
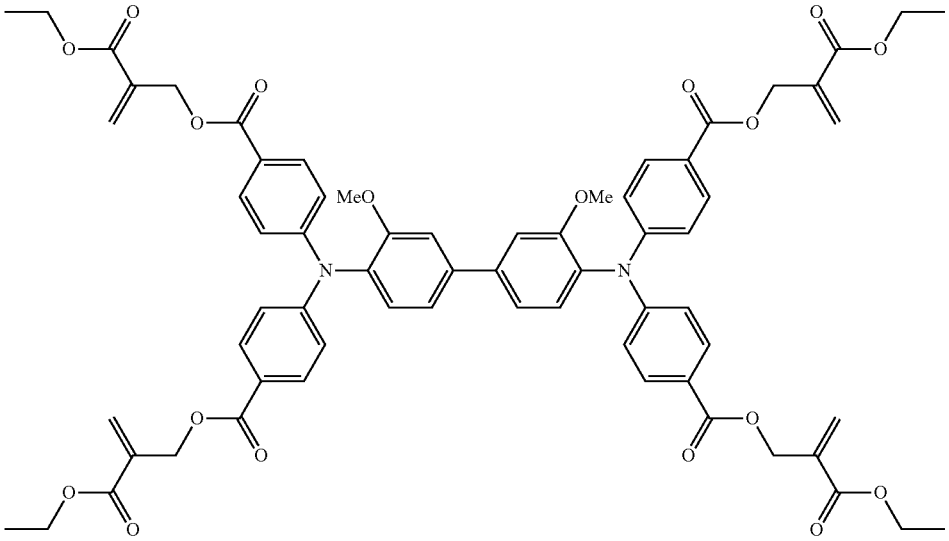

-continued
iv-33
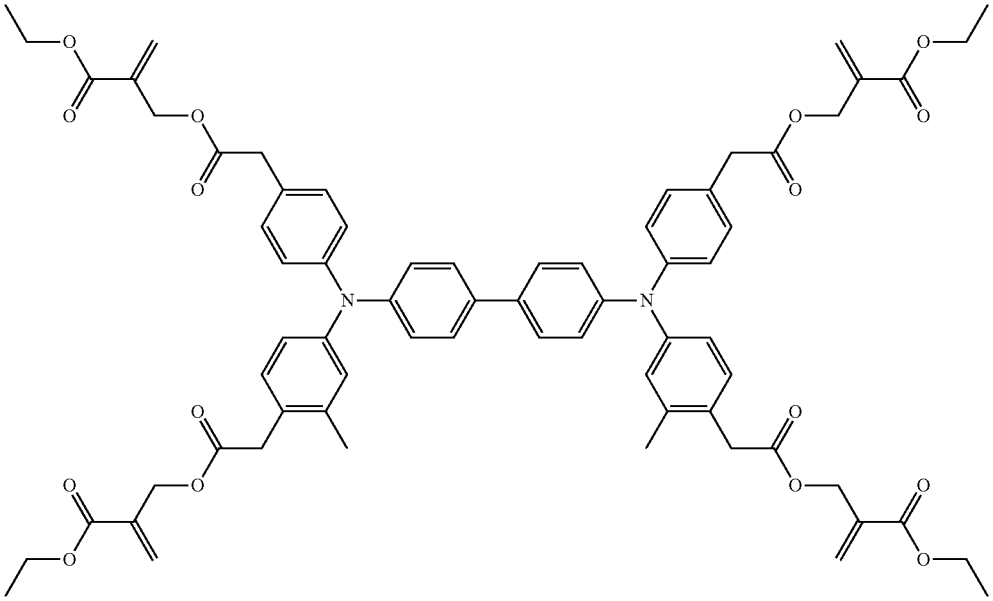
iv-34
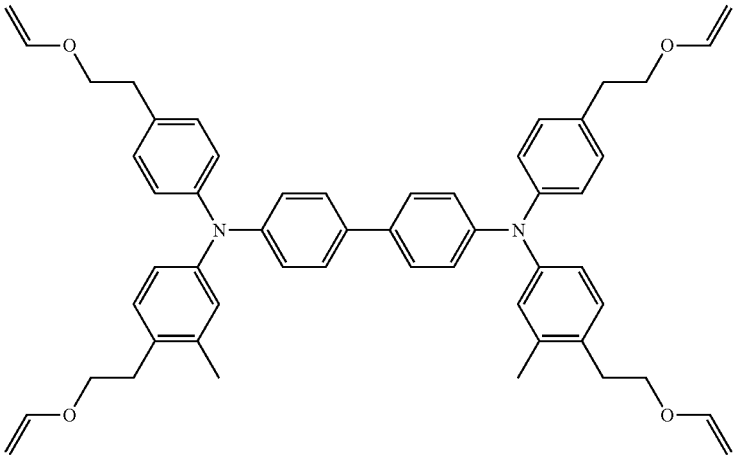
iv-35
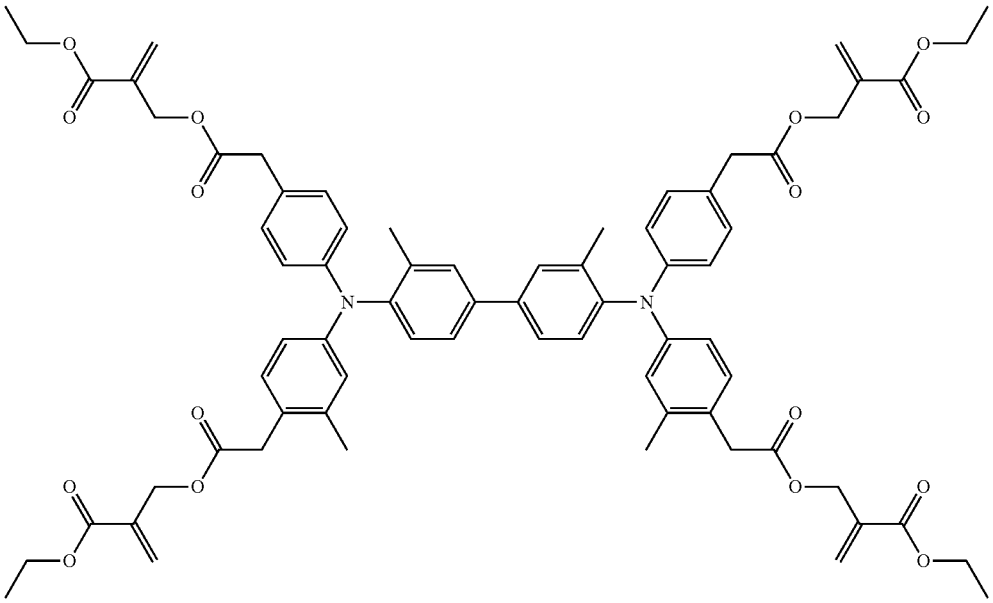

-continued
iv-36
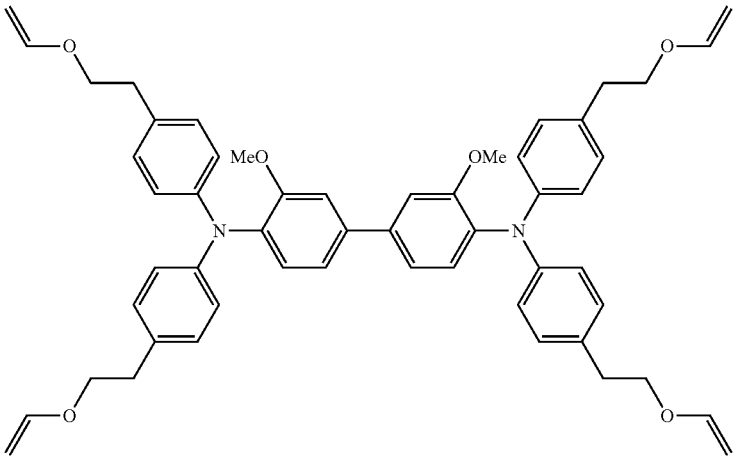
iv-37
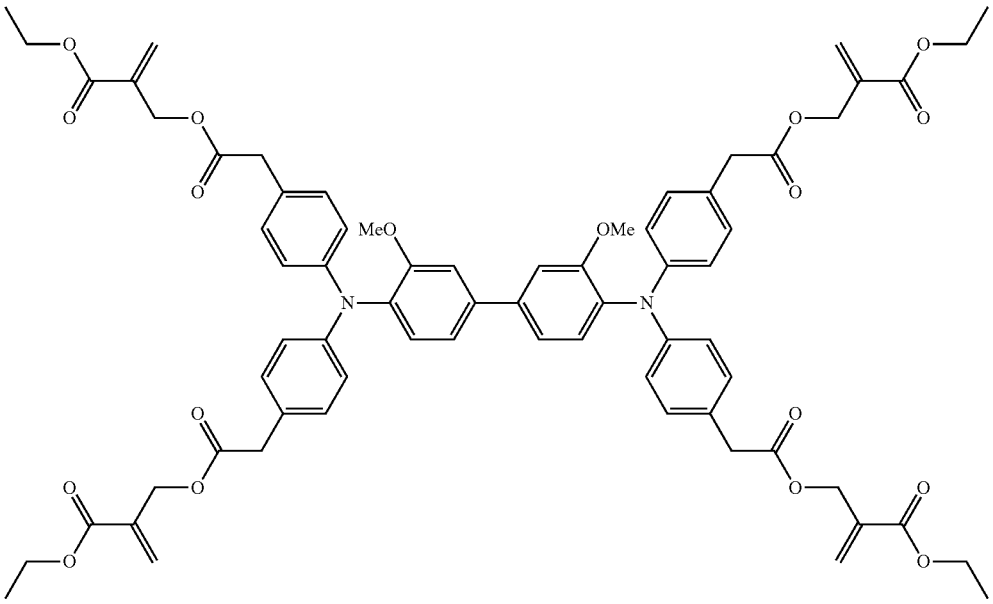

-continued
iv-38
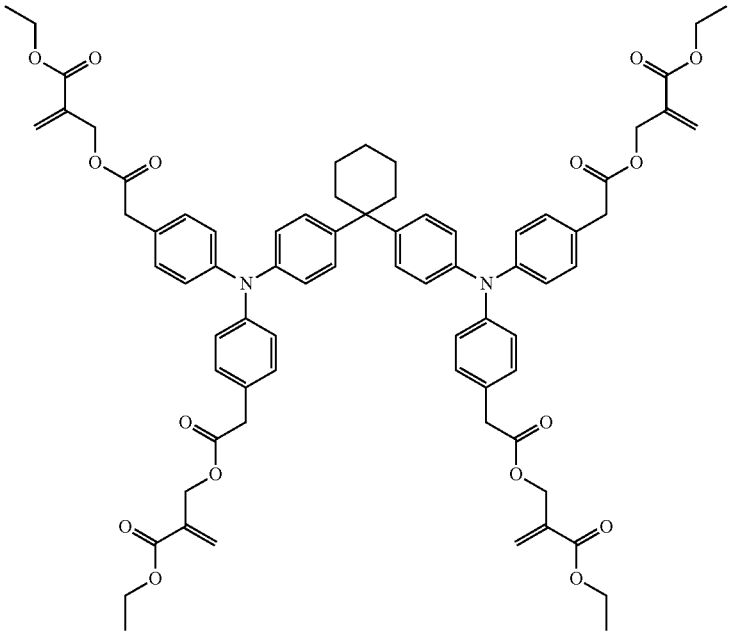
iv-39
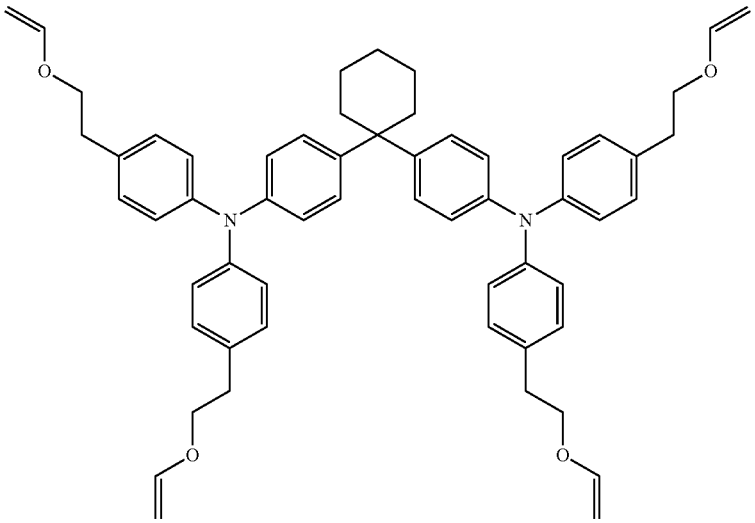

-continued
iv-40
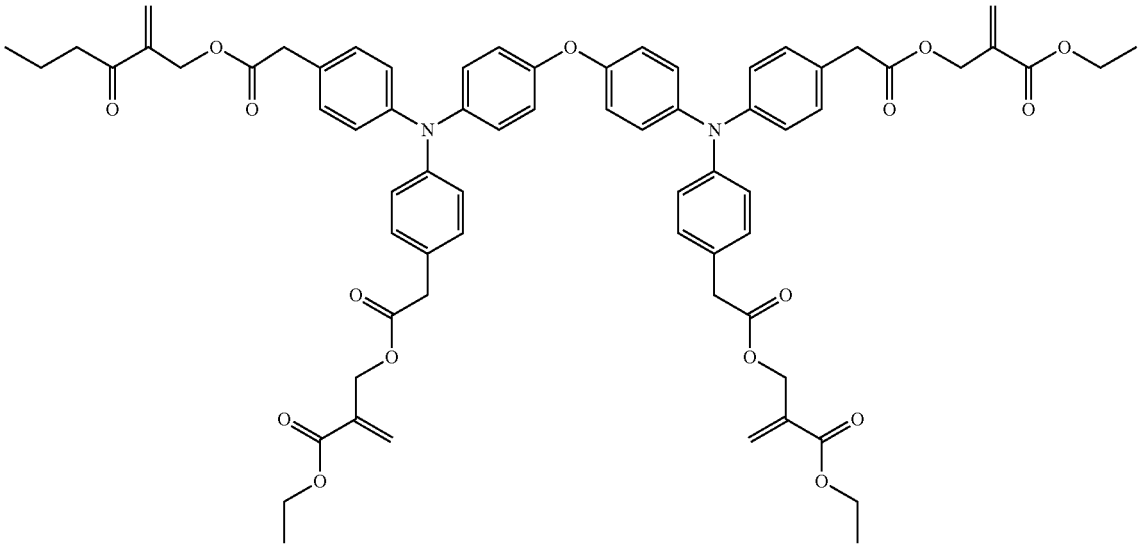
iv-41
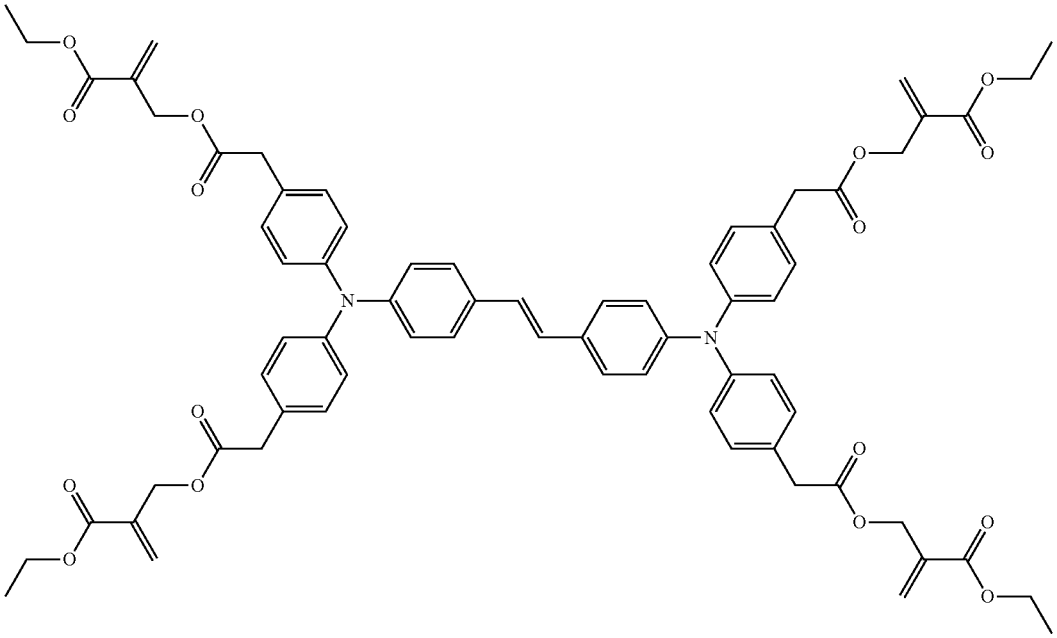

-continued
iv-42
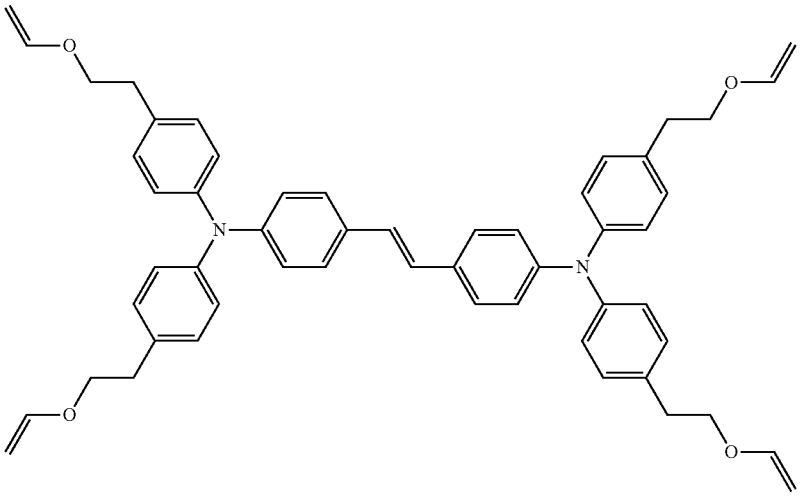
iv-43
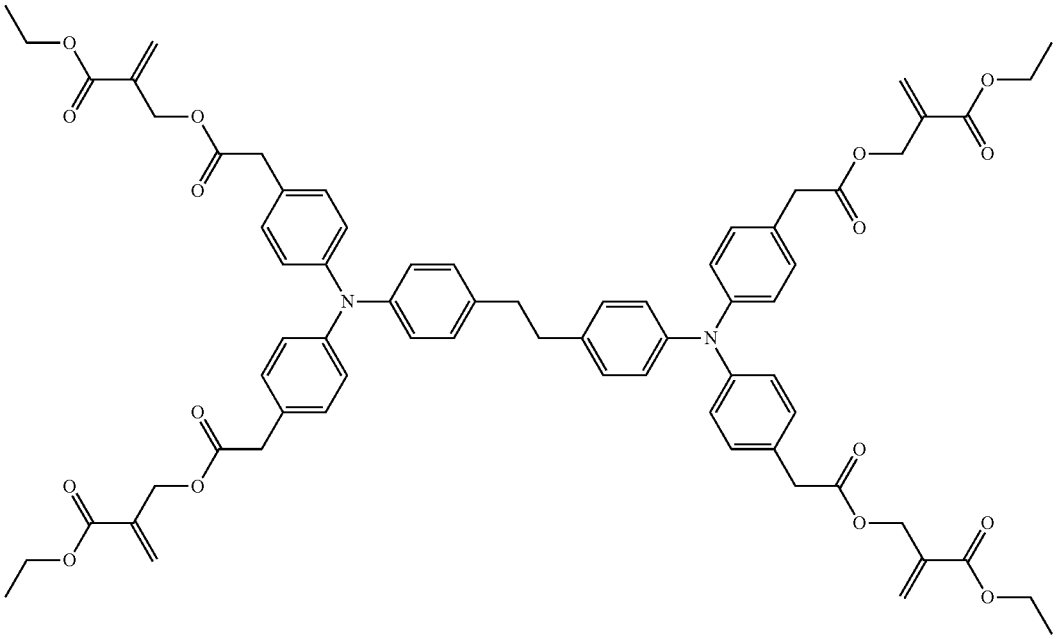
iv-44
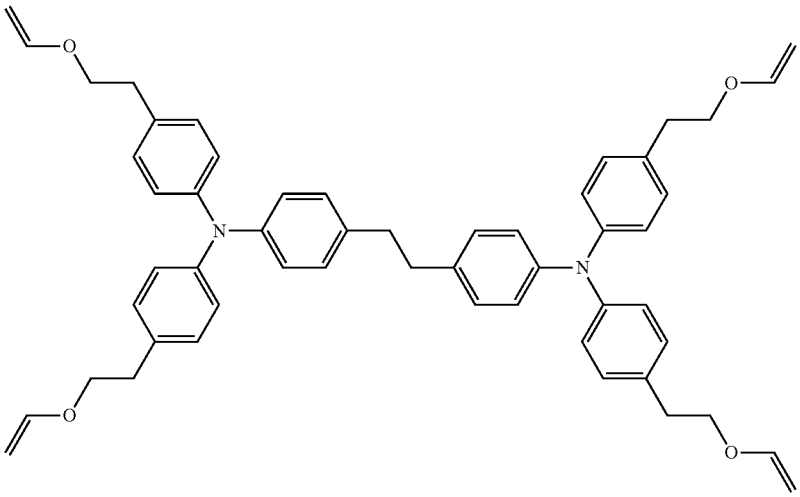

-continued
iv-45
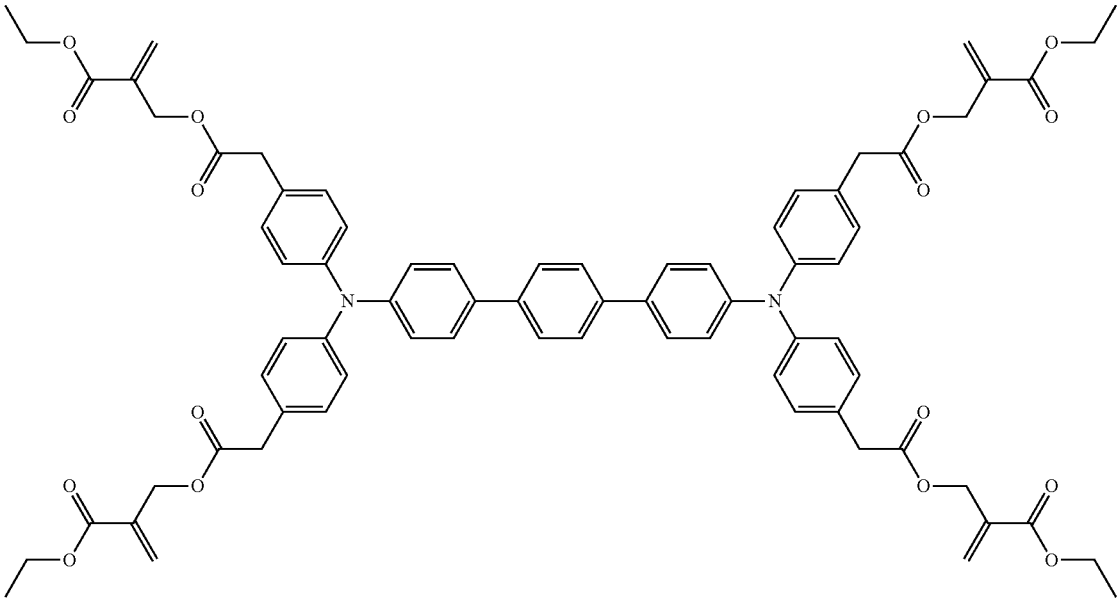
iv-46
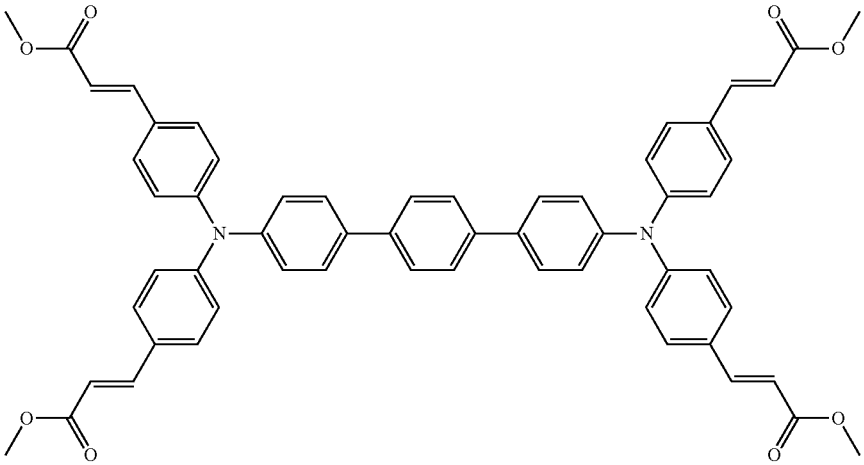
iv-47
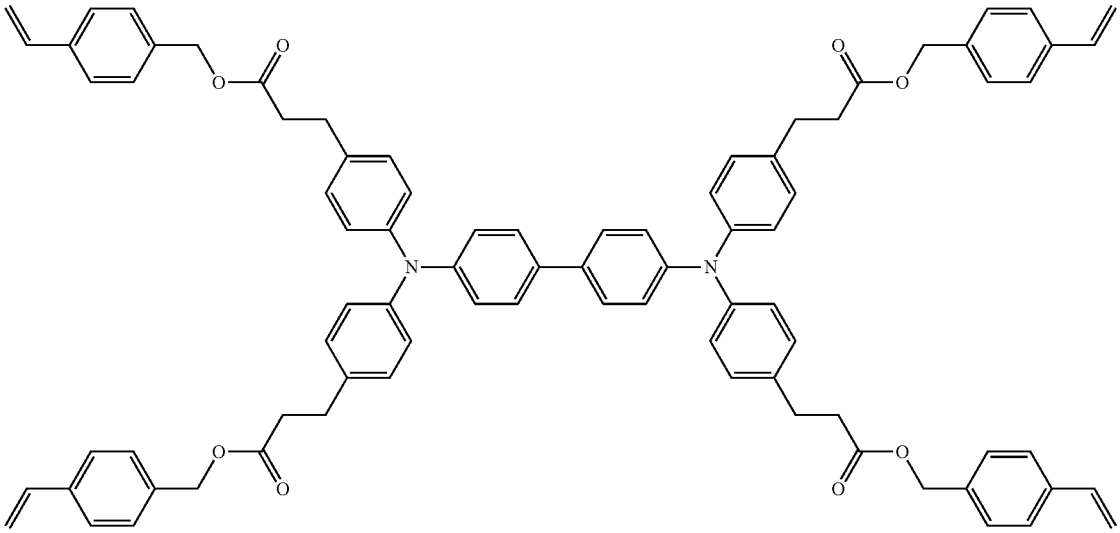

-continued
iv-48
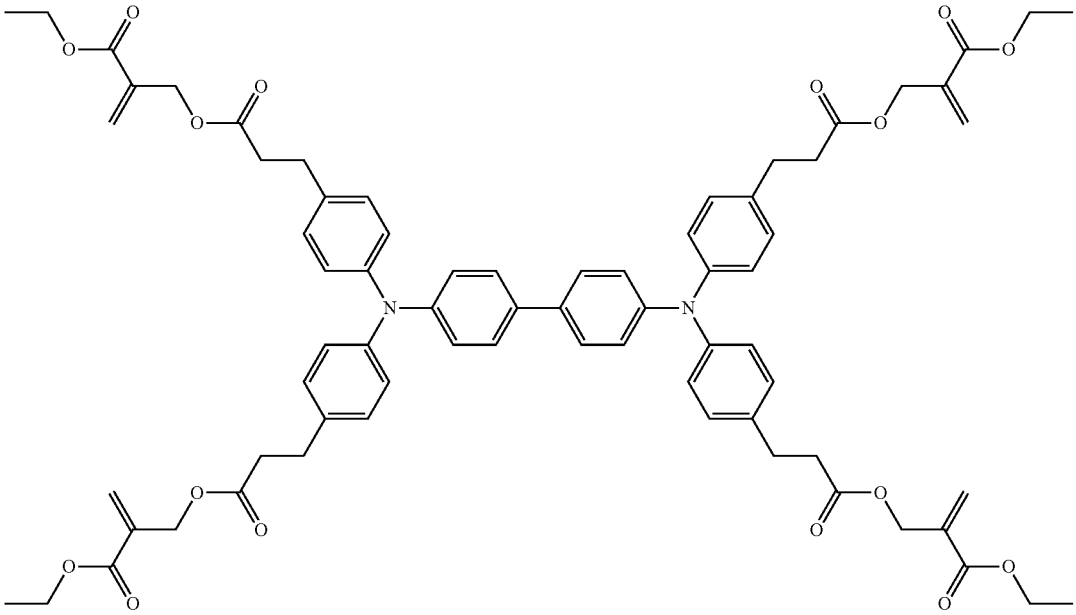
iv-49
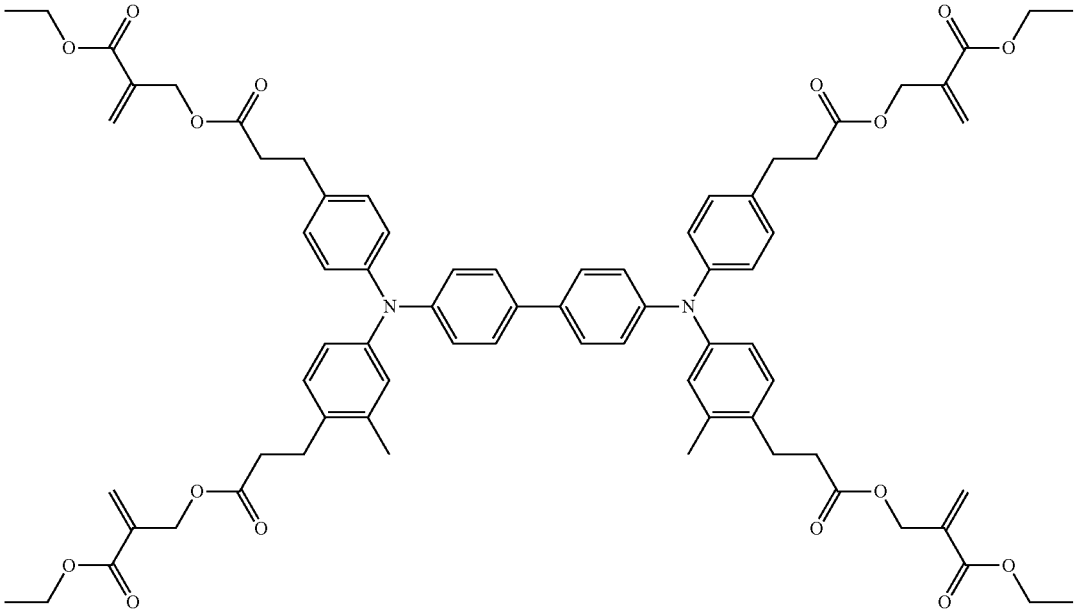

-continued
iv-50
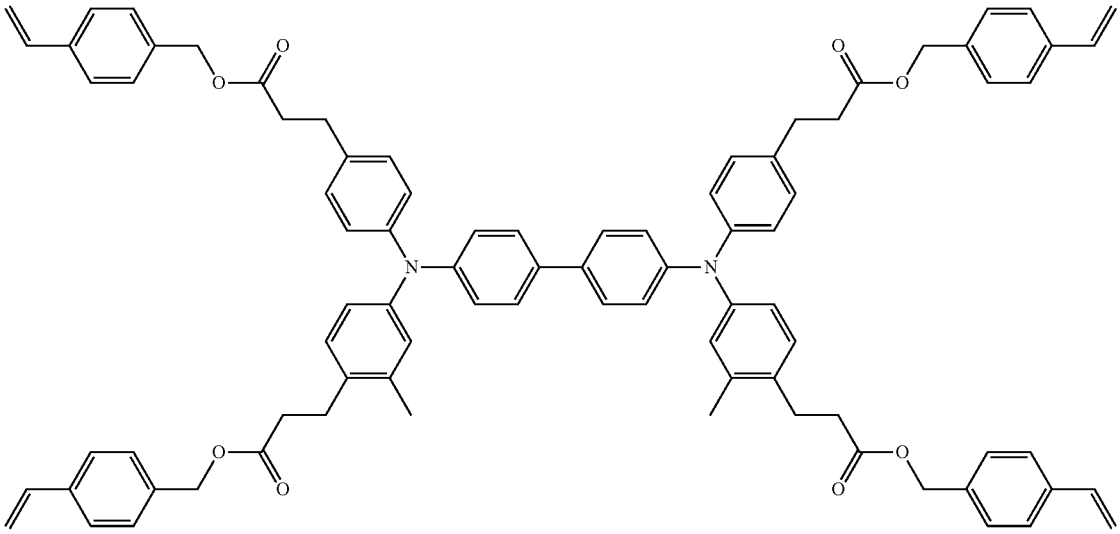
iv-51
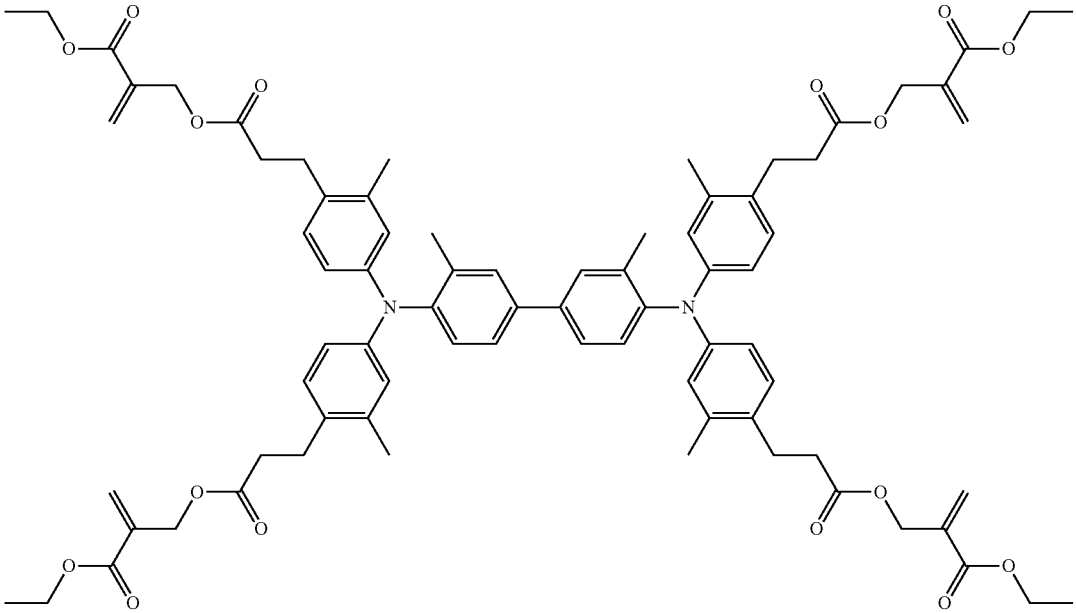

-continued
iv-52
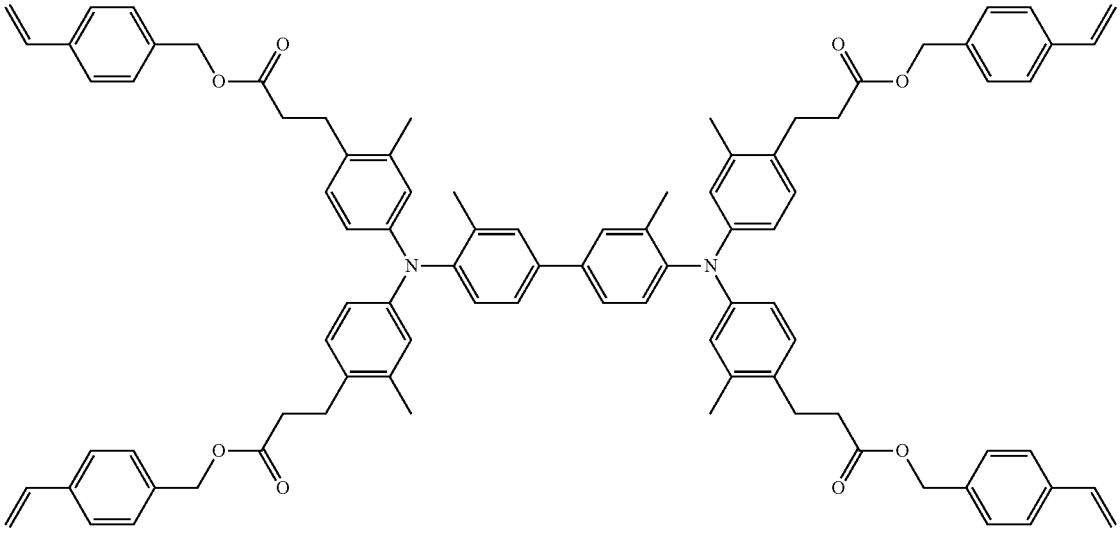
iv-53
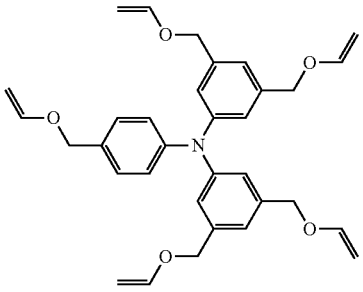
iv-54
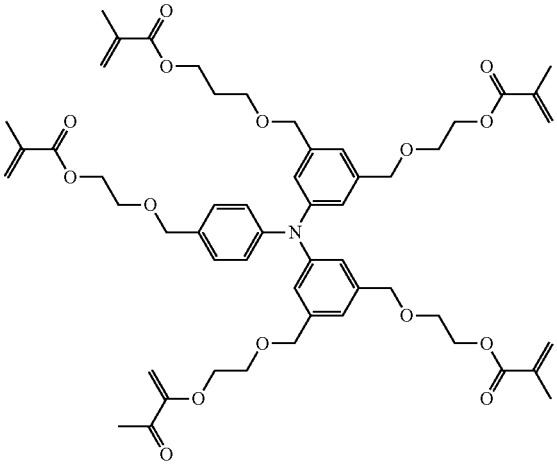

-continued
iv-55
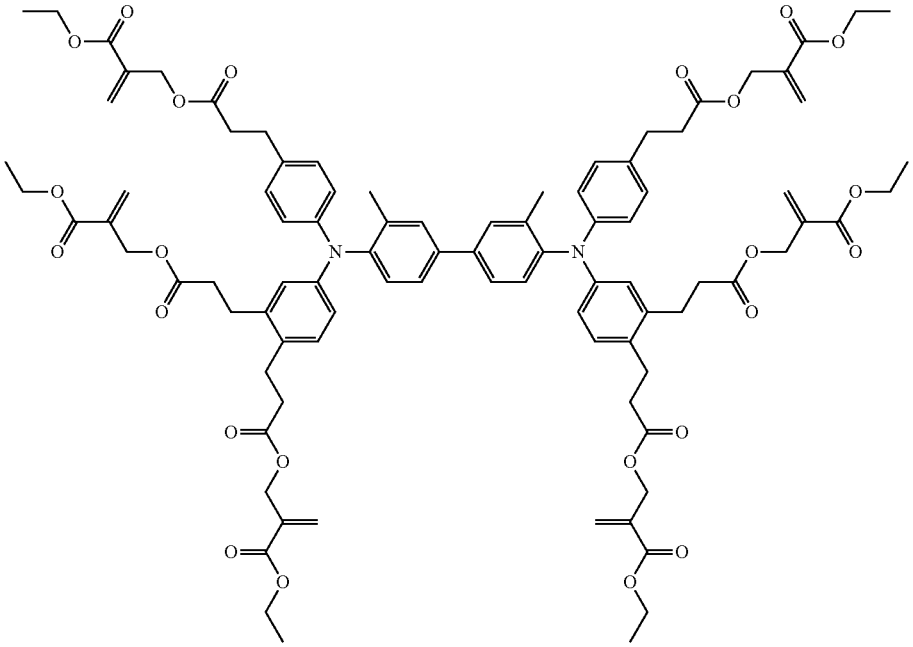
iv-56
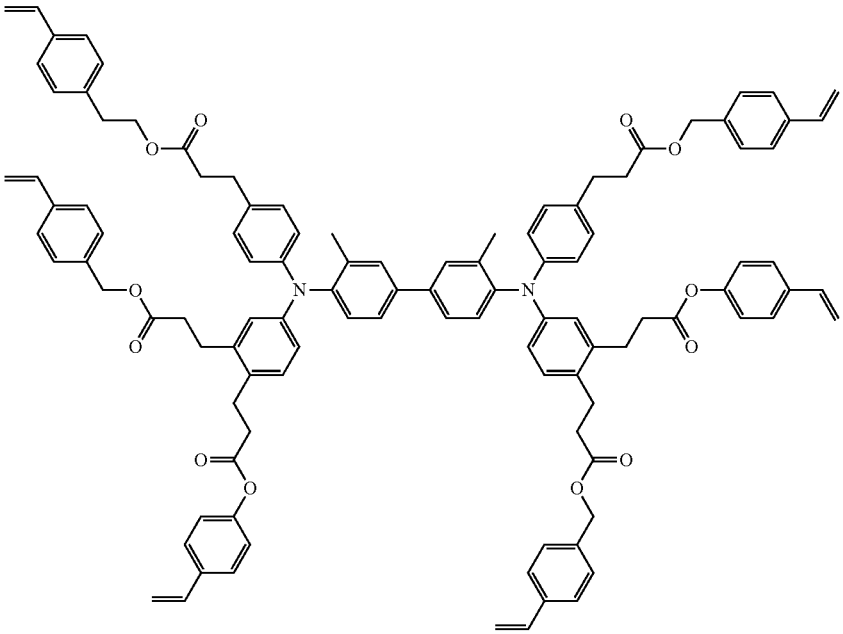

-continued iv-57

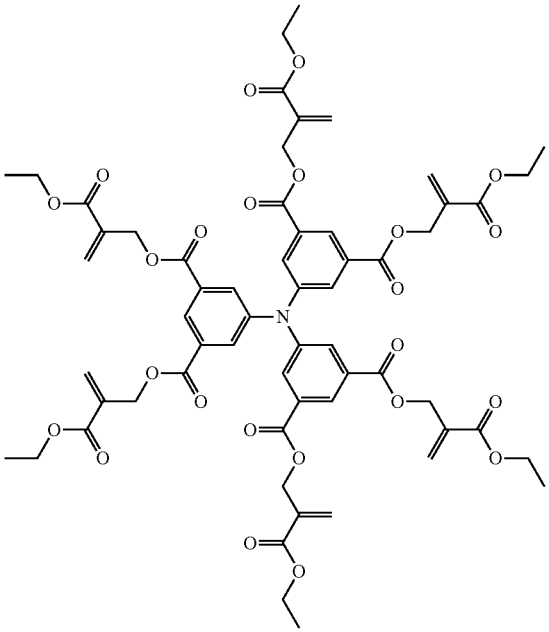

iv-58

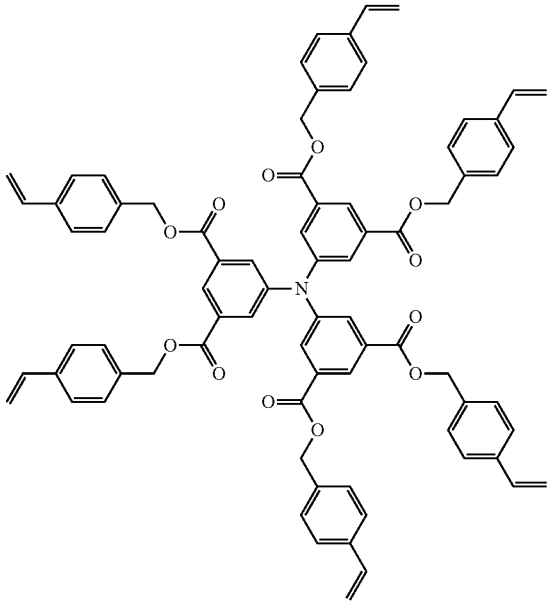

The reactive monomers having charge transport property described above may also be used as the reactive monomer (b) described below.

Compounds described in Japanese Laid-opened Patent Application Publication Nos. 2000-206715, 2004-12986, 7-72640, 2004-302450, 2000-206717, 5-256428, 5-331238, and 9-12630, or the compounds described above may be used as the compound having a charge transport skeleton and an acryl or methacryl group.

The amount of the compound having the charge transport skeleton and the acryl or methacryl group is preferably 30% to 100%, more preferably 40% to 100%, and most preferably 50% to 100% relative to the total solid content (mass ratio) in the coating solution. Two or more acryl or methacryl groups may be contained in a molecule to achieve high strength. A compound having a triphenylamine skeleton and four or more methacryl groups in one molecule is more preferably used. The amount of the compound having a triphenylamine skeleton and four or more methacryl groups in one molecule is preferably 5% or more, more preferably 10% or more, and most preferably 15% or more relative to the total solid content (mass ratio) in the coating solution from the viewpoint of strength.

(Reactive Monomer Having No Charge Transport Property)

In this exemplary embodiment, a (meth)acrylate monomer or oligomer or the like having no charge transport skeleton is used as the reactive monomer having no charge transport property, which is another constitutional unit of the copolymer (a). In the exemplary embodiment, "(meth)acrylate" means acrylate or methacrylate. For example, "isobutyl (meth)acrylate" means both isobutyl acrylate and isobutyl methacrylate.

The reactive group of the reactive monomer having no charge transport property may be at least one, selected from the group consisting of an acryl group, a methacryl group, a styryl group, and derivatives thereof from the viewpoint of copolymerizability with the reactive monomer having charge transport property.

Specific examples of the reactive monomer having no charge transport property and constituting the copolymer (a) of this exemplary embodiment include compounds represented by general formula (2-1) below:

General formula (2-1)

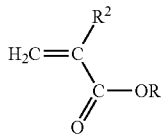

[In general formula (2-1), R represents an organic group having no charge transport property, and $R^2$ represents hydrogen or an alkyl group having 1 to 4 carbon atoms.]

No limits are imposed as to the number of reactive groups of the reactive monomer having no charge transport property used in this exemplary embodiment. However, the number of reactive groups may be 1. When a reactive monomer having two or more reactive groups is used, the ratio of the reactive monomer having two or more reactive groups in the copolymer (a) may be low.

Examples of the reactive monomer having one reactive group include isobutyl (meth)acrylate, t-butyl (meth)acrylate, isooctyl (meth)acrylate, lauryl (meth)acrylate, isodecyl (meth)acrylate, tridecyl (meth)acrylate, stearyl (meth)acrylate, isobornyl (meth)acrylate, caprolactone (meth)acrylate, cyclohexyl (meth)acrylate, methoxy triethylene glycol (meth)acrylate, 2-ethoxyethyl (meth)acrylate, 2-(2-ethoxyethoxy)ethyl (meth)acrylate, tetrahydrofurfuryl(meth)acrylate, benzyl (meth)acrylate, ethyl carbitol (meth)acrylate, phenoxyethyl (meth)acrylate, 2-hydroxypropyl (meth)acrylate, 4-hydroxybutyl (meth)acrylate, methoxy polyethylene glycol (meth)acrylate, methoxy polyethylene glycol (meth) acrylate, phenoxy polyethylene glycol (meth)acrylate, hydroxyethyl-O-phenylphenol (meth)acrylate, O-phenylphenol glycidyl ether (meth)acrylate, alkoxylated alkyl (meth)acrylate, and 3,3,5-trimethylcyclohexane triacrylate.

Examples of the difunctional monomer include 1,3-butylene glycol di(meth)acrylate, 1,4-butadiene glycol di(meth) acrylate, 1,6-hexanediol di(meth)acrylate, neopentyl glycol di(meth)acrylate, tetraethylene glycol di(meth)acrylate, triethylene glycol di(meth)acrylate, tripropylene glycol di(meth)acrylate, diethylene glycol di(meth)acrylate, ethoxylated bisphenol A di(meth)acrylate, cyclohexane dimethanol di(meth)acrylate, tricyclodecane di(meth)acrylate, alkoxylated neopentyl glycol di(meth)acrylate, polyethylene glycol di(meth)acrylate, and polypropylene glycol di(meth)acrylate.

Examples of the trifunctional monomer include trimethylolpropane tri(meth)acrylate, pentaerythritol tri(meth)acrylate, aliphatic tri(meth)acrylate, and alkoxylated trimethylolpropane tri(meth)acrylate. Examples of the tetrafunctional monomers include pentaerythritol tetra(meth)acrylate, ditrimethylolpropane tetra(meth)acrylate, and aliphatic tetra (meth)acrylate. Examples of the penta- or higher functional monomer include dipentaerythritol penta(meth)acrylate and dipentaerythritol hexa(meth)acrylate.

These reactive monomers having no charge transport property may be used alone or in combination.

Among the reactive monomers having no charge transport property described above, a reactive monomer having an ethylene oxide (EO) group or a reactive monomer having a bisphenol skeleton is preferred from the viewpoint of compatibility with the copolymer. Diethylene glycol di(meth) acrylate and ethoxylated bisphenol A di(meth)acrylate are more preferable.

From the viewpoints of mechanical strength and electrical characteristics, the amount of the reactive monomer having no charge transport property serving as a constitutional unit derived from the reactive monomer in the copolymer (a) is less than 100%, preferably 50% or less, and more preferably 30% or less in terms of mass ratio.

The copolymer (a) of the exemplary embodiment may contain a constitutional unit represented by general formula (1) below derived from the reactive monomer having charge transport property and a constitutional unit represented by general formula (2) below derived from the reactive monomer having no charge transport property.

(1)

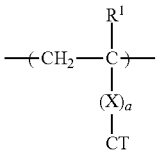

(2)

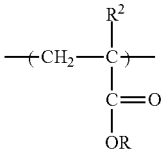

In general formulae (1) and (2), R represents an organic group having no charge transport property, $R^1$ and $R^2$ each independently represent hydrogen or an alkyl group having 1 to 4 carbon atoms, X represents a divalent organic group having 1 to 10 carbon atoms, a represents 0 or 1, and CT represents an organic group having a charge transport skeleton. X may include at least one substituent selected from the group consisting of a carbonyl group, an ester group, an alkyl group having 1 to 4 carbon atoms, and an aromatic ring.

In this exemplary embodiment, the copolymer (a) is obtained by polymerizing a charge transport material having a reactive group and a reactive monomer having no charge transport property in, for example, a solution in the presence of a polymerization initiator. The polymerization initiator may be a thermal polymerization initiator or a photo polymerization initiator.

Examples of the thermal polymerization initiator include azo-based initiators such as V-30, V-40, V-59, V-601, V-65, V-70, VE-073, VF-096, Vam-110, and Vam-111 (products of Wako Pure Chemical Industries), OTazo-15, OTazo-30, AIBN, AMBN, ADVN, and ACVA (products of Otsuka Pharmaceutical Co., Ltd.), PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TOP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (products of NOF COPORATION), Kayaketal AM-055, Trigonox 36-C75, Laurox, Perkadox L-W75, Perkadox CH-50L, Trigonox TMBH, Kayacumene H, Kayabutyl H-70, Perkadox BC-FF, Kayahexa AD, Perkadox 14, Kayabutyl C, Kayabutyl D, Kayahexa YD-E85, Perkadox 12-XL25, Perkadox 12-EB20, Trigonox 22-N70, Trigonox 22-70E, Trigonox D-T50, Trigonox 423-C70, Kayaester CND-C70, Kayaester CND-W50, Trigonox 23-C70, Trigonox 23-W50N, Trigonox 257-C70, Kayaester P-70, Kayaester TMPO-70, Trigonox 121, Kayaester O, Kayaester HTP-65W, Kayaester AN, Trigonox 42, Trigonox F-C50, Kayabutyl B, Kayacarbon EH-C70, Kayacarbon EH-W60, Kayacarbon I-20, Kayacarbon BIC-75, Trigonox 117, and Kayalen 6-70 (products of Kayaku Akzo Corporation), and Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TAIC, Luperox TAEC, Luperox DC, Luperox 101, Luperox F, Luperox DI, Luperox 130, Luperox 220, Luperox 230, Luperox 233, and Luperox 531 (products of ARKEMA YOSHITOMI, LTD).

Examples of the photo polymerization initiator include intramolecular cleavage-type initiators and hydrogen abstraction-type initiators. Examples of the intramolecular cleavage-type initiators include those based on benzyl ketal, alkylphenone, aminoalkylphenone, phosphine oxide, titanocene, and oxime. Specific examples of the benzylketal-based initiators include 2,2-dimethoxy-1,2-diphenylethan-1-one. Examples of the alkylphenone-based initiators include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]phenyl}-2-methyl-propan-1-one, acetophenone, and 2-phenyl-2-(p-toluenesulfonyloxy)acetophenone. Examples of the aminoalkylphenone-based initiators include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone. Examples of the phosphine oxide-based initiator include 2,4,6-trimethylbenzoyl-diphenyl-phosphine oxide and bis(2,4,6-trimethylbenzoyl)-phenylphosphine oxide. Examples of the titanocene-based initiators include bis(η5-2,4-cyclopentadien-1-yl)-bis(2,6-difluoro-3-(1H-pyrrol-1-yl)-phenyl)titanium. Examples of the oxime-based initiators include 1,2-octanedione, 1-[4-(phenylthio)-, 2-(0-benzoyloxime)], and ethanone, 1-[9-ethyl-6-(2-methylbenzoyl)-9H-carbazol-3-yl]-, 1-(0-acetyloxime).

Examples of the hydrogen abstraction-type initiators include those based on benzophenone, thioxanthone, benzyl, and Michler's ketone. Specific examples of the benzophenone-based initiators include 2-benzoyl benzoic acid, 2-chlorobenzophenone, 4,4'-dichlorobenzophenone, 4-benzoyl-4'-methyldiphenyl sulfide, and p,p'-bisdiethylaminobenzophenone. Examples of the thioxanthone-based initiators include 2,4-diethylthioxanthen-9-one, 2-chlorothioxanthone, and 2-isopropylthioxanthone. Examples of the benzyl-based initiators include benzyl, (±)-camphorquinone, and p-anisyl.

These polymerization initiators are added in an amount of 0.2% to 10%, preferably 0.5% to 8%, and more preferably 0.7% to 5% relative to the total amount (mass ratio) of reactive monomers during synthesis of the copolymer.

The polymerization reactions may be carried out in a low oxygen concentration atmosphere, such as an inert gas atmosphere, with an oxygen concentration of 10% or less, preferably 5% or less, and more preferably 1% or less so that the chain reactions are performed without deactivation of the radicals generated.

The molecular weight of the copolymer (a) of the exemplary embodiment is preferably 10000 to 500000, more preferably 10000 to 250000, and most preferably 25000 to 150000 in terms of weight-average molecular weight.

The ratio of the reactive charge transport material in the copolymer (a) may be 20% to 95% in terms of molar ratio from the viewpoint of electrical characteristics.

(Reactive Monomer (b))

Next, the reactive monomer (b) is described. The reactive monomer (b) may be a reactive monomer (a reactive monomer having charge transport property or a reactive monomer having no charge transport property) used in the copolymer (a) described above.

The reactive monomer (b) of the exemplary embodiment may have the same structure as the reactive monomer having charge transport property and constituting the copolymer (a) or a structure different from this. However, the difference between the solubility parameter (SP value) of the reactive monomer having no charge transport property and constituting the copolymer (a) and the solubility parameter (SP value) of the reactive monomer (b) having no charge transport property is adjusted to 2 $(cal/cm^3)^{1/2}$ or less or about 2 $(cal/cm^3)^{1/2}$ or less. The difference is preferably 1.6 $(cal/cm^3)^{1/2}$ or less and more preferably 1 $(cal/cm^3)^{1/2}$ or less from the viewpoints of electrical characteristics and mechanical strength.

In this exemplary embodiment, the charge transport layer forming the outermost surface is obtained by curing the copolymer (a) and the reactive monomer (b). For example, the charge transport layer may be formed by preparing a coating solution by dissolving the copolymer (a) and the reactive monomer (b), applying the coating solution by a blade coating technique, a wire bar coating technique, a spray coating technique, a dip coating technique, a bead coating technique, an air knife coating technique, a curtain coating technique, or an ink jet technique to form a coating film, and curing the coating film.

The outermost surface layer 3A of the exemplary embodiment is formed by curing with light, an electron beam, or heat. In curing, the polymerization initiator is not needed; however, in order to obtain an outermost surface layer having high homogeneity and high hardness, a polymerization initiator may be added. The polymerization initiators described above may be used as the polymerization initiator used in the exemplary embodiment. The polymerization initiator may be a thermal polymerization initiator and the molecular weight of the thermal polymerization initiator may be 250 or more or about 250 or more.

The amount of the polymerization initiator added to the coating solution is 0.2% to 10%, preferably 0.5% to 8%, and more preferably 0.7% to 5% relative to the total amount (mass ratio) of reactive monomers.

The curing reactions may be carried out in a low oxygen concentration atmosphere, such as an inert gas atmosphere, with an oxygen concentration of 10% or less, preferably 5% or less, and more preferably 1% or less so that chain reactions are performed without deactivation of radicals generated.

The thickness of the charge transport layer 3A forming the outermost surface is preferably 1 μm to 20 μm and more preferably 3 μm to 15 μm, for example, in the case of the photoconductor having the layer configuration shown in FIG. 1. The thickness of the charge transport layer 3A is preferably 10 μm to 60 μm and more preferably 20 μm to 60 μm, for example, in the case of the photoconductor having the layer configuration shown in FIG. 2.

The material contained in the charge transport layer 3A forming the outermost surface layer of the photoconductor of the exemplary embodiment may be contained in the charge transport layer 3B.

In this exemplary embodiment, a charge transport material having no reactivity, a reactive material having no charge transport property, a binder resin, etc., may be used as the materials for the charge transport layers 3A and 3B. For example, the mechanical strength and the charge transport property of the charge transport layer may be effectively adjusted by selecting the type and the amount of the charge transport substance having no reactivity and/or the reactive material having no charge transfer property.

First, the charge transport material having no reactive group is described. Examples of the charge transport material having no reactive group include electron transport compounds such as quinone-based compounds, e.g., p-benzoquinone, chloranil, bromanil, and anthraquinone, tetracyanoquinodimethane-based compounds, fluorenone compounds such as 2,4,7-trinitrofluorenone, xanthone-based compounds, benzophenone-based compounds, cyanovinyl-based compounds, and ethylene-based compounds; and hole transport compounds such as triarylamine-based compounds, benzidine-based compounds, arylalkane-based compounds, aryl-substituted ethylene-based compounds, stilbene-based compounds, anthracene-based compounds, and hydrazone-based compounds.

From the viewpoint of charge mobility, triarylamine derivatives represented by structural formula (a-1) below or benzidine derivatives represented by structural formula (a-2) below are preferred.

(a-1)

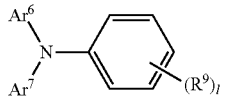

In formula (a-1), $R^9$ represents a hydrogen atom or a methyl group, 1 represents 1 or 2, and $Ar^6$ and $Ar^7$ each represent a substituted or unsubstituted aryl group.

(a-2)

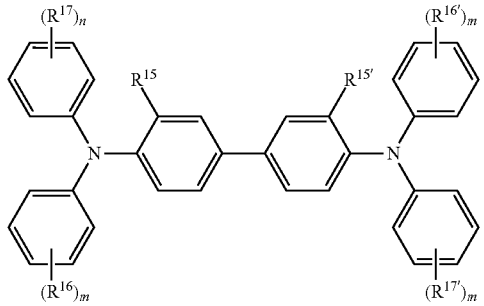

In formula (a-2), $R^{15}$ and $R^{15'}$ may be the same or different and each represent a hydrogen atom, a halogen atom, an alkyl group having 1 to 5 carbon atoms, or an alkoxy group having 1 to 5 carbon atoms; $R^{16}$, $R^{16'}$, $R^{17}$, and $R^{17'}$ may be the same or different and each represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, or a substituted or unsubstituted aryl group; and m and n each represent an integer of 0 to 2.

A polymeric charge transport material having no reactivity, such as poly-N-vinyl carbazole and polysilane, may also be used. Among available non-cross-linking polymeric charge transport materials, polyester-based polymeric charge transport materials disclosed in Japanese Laid-opened Patent Application Publication Nos. 8-176293 and 8-208820 are particularly preferable for their high charge transport property. Although the polymeric charge transport materials may be formed into layers alone, layers may be formed by adding binder resins described below. The charge transport materials are used alone or as a mixture of two or more types but are not limited to those described above.

The materials described above may be used as the reactive material having no charge transport property.

(Binder Resin)

Specific examples of the binder resin used in the charge transport layer constituting the outermost surface layer include polycarbonate resin, polyester resin, polyarylate resin, methacryl resin, acrylic resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinylcarbazole, and polysilane. As discussed above, polyester-based polymeric charge transport materials such as those disclosed in Japanese Laid-opened Patent Application Publication Nos. 8-176293 and 8-208820 may be used as the binder resin. These binder resins are used alone or as a mixture of two or more types. The blend ratio of the charge transport material to the binder resin is preferably 10:1 to 1:5 and more preferably 8:1 to 1:3 on a mass basis.

Of these, polycarbonate resin and polyarylate resin having high charge transport property and compatibility with the charge transport material are preferable. When a layer containing a compound having a triphenylamine skeleton and four or more methacryl groups in a molecule is formed as a surface layer on the charge transport layer, the binder resin used in the charge transport layer preferably has a viscosity-average molecular weight of 50000 or more and more preferably 55000 or more to improve the adhesiveness, crack resistance during formation of the upper layer, etc.

Examples of the techniques used to coat the charge generation layer with a coating solution for forming a charge transfer layer include a blade coating technique, a wire bar coating technique, a spray coating technique, a dip coating technique, a bead coating technique, an air knife coating technique, a curtain coating technique, and an ink jet technique.

The total thickness of the charge transport layer is preferably 10 μm to 60 μm and more preferably 20 μm to 60 μm.

The charge transport layer of the exemplary embodiment may contain a polymer that reacts with or does not react with a compound having a charge transport skeleton and an acryl group or a methacryl group to enhance discharge gas resistance, mechanical strength, scratch resistance, particle dispersing property, viscosity control, torque reduction, and wear control, and extend pot life.

Examples of the polymer that reacts with the compound include those disclosed in Japanese Laid-opened Patent Application Publication Nos. 5-216249, 5-323630, 11-52603, and 2000-264961. Examples of the polymer that does not react with the compound include polycarbonate resin, polyester resin, polyarylate resin, methacryl resin, acrylic resin, polyvinyl chloride resin, polyvinylidene chloride resin, and polystyrene resin. These polymers may be used in an amount of 100% or less, preferably 50% or less, and more preferably 30% or less relative to the total amount of the compound having charge transfer property.

The charge transport layer of the exemplary embodiment may further contain a coupling agent, a fluorine compound, etc., to control the film-forming property, plasticity, lubricity, and adhesiveness. Examples of the compound include various silane coupling agents and commercially available silicone-based hard coating agents.

Examples of the silane coupling agent to be used include vinyltrichlorosilane, vinyltrimethoxysilane, vinyltriethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, tetramethoxysilane, methyltrimethoxysilane, and dimethyldimethoxysilane. Examples of the commercially available hard coating agents to be used include KP-85, X-40-9740, and X-8239 (products of Shin-Etsu Chemical Co., Ltd.), and AY42-440, AY42-441, and AY49-208 (products of Dow Corning Toray Co., Ltd.). A fluorine-containing compound may be added to impart water repellency or the like. Examples of the fluorine-containing compound include (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane. The amount of the silane coupling agent to be used may be any but the amount of the fluorine-containing compound may be of 0.25 times the amount of the compound that does not contain fluorine or less in terms of mass. When the amount used exceeds this, the formation of the crosslinked layer may be adversely affected. A reactive fluorine compound such as one disclosed in Japanese Laid-opened Patent Application Publication 2001-166510 may be added.

The first layer and/or the second layer may contain a resin that dissolves in alcohol to enhance discharge gas resistance, mechanical strength, scratch resistance, particle dispersing property, viscosity control, torque reduction, and wear control, and extend pot life.

In preparing a coating solution by reacting the components described above, the components may be simply mixed and dissolved but may be heated to a temperature of room temperature (20° C.) or more and 100° C. or less and preferably 30° C. or more and 80° C. or less for 10 minutes to 100 hours and preferably 1 hour to 50 hours. During preparation, ultrasonic waves may be applied. As a result, local reactions may proceed, homogeneity of the coating solution increases, and a film having fewer film defects may be easily obtained.

An antioxidant may be added to the charge transport layer to prevent deterioration caused by oxidizing gas such as ozone generated by the charging device. When the mechanical strength of the photoconductor is increased and the lifetime of the photoconductor is extended, the photoconductor comes into contact with the oxidizing gas for a longer period of time. Thus, a higher oxidation resistance is desirable. The antioxidant is preferably a hindered phenol-based or hindered amine-based antioxidant. An organic sulfur-based antioxidant, a phosphite-based antioxidant, a dithiocarbamate-based antioxidant, a thiourea-based antioxidant, a benzimidazole-based antioxidant, or other known antioxidant may be used as the antioxidant. The amount of the antioxidant added is preferably 20 mass % or less and more preferably 10 mass % or less.

Examples of the hindered phenol-based antioxidant include IRGANOX 1076, IRGANOX 1010, IRGANOX 1098, IRGANOX 245, IRGANOX 1330, IRGANOX 3114, and IRGANOX 1076 (products of Ciba Japan KK), and 3,5-di-t-butyl-4-hydroxybiphenyl.

Examples of the hindered amine-based antioxidant include SANOL LS2626, SANOL LS765, SANOL LS770, and SANOL LS744 (products of Sankyo Lifetech Co., Ltd.), TINUVIN 144 and TINUVIN 622LD (products of Ciba Japan KK), and MARK LA57, MARK LA67, MARK LA62, MARK LA68, and MARK LA63 (products of Adeka Corporation). Examples of the thioether-based antioxidant include Sumilizer TPS and Sumilizer TP-D (products of Sumitomo Chemical CO., Ltd.). Examples of the phosphite-based antioxidant include MARK 2112, MARK PEP-8, MARK PEP-24G, MARK PEP-36, MARK 329K, and MARK HP-10 (products of Adeka Corporation).

In order to decrease the residual potential or increase the mechanical strength, conductive particles or organic or inorganic particles may be added to the charge transport layer. An example of the particles is silicon-containing particles. Silicon-containing particles are particles containing silicon as a constitutional element. Specific examples thereof include colloidal silica and silicone particles. Colloidal silica used as silicon-containing particles is selected from those prepared by dispersing silica having an average particle size of 1 μm to 100 nm and more preferably 10 nm to 30 nm in an acidic or alkaline aqueous medium or an organic solvent such as alcohol, ketone, or ester, and may be a commercially available product. The solid content of the colloidal silica in the first layer is not particularly limited but is preferably 0.1 mass % to 50 mass % and more preferably 0.1 mass % to 30 mass % relative to the total solid content from the viewpoints of film-forming property, electrical characteristics, and strength.

The silicone particles used as the silicon-containing particles are selected from silicone resin particles, silicone rubber particles, and silicone surface-treated silica particles. A commercially available product is generally used as the silicone particles. These silicone particles may be spherical with an average particle size of 1 nm to 500 nm and preferably 10 nm to 100 nm. The silicone particles are chemically inert and are small particles that have good dispersibility in a resin. Since the silicone particle content for obtaining sufficient characteristics is low, the silicone particles improve the surface characteristics of the electrophotographic photoconductor without obstructing crosslinking reactions. In other words, the silicone particles evenly trapped in a robust crosslinked structure improve the lubricity and water repellency of the electrophotographic photoconductor surface and offer good wear resistance and antifouling property over a long period of time.

The silicone particle content in the outermost surface layer is preferably 0.1 mass % to 30 mass % and more preferably 0.5 mass % to 10 mass % relative to the total solid content.

Other examples of the particles include fluorine-based particles such as ethylene tetrafluoride, ethylene trifluoride, propylene hexafluoride, vinyl fluoride, and vinylidene fluoride particles, particles composed of a copolymer resin derived from a fluorine-based resin and a hydroxyl-containing monomer such as one described in "8th Polymer Material Forum, Lecture abstract, p. 89", and semiconductor metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO.

Oil such as silicone oil may be added for the same purpose. Examples of the oil include silicone oil such as dimethylpolysiloxane, diphenylpolysiloxane, and phenylmethylsiloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxane such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl-containing cyclosiloxanes such as methylhydrosiloxane mixtures, pentamethylcyclopentasiloxane, and phenylhydrocyclosiloxane; and vinyl-containing cyclosiloxanes such as pentavinylpentamethylcyclopentasiloxane.

A metal, metal oxide, carbon black, or the like may also be added. Examples of the metal include aluminum, zinc, copper, chromium, nickel, silver, and stainless steel and those metals vapor-deposited on surfaces of plastic particles. Examples of the metal oxide include zinc oxide, titanium oxide, tin oxide, antimony oxide, indium oxide, bismuth oxide, tin-doped indium oxide, antimony- or tantalum-doped tin oxide, and antimony-doped zirconium oxide. These may be used alone or in combination. When two or more of these materials are used in combination, the materials may simply be mixed, or fused, or prepared as a solid solution. The average diameter of the conductive particles is 0.3 μm or less and preferably 0.1 μm or less from the viewpoint of transparency.

<Conductive Substrate>

Examples of the conductive substrate 4 include metal plates containing metals such as aluminum, copper, zinc, stainless steel, chromium, nickel, molybdenum, vanadium, indium, gold, and platinum or alloys thereof, metal drums, metal belts, and paper, plastic films, belts, etc., on which a conductive polymer, a conductive compound such as indium oxide, a metal such as aluminum, palladium, or gold, or an alloy is applied, vapor-deposited, or laminated.

When the electrophotographic photoconductor is used in a laser printer, in order to prevent interference fringe from occurring during irradiation with laser beams, the surface of the conductive substrate 4 may be roughened to exhibit a center line average roughness Ra of 0.04 μm to 0.5 μm. When Ra is less than 0.04 μm, the surface is close to a mirror surface and the interference-preventing effect tends to be insufficient. When Ra exceeds 0.5 μm, the image quality tends to be rough even when a coating is formed. Note that when incoherent light is used as a light source, the surface roughening for preventing interference fringe may be omitted. Since this prevents generation of defects caused by irregularities in the surface of the conductive substrate 4, the lifetime may be extended.

The surface roughening may be conducted by a wet honing involving suspending an abrasive in water and spraying the resulting suspension onto a support, by center-less polishing involving pressing a support against a rotating grindstone and continuously conducting polishing, or by anodization.

Another example of a method for roughening the surface involves dispersing conductive or semiconducting powder in a resin and forming a layer on a surface of a support using the dispersion of the particles so that the surface has roughness due to the particles dispersed in the layer without roughening the conductive substrate 4 itself.

The roughening by anodization involves forming an oxide layer on an aluminum surface by oxidizing an aluminum anode in an electrolytic solution. Examples of the electrolytic solution include a sulfuric acid solution and an oxalic acid solution. However, the porous oxide layer formed by anodization is chemically active as is, is susceptible to contamination, and has a resistance that greatly varies depending on the environment. Accordingly, the pores of the anode oxide layer may be sealed by volume expansion caused by hydration reactions using compressed water vapor or boiling water (a metal salt such as nickel may be added) so that the anode oxide layer turns into a more stable hydrated oxide (pore-sealing treatment).

The thickness of the anode oxide layer may be 0.3 μm to 15 μm. When the thickness is less than 0.3 μm, the barrier property against injection tends to be poor and the effect tends to be insufficient. In contrast, when the thickness exceeds 15 μm, the potential tends to increase by repeated use.

The conductive substrate 4 may be treated with an acidic aqueous solution or a Boehmite treatment. The treatment using an acidic treatment solution composed of phosphoric acid, chromic acid, and hydrofluoric acid is conducted as follows. First, an acidic treatment solution is prepared. The blend ratios of phosphoric acid, chromic acid, and hydrofluoric acid are as follows: 10 to 11 mass % phosphoric acid, 3 to 5 mass % chromic acid, and 0.5 to 2 mass % hydrofluoric acid. The total concentration of these acids may be in the range of 13.5 to 18 mass %. The temperature of treatment may be 42° C. to 48° C. A thick film may be formed at a higher rate when the temperature of treatment is maintained high. The thickness of the coating film may be 0.3 μm to 15 μm. When the thickness is less than 0.3 μm, the barrier property against injection tends to be poor and the effect tends to be insufficient. In contrast, when the thickness exceeds 15 μm, the rest potential tends to increase by repeated use.

The Boehmite treatment is conducted by dipping the support in pure water at 90° C. to 100° C. for 5 to 60 minutes or bringing the support in contact with heated steam of 90° C. to 120° C. for 5 to 60 minutes. The thickness of the coating film may be 0.1 μm to 5 μm. The resulting film may be further anodized by using an electrolytic solution having low film dissolving property such as adipic acid, boric acid, borate, phosphate, phthalate, maleate, benzoate, tartrate, or citrate.

<Undercoat Layer>

The undercoat layer 1 may be composed of a binder resin alone or a binder resin and inorganic particles.

Inorganic particles having a powder resistance (volume resistivity) of $10^2$ Ω·cm to $10^{11}$Ω·cm may be used as the inorganic particles so that the undercoat layer 1 obtains an adequate resistance for achieving leak resistance and carrier blocking property. When the resistance value of the inorganic particles is lower than the lower limit of this range, sufficient leak resistance is not obtained. When the resistance value exceeds the upper limit of this range, the rest potential may be increased.

Among inorganic particles having the above-described resistance value, inorganic particles of tin oxide, titanium oxide, zinc oxide, zirconium oxide, etc., are preferred, and zinc oxide is particularly preferable.

The inorganic particles may be subjected to a surface treatment. A mixture of two types of inorganic particles subjected to different surface treatments or having different particle sizes may also be used.

Inorganic particles having a BET specific surface of 10 $m^2/g$ or more may be used as the inorganic particles. Inorganic particles having a BET specific surface less than 10 $m^2/g$ are likely to cause a decrease in charging property and it is difficult to obtain good electrophotographic characteristics.

When the inorganic particles and an acceptor compound are contained, the long-term stability of the electrical characteristics and the carrier blocking property are improved. The acceptor compound may be any compound that achieves desired characteristics but is preferably an electron transport substance such as quinone-based compounds such as chloranil and bromanil, tetracyanoquinodimethane-based compounds, fluorene compounds such as 2,4,7-trinitrofluorenone and 2,4,5,7-tetranitro-9-fluorenone, oxadiazole-based compounds such as 2-(4-biphenyl)-5-(4-t-butyl phenyl)-1,3,4-oxadiazole, 2,5-bis(4-naphthyl)-1,3,4-oxadiazole, and 2,5-bis(4-diethylaminophenyl)-1,3,4-oxadiazole, xanthone-based compounds, thiophene compounds, and diphenoquinone compounds such as 3,3',5,5'-tetra-t-butyldiphenoquinone. In particular, compounds having an anthraquinone structure are preferred. Preferred examples of the acceptor compound having an anthraquinone structure include hydroxyanthraquinone-based compounds, aminoanthraquinone-based compounds, and aminohydroxyanthraquinone-based compounds. Specific examples thereof include anthoraquinone, alizarin, quinizarin, anthrarufin, and purpurin.

The acceptor compound content may be set to any value within the range that achieves the desired characteristics but is preferably 0.01 mass % to 20 mass % relative to the inorganic particles. The acceptor compound content is preferably 0.05 to 10 mass % from the viewpoint of preventing charge accumulation and aggregation of inorganic particles. Aggregation of inorganic particles not only results in formation of uneven conduction paths and deterioration of maintainability such as an increase in rest potential due to repeated use but also tends to cause image quality defects such as black spots.

The acceptor compound may be added at the time of forming the undercoat layer by application or may be allowed to adhere on the surfaces of the inorganic particles in advance. Examples of the techniques for imparting the acceptor compound to the surfaces of the inorganic particles include a dry technique or a wet technique.

When the surface treatment is conducted by a dry technique, the acceptor compound as is or dissolved in an organic solvent is added dropwise and sprayed together with dry air or nitrogen gas toward the inorganic particles being stirred in a mixer or the like at a large shear force so that the treatment is homogeneously conducted. The addition or spraying may be conducted at a temperature less than the boiling point of the solvent. When spraying is conducted at a temperature equal to or higher than the boiling point of the solvent, the solvent evaporates before the particles and the compound are homogeneously mixed, resulting in uneven distribution of the acceptor compound and uneven treatment. Upon completion of addition or spraying, baking may be conducted at a temperature of 100° C. or higher. Baking may be conducted at any temperature for any length of time as long as desired electrophotographic characteristics are obtained.

According to a wet technique, homogeneous treatment is conducted as follows. Inorganic particles are stirred in a solvent and dispersed using ultrasonic waves, a sand mill, an attritor, a ball mill, or the like. The acceptor compound is added to the dispersed inorganic particles, stirred, and dispersed. Then the solvent is removed from the mixture. The solvent is removed by filtration or distillation. After removal of the solvent, baking is conducted at a temperature of 100° C. or higher. Baking may be conducted at any temperature for any length of time as long as desired electrophotographic characteristics are obtained. According to the wet technique, moisture contained in the inorganic particles is removed before addition of the surface treating agent. The moisture in the inorganic particles may be removed by stirring the inorganic particles in a solvent used for surface treatment under heating or by boiling with a solvent.

The inorganic particles may be surface-treated before addition of the acceptor compound. The surface-treating agent may be any known material as long as desired characteristics are obtained. Examples thereof include silane coupling agents, titanate-based coupling agents, aluminum-based coupling agents, and surfactants. In particular, silane coupling agents provide good electrophotographic characteristics. Silane coupling agents having amino groups impart good blocking property to the undercoat layer 1 and are thus preferable.

Any silane coupling agent having an amino group may be used as long as desired electrophotographic characteristics are provided. Specific examples thereof include, but are not limited to, γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane.

Two or more silane coupling agents may be used as a mixture. Examples of the silane coupling agent used together with a silane coupling agent having an amino group include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Any known surface-treating method may be used. For example, a wet method or a dry method may be used. The addition of the acceptor and the surface-treatment with a coupling agent and the like may be conducted simultaneously.

The amount of the silane coupling agent relative to the inorganic particles in the undercoat layer 1 may be set to any amount as long as the desired electrophotographic characteristics are obtained. However, the amount of silane coupling agent may be 0.5 to 10 mass % relative to the inorganic particles from the viewpoint of improving the dispersibility.

The binder resin contained in the undercoat layer 1 may be any binder resin that forms a satisfactory film and achieves desired characteristics. Examples thereof include polymer resins such as acetals, e.g., polyvinyl butyral, polyvinyl alcohol resin, casein, polyamide resin, cellulose resin, gelatin, polyurethane resin, polyester resin, methacryl resin, acrylic resin, polyvinyl chloride resin, polyvinyl acetate resin, vinyl chloride-vinyl acetate-maleic anhydride resin, silicone resin, silicone-alkyd resin, phenol resin, phenol-formaldehyde resin, melamine resin, and urethane resin, and other known materials such as zirconium chelate compounds, titanium chelate compounds, aluminum chelate compounds, titanium alkoxide compounds, organic titanium compounds, and silane coupling agents. Charge transport resins having charge transport groups and conductive resins such as polyaniline are also used. Among these, resins insoluble in a coating solvent of the upper layer are preferable and phenol resins, phenol-formaldehyde resins, melamine resins, urethane resins, epoxy resins, etc., are more preferable. When two or more of these materials are used in combination, the mixing ratio is set according to need.

The ratio of the metal oxide imparted with the acceptor property to the binder resin or the ratio of the inorganic particles to the binder resin in the coating solution for forming the undercoat layer are freely set within the ranges that achieve desired electrophotographic photoconductor characteristics.

Various additives for improving electrical characteristics, environmental stability, and image quality may be used in the undercoat layer 1. Additives may be any known materials such as polycyclic-based and azo-based electron transport pigments, zirconium chelate compounds, titanium chelate compounds, aluminum chelate compounds, titanium alkoxide compounds, organic titanium compounds, and silane coupling agents. While a silane coupling agent is used in surface treatment of the metal oxide, it is also added as an additive to the coating solution. Specific examples of the silane coupling agents used here include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetonate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethyl hexyl)titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxytitanium stearate.

Examples of the aluminum chelate compounds include aluminum isopropylate, monobutoxy aluminum diisopropylate, aluminum butyrate, diethyl acetoacetate aluminum diisopropylate, and aluminum tris(ethyl acetoacetate).

These compounds may be used alone or as a mixture or a polycondensate of two or more.

The solvent for preparing the coating solution for forming the undercoat layer is selected from known organic solvents, e.g., alcohol-based, aromatic-based, halogenated hydrocarbon-based, ketone-based, ketone alcohol-based, ether-based, and ester-based organic solvents. Examples of the organic solvent include methanol, ethanol, n-propanol, iso-propanol, n-butanol, benzylalcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

The solvent used for dispersing these may be one solvent or a mixture of two or more solvents. When a mixture is used, the solvent used may be any solvent that dissolves a binder resin as a mixed solvent.

Examples of the devices used for dispersion include roll mills, ball mills, vibrating ball mills, attritors, sand mills, colloid mills, and paint shakers. Examples of the coating technique used for forming the undercoat layer 1 include common techniques such as a blade coating technique, a wire bar coating technique, a spray coating technique, a dip coating technique, a bead coating technique, an air knife coating technique, and a curtain coating technique.

The undercoat layer 1 is formed on the conductive substrate by using the coating solution for forming the undercoating layer obtained as such.

The Vickers hardness of the undercoat layer 1 may be 35 or more.

The thickness of the undercoat layer 1 may be any as long as desired characteristics are achieved. For example, the thickness may be 15 μm or more and preferably 15 to 50 μm.

When the thickness of the undercoat layer 1 is less than 15 μm, sufficient anti-leakage property is not obtained. When the thickness exceeds 50 μm, the rest potential tends to remain during long use and abnormality in image density is likely to occur.

The surface roughness (ten-point average roughness) of the undercoat layer 1 is adjusted to ¼n (n is a refractive index of the upper layer) of the exposure laser wavelength λ to ½λ to prevent moire patterns. Particles such as resin particles may be added to the undercoat layer to adjust the surface roughness. Examples of the resin particles include silicone resin particles and crosslinked PMMA resin particles.

The undercoat layer may be polished to adjust the surface roughness. Examples of the polishing technique include buff polishing, sand blasting, wet horning, and grinding.

The applied coating solution is dried to obtain an undercoat layer. Typically, drying is conducted at a temperature at which the solvent is evaporated and a film is formed.

<Charge Generation Layer>

The charge generation layer 2 is a layer that contains a charge generation material and a binder resin.

Examples of the charge generation material include azo pigments such as bisazo and trisazo; polycyclic aromatic pigments such as dibromoanthanthrone, perylene pigments, pyrrolopyrrole pigments, phthalocyanine pigments, zinc oxide, and trigonal selenium. Of these, metal or non-metal phthalocyanine pigments are preferred for the exposure to near infrared. In particular, hydroxygallium phthalocyanine disclosed in, for example, Japanese Laid-opened Patent Application Publication Nos. 5-263007 and 5-279591, chlorogallium phthalocyanine disclosed in, for example, Japanese Laid-opened Patent Application Publication No. 5-98181, dichlorotin phthalocyanine disclosed in, for example, Japanese Laid-opened Patent Application Publication Nos. 5-11172 and 5-11173, and titanyl phthalocyanine disclosed in Japanese Laid-opened Patent Application Publication Nos. 4-189873 and 5-43823 are more preferable. For the exposure to near ultraviolet laser beams, polycyclic aromatic pigments such as dibromoanthanthrone, thioindigo-based pigments, porphyrazine compounds, zinc oxide, trigonal selenium, and bisazo pigments described in Japanese Laid-opened Patent Application Publication Nos. 2004-78147 and 2005-181992 are more preferable.

The binder resin used in the charge generation layer 2 is selected from a wide range of insulating resins. The binder resin may be selected from organic photoconductive polymer such as poly-N-vinylcarbazole, polyvinylanthracene, polyvinylpyrene, and polysilane. Examples of the binder resin include polyvinylbutyral resin, polyarylate resin (polycondensate of a bisphenol and an aromatic divalent carboxylic acid, etc.), polycarbonate resin, polyester resin, phenoxy resin, vinyl chloride-vinyl acetate copolymer, polyamide resin, acrylic resin, polyacrylamide resin, polyvinylpyridine resin, cellulose resin, urethane resin, epoxy resin, casein, polyvinyl alcohol resin, and polyvinyl pyrrolidone resin. These binder resins are used alone or as a mixture of two or more types. The blend ratio of the charge generation material to the binder resin may be in the range of 10:1 to 1:10 in terms of mass ratio.

The charge generation layer 2 is formed by using a coating solution prepared by dispersing the charge generation material and a binder resin in a solvent.

Examples of the solvent used for dispersion include methanol, ethanol, n-propanol, n-butanol, benzylalcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These may be used alone or as a mixture of two or more types.

The technique for dispersing the charge generation material and the binder resin in a solvent include common techniques such as a ball mill dispersion technique, an attritor dispersion technique, and a sand mill dispersion technique. The change in crystal type of the charge generation material caused by dispersion is suppressed when such a dispersion technique is used. For the dispersion, it is effective to adjust the average particle size of the charge generation material to 0.5 μm or less, preferably 0.3 μm or less, and more preferably 0.15 μm or less.

A common technique is used to form the charge generation layer 2. Examples of the technique include a blade coating technique, a wire bar coating technique, a spray coating technique, a dip coating technique, a bead coating technique, an air knife coating technique, and a curtain coating technique.

The thickness of the charge generation layer 2 obtained as such is preferably 0.1 μm to 5.0 μm and more preferably 0.2 μm to 2.0 μm.

<Method for Preparing Electrophotographic Photoconductor>

A method for preparing the electrophotographic photoconductor of this exemplary embodiment includes a step of sequentially forming, if needed, an undercoat layer 1, a charge generation layer 2, and a charge transport layer 3B on a conductive substrate 4 and then forming an outermost surface layer by applying a coating solution containing a copolymer (a) derived from a reactive monomer having charge transport property and a reactive monomer having no charge transport property, and a reactive monomer (b) that has a solubility parameter (SP value) different from the solubility parameter (SP value) of the reactive monomer having no charge transport property, i.e., a constitutional unit of the copolymer (a), by 2 $(cal/cm^3)^{1/2}$ or less or about 2 $(cal/cm^3)^{1/2}$ or less; and a step of heating the coating film of the coating solution at an oxygen concentration of 1000 ppm or less or about 1000 ppm or less and a temperature of 130° C. or higher or about 130° C. or higher. From the viewpoint of mechanical strength, the oxygen concentration in the heating step may be 200 ppm or less. From the viewpoints of mechanical strength and electrical characteristics, the heating temperature may be 130° C. to 175° C.

When the heating step is conducted under the aforementioned conditions, a charge transport layer 3A having good mechanical strength and electrical characteristics is formed.

<Process Cartridge and Image Forming Apparatus>

Next, a process cartridge and an image forming apparatus that use the electrophotographic photoconductor of the exemplary embodiment are described.

The process cartridge of the exemplary embodiment includes the electrophotographic photoconductor of the aforementioned exemplary embodiment. The process cartridge is detachably attachable to an image forming apparatus that forms an image on a recording medium by transferring a toner image, which has been obtained by developing an electrostatic latent image on a surface of the photoconductor, onto the recording medium.

The image forming apparatus of the exemplary embodiment includes the electrophotographic photoconductor of the aforementioned exemplary embodiment, a charging device that charges the electrophotographic photoconductor, a latent image forming device that forms an electrostatic latent image on a surface of the charged electrophotographic photoconductor, a developing device that forms a toner image by developing the electrostatic latent image on the surface of the electrophotographic photoconductor with a toner, and a transfer device that transfers the toner image formed on the surface of the electrophotographic photoconductor onto a recording medium. The image forming apparatus of the exemplary embodiment may be a tandem machine that includes two or more photoconductors corresponding to toners of different colors. In such a case, each photoconductor may be the electrophotographic photoconductor of the exemplary embodiment. The transfer of the toner image may be conducted by using an intermediate transfer body (intermediate transfer system).

Figure 3:
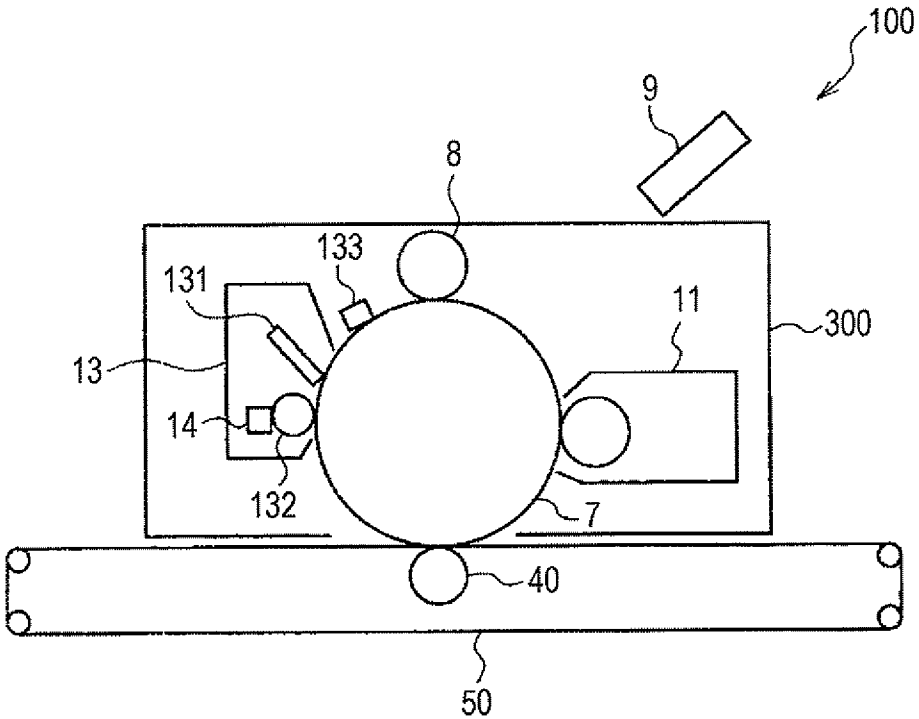
FIG. 3 is a schematic diagram showing an example of a structure of an image forming apparatus (process cartridge) according to an exemplary embodiment.

FIG. 3 is a schematic diagram showing an example of an image forming apparatus (with a process cartridge) of the exemplary embodiment. Referring to FIG. 3, an image forming apparatus 100 includes a process cartridge 300 having an electrophotographic photoconductor 7, an exposure device 9, a transfer device 40, and an intermediate transfer body 50. The exposure device 9 is located at a position that that makes expose the electrophotographic photoconductor 7 possible through an opening in the process cartridge 300. The transfer device 40 is located at a position that faces the electrophotographic photoconductor 7 through the intermediate transfer body 50. The intermediate transfer body 50 is partly in contact with the electrophotographic photoconductor 7.

The process cartridge 300 in FIG. 3 has a housing that supports the electrophotographic photoconductor 7, a charging device 8, a developing device 11, and a cleaning device 13. The cleaning device 13 has a cleaning blade (cleaning member) 131 positioned to contact the surface of the electrophotographic photoconductor 7.

Although the drawing shows an example in which a fibrous member 132 (roll-shaped) that supplies a lubricant 14 onto the surface of the photoconductor 7 and a fibrous member 133 (flat brush) that assists cleaning are provided, these components may be omitted if not needed.

Examples of the charging device 8 include contact-type chargers such as a conductive or semiconductive charge roller, a charge brush, a charge film, a charge rubber blade, and a charge tube. Other known chargers such as non-contact-type roller chargers, scorotron and corotron chargers that utilize corona discharge, etc., may be used.

Although not shown in the drawing, a photoconductor heating member for raising the temperature of the electrophotographic photoconductor 7 and reducing the relative temperature may be provided in the vicinity of the electrophotographic photoconductor 7.

Examples of the exposure device 9 include optical devices that expose the surface of the photoconductor 7 to form an image with light such as semiconductor laser light, LED light, liquid crystal shutter light, etc. The wavelength of the light source used is in the spectral sensitivity range of the photoconductor. The mainstream of the wavelength of the semiconductor lasers is near infrared that has an oscillation wavelength near 780 nm. However, the wavelength is not limited to this. For example, lasers having oscillation wavelengths on the order of 600 nm and lasers having oscillation wavelengths near the range of 400 nm to 450 nm may also be used. Moreover, in order to form color images, surface-emission laser light sources that output multibeam are also effective.

The developing device 11 may be a common developing device that develops images using a magnetic or non-magnetic one-component developer or two-component developer or the like in a contact manner or a non-contact manner. No limitation is imposed on the developing device as long as the aforementioned functions are achieved and a developing device is selected according to the purpose. An example of the developing device is a developer that causes a one-component developer or a two-component developer to adhere on the photoconductor 7 using a brush, a roller, and the like. In particular, a developing device that uses a developing roller having a surface supporting a developer may be used.

The toner used in the developing device 11 is described below.

The toner used in the image forming apparatus of the exemplary embodiment preferably has an average shape factor $((ML^2/A)\times(\pi r/4)\times 100$, where ML representing the maximum length of a particle and A represents the projected area of the particle) of 100 to 150, more preferably 105 to 145, and most preferably 110 to 140. The toner preferably has a volume-average particle size of 3 to 12 μm and more preferably 3.5 to 9 μm.

The method of making the toner is not particularly limited. Examples of the method of making the toner includes a kneading and pulverizing method involving kneading a binder resin, a coloring agent, a releasing agent, a charge controlling agent, etc., and pulverizing and classifying the kneaded mixture; a method of changing the shape of particles prepared by a kneading and pulverizing method by applying mechanical impact or thermal energy; an emulsion polymerization/aggregation method involving emulsifying a polymerizable monomer of a binder resin, mixing the dispersion with dispersions of a coloring agent, a releasing agent, a charge controlling agent, etc., and aggregating and thermally coalescing the mixture to obtain toner particles; a suspension polymerization method involving suspending solutions of a polymerizable monomer for obtaining a binder resin, a coloring agent, a releasing agent, a charge controlling agent, etc., in an aqueous solvent to conduct polymerization; and a solution suspension method involving forming particles by suspending solutions of a binder resin, a coloring agent, a releasing agent, a charge controlling agent, etc., in an aqueous solvent.

Another example of the method for forming the toner includes causing aggregated particles to adhere on the toner particles obtained by any of the methods described above, and heating and coalescing the particles so that the particles have a core-shell structure. The toner is preferably made by a suspension polymerization method, an emulsion polymerization/aggregation method, or a solution suspension method that uses an aqueous solvent and more preferably by an emulsion polymerization/aggregation method from the viewpoints of controlling the shape and the particle size distribution.

Toner mother particles may contain a binder resin, a coloring agent, and a releasing agent and may further contain silica and a charge controlling agent.

Examples of the binder resin used in the toner mother particles include homopolymers and copolymers of styrenes such as styrene and chlorostyrene, monoolefins such as ethylene, propylene, butylene, and isoprene, vinyl esters such as vinyl acetate, vinyl propionate, vinyl benzoate, and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, vinyl ketones such as vinyl methyl ketone, vinyl hexyl ketone, and vinyl isopropenyl ketone, and polyester resins obtained by copolymerizing dicarboxylic acids and diols.

Representative examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester resin, polyurethane, epoxy resin, silicone resin, polyamide, modified rosin, and paraffin wax.

Representative examples of the coloring agent include magnetic powder such as magnetite and ferrite, carbon black, aniline blue, Calco Oil blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C.I. Pigment Red 57:1, C.I. Pigment Yellow 97, C. I. Pigment Yellow 17, C. I. Pigment Blue 15:1, and C. I. Pigment Blue 15:3.

Representative examples of the releasing agent include low molecular polyethylene, low molecular polypropylene, Fischer-Tropsch wax, montan wax, carnauba wax, rice wax, and candelilla wax.

A known charge controlling agent is used as the charge controlling agent. For example, an azo-based metal complex compound, a metal complex compound of salicylic acid, or a resin-type charge controlling agent that contains a polar group is used. When the toner is made by a wet method, raw materials that do not readily dissolve in water may be used. The toner may be a magnetic toner that contains a magnetic material or a non-magnetic toner that does not contain a magnetic material.

The toner used in the developing device 11 is made by mixing the toner mother particles described above and the external additives with a Henschel mixer, a V blender, or the like. When the toner mother particles are prepared by a wet method, external additives may be added by a wet method.

Lubricating particles may be added to the toner mother particles used in the developing device 11. Examples of the lubricating particles include solid lubricants such as graphite, molybdenum disulfide, talc, fatty acids, and fatty acid metal salts; low molecular polyolefins such as polypropylene, polyethylene, and polybutene; silicones having a softening points by heating; aliphatic amides such as amide oleate, amide erucate, amide ricinoleate, and amide stearate; vegetable wax such as carnauba wax, rice wax, candelilla wax, Japan wax, and jojoba oil; animal wax such as beeswax; mineral and petroleum wax such as montan wax, ozokerite, ceresine, paraffin wax, microcrystalline wax, and Fischer-Tropsch wax; and modified products of the foregoing. These may be used alone or in combination. The average particle size may be in the range of 0.1 μm to 10 μm. The particles having the chemical structure above may be ground to make the diameter uniform. The amount of the lubricating particles added to the toner is preferably 0.05 mass % to 2.0 mass % and more preferably 0.1 mass % to 1.5 mass %.

Inorganic particles, organic particles, composite particles including organic particles and inorganic particles adhered on the organic particles may be added to the toner mother particles used in the developing device 11.

Examples of the inorganic particles include various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The inorganic particles may be treated with a titanium coupling agent such as tetrabutyl titanate, tetraoctyl titanate, isopropyltriisostearoyl titanate, isopropyltridecylbenzenesulfonyl titanate, and bis(dioctylpyrophosphate)oxyacetate titanate, a silane coupling agent such as γ-(2-aminoethyl) aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. The inorganic particles hydrophobized with a higher fatty acid metal salt such as silicone oil, aluminum stearate, zinc stearate, or calcium sterate may also be used.

Examples of the organic particles include styrene resin particles, styrene acrylic resin particles, polyester resin particles, and urethane resin particles.

Organic particles that have a number-average particle size of 5 nm to 1000 nm, preferably 5 nm to 800 nm, and more preferably 5 nm to 700 nm are used. The sum of the amounts of the aforementioned particles and lubricating particles may be 0.6 mass % or more.

A small-diameter inorganic oxide having a primary particle size of 40 nm or less may be used as the inorganic oxide added to the toner mother particles, and an inorganic oxide having a larger diameter may be further added. The inorganic oxide particles may be known particles. Silica and titanium oxide may be used in combination.

The small-diameter inorganic oxide may be surface-treated. A carbonate such as calcium carbonate and magnesium carbonate or an inorganic mineral such as hydrotalcite may also be added.

The electrophotographic color toner is mixed with a carrier and used. Examples of the carrier include iron powder, glass beads, ferrite powder, and nickel powder coated or uncoated with a resin. The mixing ratio of the carrier is set according to need.

Examples of the transfer device 40 include contact-type transfer chargers that use belts, rollers, films, and rubber blades, and scorotron transfer chargers and corotron transfer chargers that use corona discharge.

Examples of the intermediate transfer body 50 include a belt (intermediate transfer belt) composed of polyimide, polyamideimide, polycarbonate, polyarylate, polyester, rubber, or the like that has been rendered a semiconductive property. The intermediate transfer body 50 may be a drum instead of a belt.

The image forming apparatus 100 may include an optical charge eraser that optically erase the charges of the photoconductor 7 in addition to the respective devices described above.

Figure 4:
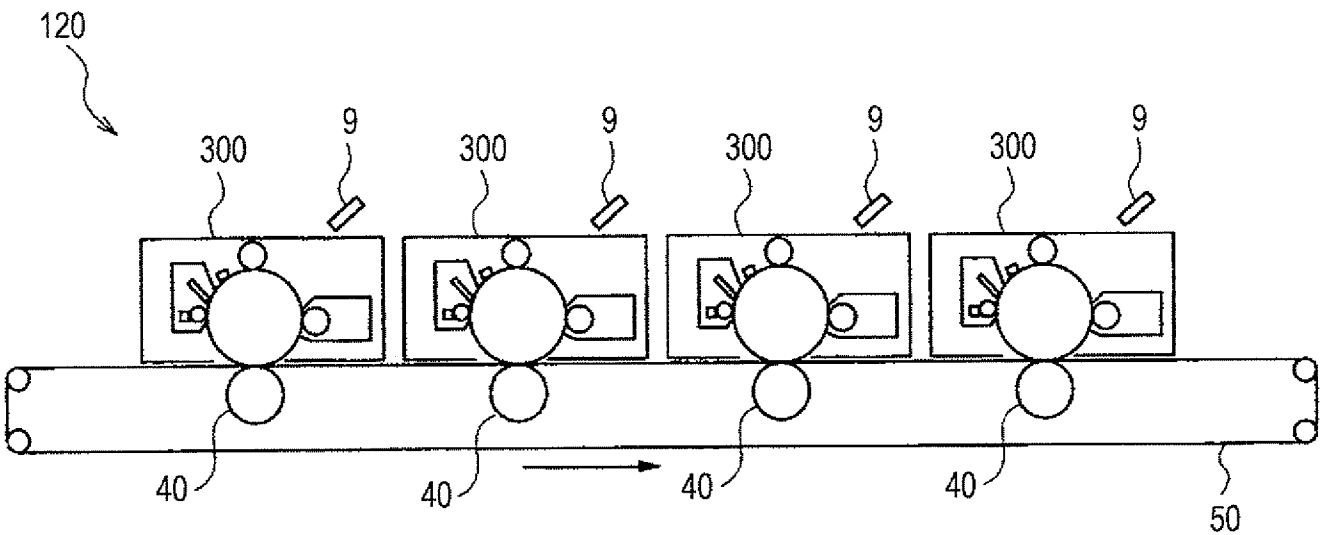
FIG. 4 is a schematic diagram showing an example of a tandem-system image forming apparatus according to an exemplary embodiment.

FIG. 4 is a schematic diagram showing an example of an image forming apparatus according to another exemplary embodiment. An image forming apparatus 120 is a full color image forming apparatus of a tandem type equipped with four process cartridges 300 as shown in FIG. 4. The image forming apparatus 120 includes four process cartridges 300 aligned side by side on the intermediate transfer body 50. One electrophotographic photoconductor is used per color. The image forming apparatus 120 has the same structure as the image forming apparatus 100 except for that it has a tandem system.

When the electrophotographic photoconductor of the exemplary embodiment is used in a tandem image forming apparatus, the electrical characteristics of the four photoconductors become stable. Thus, quality images with good color balance are obtained for a long time.

According to the image forming apparatus and the process cartridge of the exemplary embodiment, the developing device may include a developing roller which serves as a developer support that moves in a direction opposite to the moving direction (rotation direction) of the electrophotographic photoconductor. The developing roller has a cylindrical developing sleeve that supports a developer at its surface. The developing device may be equipped with a limiting member for limiting the amount of the developer supplied to the developing sleeve. When the developing roller is moved (rotated) in a direction opposite to the rotation direction of the electrophotographic photoconductor, the surface of the electrophotographic photoconductor is rubbed with the toner remaining between the developing roller and the electrophotographic photoconductor.

According to the image forming apparatus of the exemplary embodiment, the gap between the developing sleeve and the photoconductor is preferably 200 μm to 600 μm and more preferably 300 μm to 500 μm. The gap between the developing sleeve and the limiting member for limiting the amount of the developer is preferably 300 μm to 1000 μm and more preferably 400 μm to 750 μm.

The absolute value of the moving rate of the surface of the developing roller is preferably 1.5 to 2.5 times and more preferably 1.7 to 2.0 times the absolute value (process speed) of the moving rate of the surface of the photoconductor.

According to the image forming apparatus (process cartridge) of the exemplary embodiment, the developing device may be equipped with a developer supporting member having a magnetic body and configured to develop an electrostatic latent image with a two-component developer containing a magnetic carrier and a toner.

As described heretofore, according to the exemplary embodiment, stable images are obtained despite the repeated use without being affected by the environment since the electrophotographic photoconductor described above is used. The electrophotographic photoconductor of the exemplary embodiment has good mechanical strength and exhibits stable electrical characteristics over a long time.

EXAMPLES

The present invention will now be described by using Examples below which do not limit the scope of the present invention. Hereinafter, "parts" refer to parts by mass unless otherwise noted.

Synthetic Example 1

Synthesis of Compound I-14

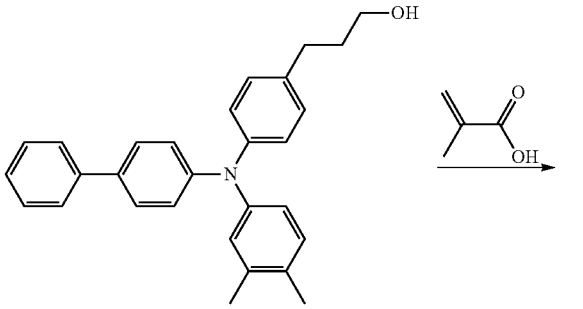

(1)

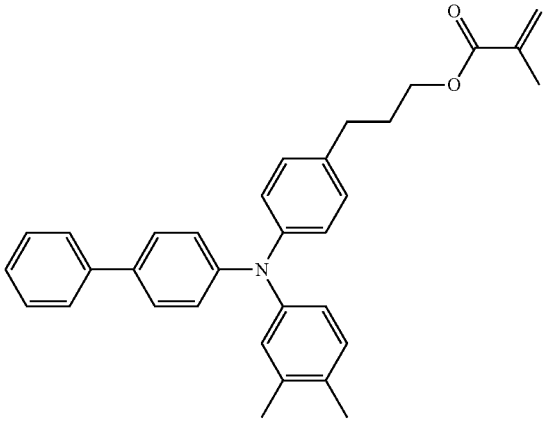

(I-14)

Figure 6:
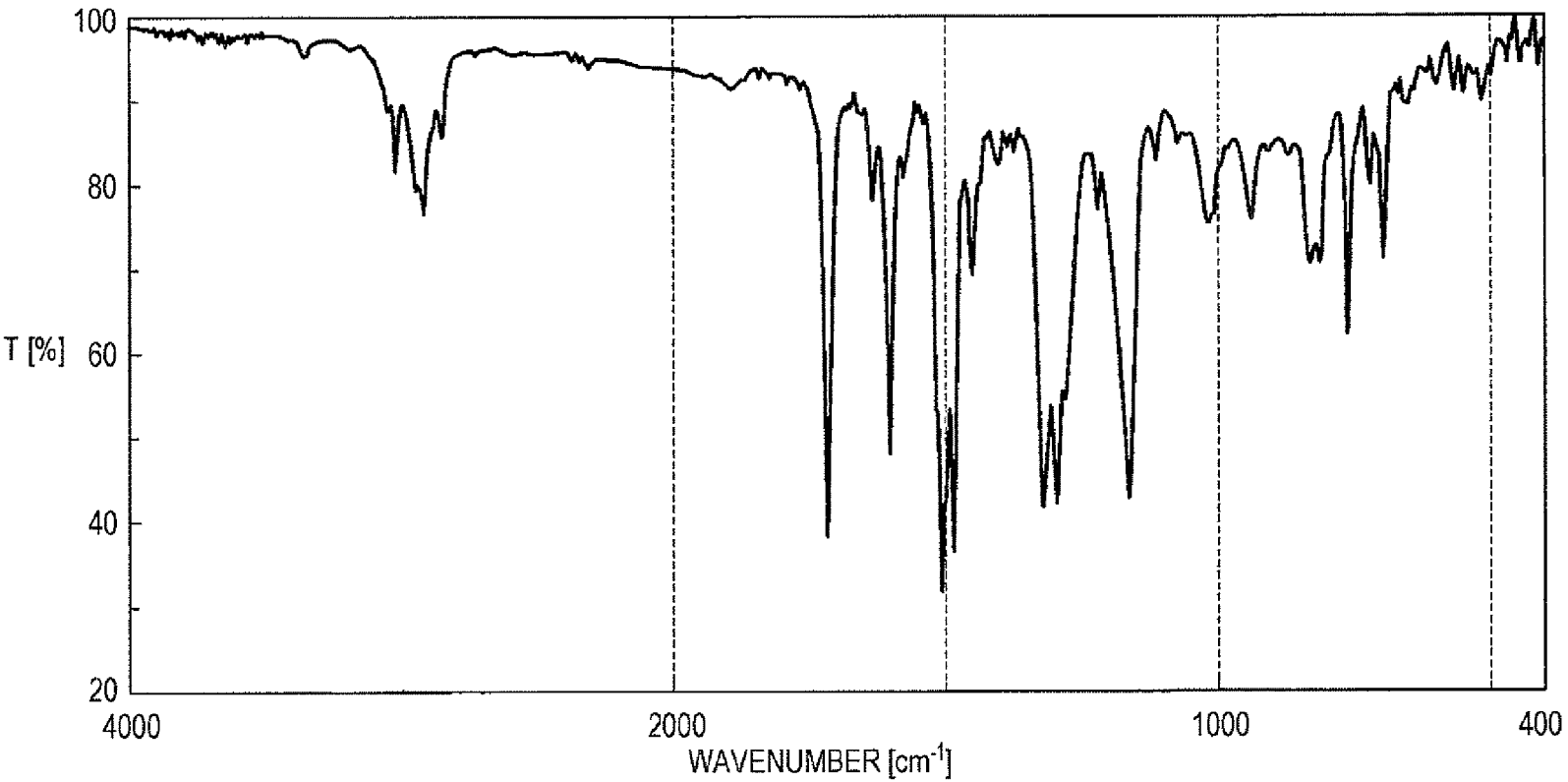
FIG. 6 is an IR spectrum of compound (I-14) synthesized in Example.

Into a 1000 ml flask, 100 g of a compound (1), 107 g of methacrylic acid, 300 ml of toluene, and 2 g of p-toluene sulfonic acid are added and the mixture is refluxed under heating for 10 hours. Upon completion of reaction, the mixture is cooled and put into 2000 ml of water to be washed, and is further washed with water. The toluene layer is dried over anhydrous sodium sulfate and purified by silica gel column chromatography to obtain 35 g of a compound (I-14). The IR spectrum of the compound (I-14) is shown in FIG. 6.

Synthetic Example 2

Synthesis of Copolymer

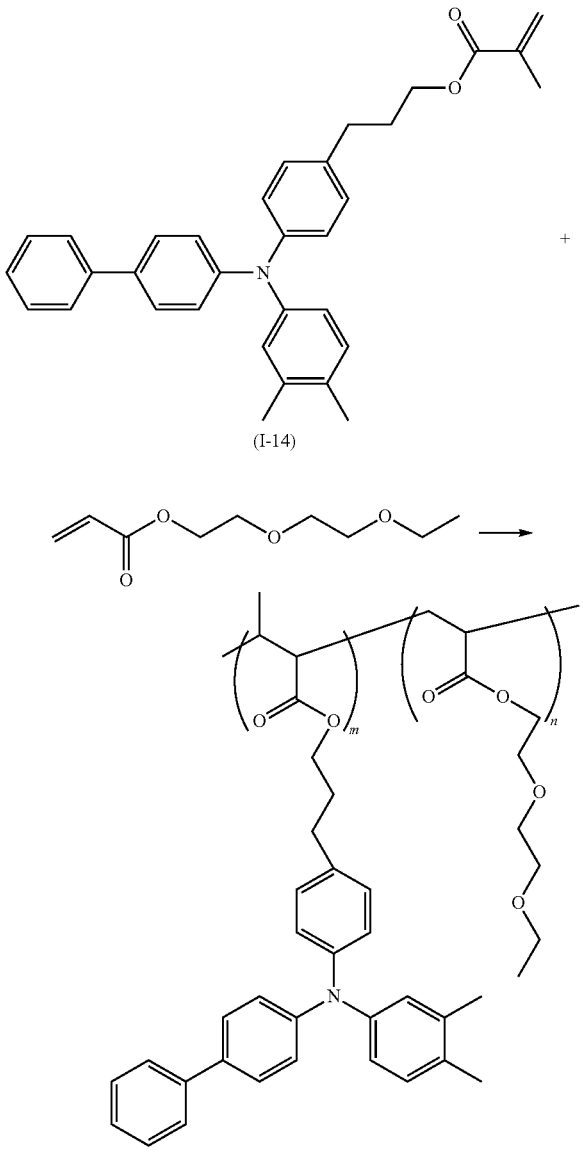

(I-14)

Compound (2)

Into a 500 ml flask, 20 g of compound (I-14), 5 g of 2-(2-ethoxyethoxy)ethyl acrylate, 150 g of toluene, and 0.5 g of polymerization initiator (V601) are added. After the flask is purged with nitrogen, the mixture is refluxed for 3 hours at 90° C. under heating. The mixture is cooled to room temperature, and 25 ml of tetrahydrofuran is added to the mixture. The resulting solution is added to 1000 ml of methanol dropwise to obtain a solid component. Reprecipitation is conducted twice. As a result, 20 g of compound (2) is obtained.

Example 1

Formation of Undercoat Layer

One hundred parts of zinc oxide (average particle size: 70 nm, product of Tayca Corporation, specific surface: 15 $m^2/g$) and 500 parts of toluene are mixed and stirred. To the resulting solution, 1.3 parts of a silane coupling agent KBM503, product of Shin-Etsu Chemical. Co., Ltd.) is added, and the mixture is stirred for 2 hours. Then toluene is removed by evaporation under a reduced pressure and baking is conducted at 120° C. for 3 hours to obtain zinc oxide surface-treated with the silane coupling agent.

The zinc oxide surface-treated with the silane coupling agent (110 parts) and 500 parts of tetrahydrofuran are mixed and stirred. To the resulting mixture, a solution of 0.6 parts of alizarin in 50 parts of tetrahydrofuran is added, and the mixture is stirred at 50° C. for 5 hours. The zinc oxide clad with alizarin is separated by filtering under a reduced pressure and dried under a reduced pressure at 60° C. to obtain alizarin-clad zinc oxide.

Thirty eight parts of a solution prepared by dispersing 60 parts of alizarin-clad zinc oxide, 13.5 parts of curing agent (block isocyanate, Sumidur 3175, product of Sumika Bayer Urethane Co., Ltd.), and 15 parts of butyral resin (S-LEC BM-1, product of Sekisui Chemical Co., Ltd.) in 85 parts of methyl ethyl ketone is mixed with 25 parts of methyl ethyl ketone. The mixture is dispersed in a sand mill using glass beads having a diameter of 1 mm for 2 hours.

To the dispersion, 0.005 parts of dioctyltin dilaurate and 40 parts of silicone resin particles (Tospearl 145, product of GE Toshiba Silicones Co., Ltd.) are added to obtain a coating solution for forming the undercoat layer. The coating solution for forming an undercoat layer is applied on an aluminum substrate having a diameter of 30 mm, a length of 340 mm, and a thickness of 1 mm by dip-coating, and the applied solution is dried and cured at 170° C. for 40 minutes to obtain an undercoat layer having a thickness of 18 μm.

(Formation of Charge Generation Layer 2)

A mixture of 15 parts of hydroxygallium phthalocyanine (charge generation material) and at least having diffraction peaks at Bragg angles (2θ±0.2°) of 7.3°, 16.0°, 24.9°, 28.0° in an X-ray diffraction spectrum observed using a Cukα X ray, 10 parts of vinyl chloride-vinyl acetate copolymer resin (binder resin) (VMCH, product of Nipon Unicar Co., Ltd.), and 200 parts of n-butyl acetate is dispersed in a sand mill for 4 hours using glass beads having a diameter of 1 mm. To the dispersion, 175 parts of n-butyl acetate and 180 parts of methyl ethyl ketone are added. The resulting mixture is stirred to obtain a coating solution for forming a charge generation layer. The coating solution for forming the charge generation layer is applied on the undercoat layer by dip coating and dried at normal temperature (23° C.) to form a charge generation layer having a thickness of 0.2 μm.

(Formation of Charge Transport Layer 3B)

A coating solution is prepared by dissolving 3.5 parts by mass of N,N'-diphenyl-N,N'-bis(3-methylphenyl)-[1,1']biphenyl-4,4'-diamine, 1.5 parts by mass of N,N'-bis(3,4-dimethylphenyl)-biphenyl-4-amine, and 5.0 parts by mass of bisphenol Z polycarbonate resin (viscosity-average molecular weight: about 40,000) in 40 parts by mass of chlorobenzene. The coating solution is applied on the charge generation layer by dip coating and dried at 130° C. for 45 minutes. The thickness of the charge transport layer 3B is about 20 μm.

(Formation of Charge Transport Layer 3A)

A coating solution is prepared by mixing 16 parts by mass of compound (2) prepared in the previous synthetic example, 4 parts by mass of 2-(2-ethoxyethoxy)ethyl acrylate, 0.08 parts by weight of polymerization initiator (OT-azo15 (product of Otsuka Chemical Co., Ltd.)), 30 parts by mass of cyclopentanone, 40 parts by mass of cyclopentylmethyl ether, 30 parts by mass of toluene, 1 part by mass of 3,5-di-t-butyl-4-hydroxytoluene (BHT), and 0.5 parts by mass of fluorine-containing acryl polymer (KL-600, product of KYOEISHA CHEMICAL Co., Ltd.). The coating solution is applied on the charge transport layer 3B by dip coating and air-dried at room temperature for 5 minutes.

Next, the resulting photoconductor is heated in a nitrogen atmosphere at 160° C. for 60 minutes to conduct polymerization and to thereby obtain a desired photoconductor. The thickness of the charge transport layer 3A is 5 μm.

Examples 2 to 4, 7, 8, 11, and 16 and Comparative Examples 1 and 2

Photoconductors are prepared as in Example 1 except that the constitutional materials of the photoconductors and the contents thereof are changed as shown in Tables 1 to 4.

Example 5

An undercoat layer 1 and a charge generation layer 2 are made as in Example 1.

(Formation of Charge Transport Layer (Outermost Surface Layer) 3A)

A coating solution is prepared by mixing 32 parts by mass of compound (2) synthesized in the previous synthetic example, 8 parts by mass of the reactive monomer (b) shown in Table 5, 0.08 parts by weight of polymerization initiator (OT-azo15 (product of Otsuka Chemical Co., Ltd.)), 30 parts by mass of tetrahydrofuran, 30 parts by mass of toluene, 1 part by mass of 3,5-di-t-butyl-4-hydroxytoluene (BHT), and 0.5 parts by mass of fluorine-containing acryl polymer (KL-600, product of KYOEISHA CHEMICAL Co., Ltd.). The coating solution is applied on the charge generation layer 2 by dip coating and air-dried at room temperature for 5 minutes.

Next, the resulting photoconductor is heated at 160° C. for 60 minutes to conduct polymerization and to thereby obtain a desired photoconductor. The thickness of the charge transport layer of the resulting photoconductor is 40

Examples 6, 9, and 10 and Comparative Examples 3 and 4

Photoconductors are prepared as in Example 5 except that the constitutional materials of the photoconductors and the contents thereof are changed as shown in Tables 2, 3, 4, and 6.

The monomers used in forming the outermost surface layer and the solubility parameters (SP values) of Examples and Comparative Examples are indicated in Tables 1 to 6 below.

TABLE 1
| Example No. | Polymeric electron transfer material (a): Reactive monomer having charge transport property: Structure | Mass % | Reactive monomer having no charge transport property: Structure | Mass % | SP value | Reactive monomer (b): Structure | SP value | Difference in SP value |
|---|---|---|---|---|---|---|---|---|
| 1 | 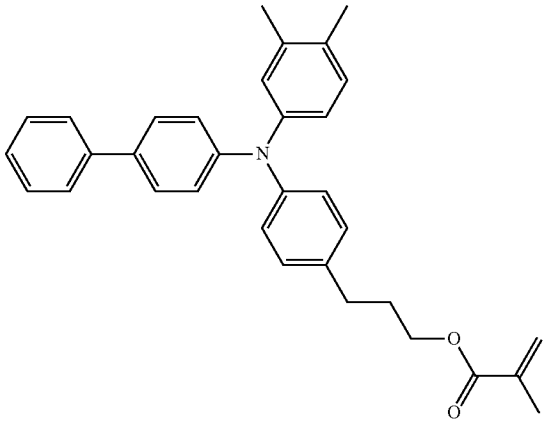 | 80 | 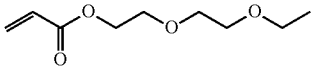 | 20 | 9.08 | 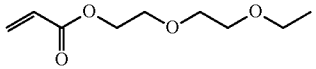 | 9.08 | 0 |
| 2 | 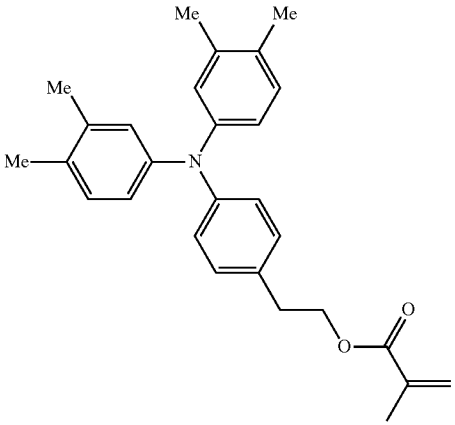 | 75 | 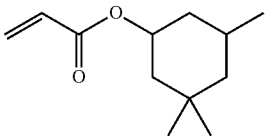 | 25 | 8.73 | 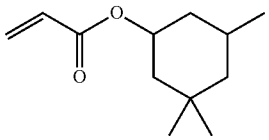 | 8.73 | 0 |

TABLE 1-continued
| Example No. | Polymeric electron transfer material (a): Reactive monomer having charge transport property: Structure | Mass % | Reactive monomer having no charge transport property: Structure | Mass % | SP value | Reactive monomer (b): Structure | SP value | Difference in SP value |
|---|---|---|---|---|---|---|---|---|
| 3 | 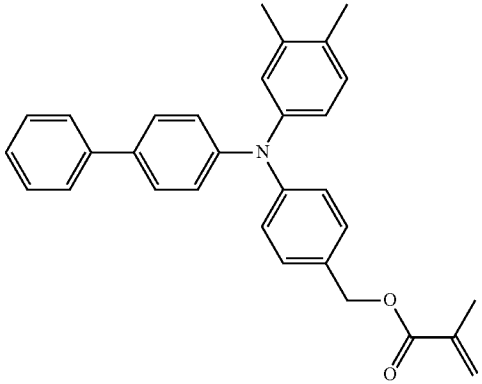 | 50 | 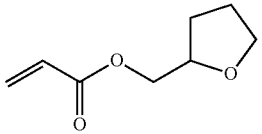 | 50 | 9.99 | 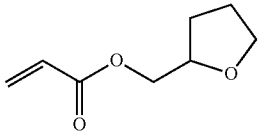 | 9.99 | 0 |

TABLE 2
| Example No. | Polymeric electron transfer material (a): Reactive monomer having charge transport property: Structure | Mass % | Reactive monomer having no charge transport property: Structure | Mass % | SP value |
|---|---|---|---|---|---|
| 4 | 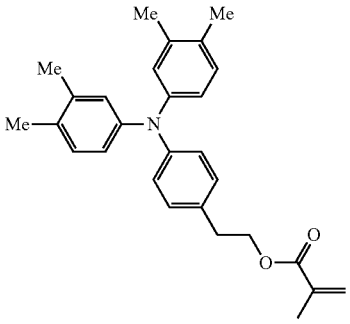 | 90 | 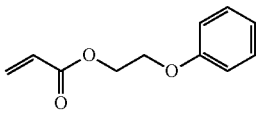 | 10 | 10.12 |
| 5 | 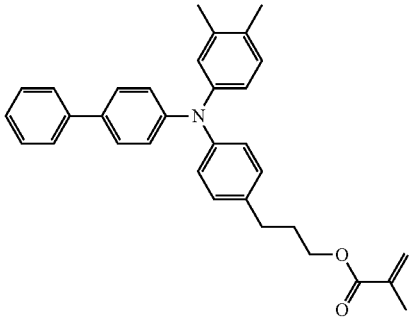 | 80 | 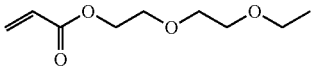 | 20 | 9.08 |
| 6 | 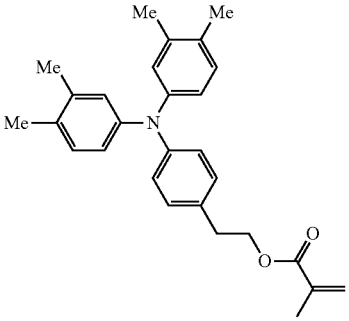 | 80 | 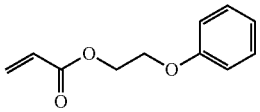 | 20 | 10.12 |
| Example No. | Reactive monomer (b): Structure | SP value | Difference in SP value |
|---|---|---|---|
| 4 | 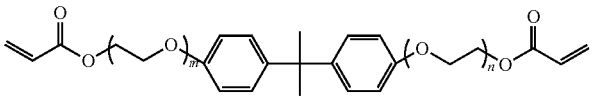 m + n = 3 | 10.26 | 0.14 |
| 5 | 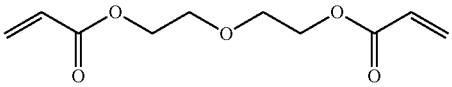 | 9.84 | 0.76 |

TABLE 2-continued
| | | | |
|---|---|---|---|
| 6 | 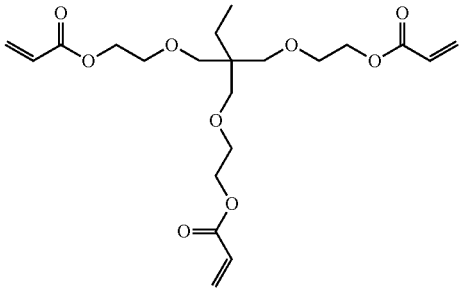 | 9.9 | 0.22 |
15
TABLE 3
| Example No. | Polymeric electron transfer material (a) | | | | |
|---|---|---|---|---|---|
| | Reactive monomer having charge transport property | | Reactive monomer having no charge transport property | | |
| | Structure | Mass % | Structure | Mass % | SP value |
| 7 | 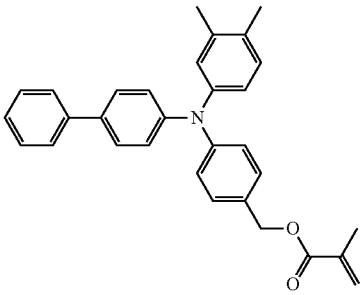 | 95 | 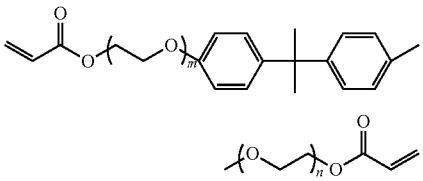 m + n = 3 | 5 | 10.26 |
| 8 | 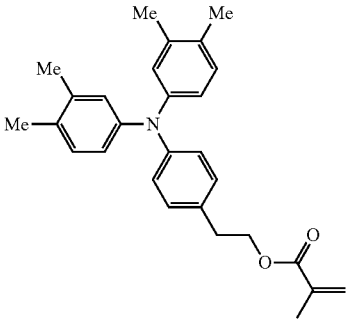 | 92.5 | 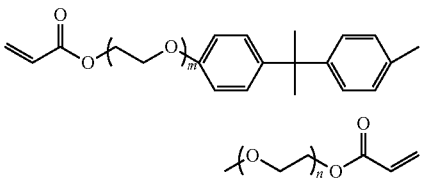 m + n = 3 | 7.5 | 10.26 |
| 9 | 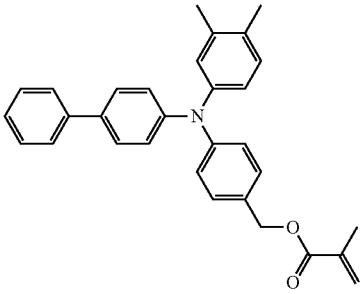 | 91 | 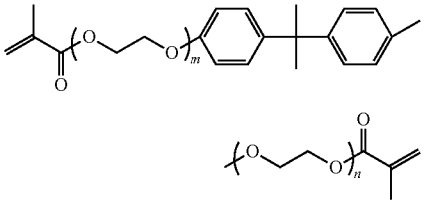 m + n = 2 | 9 | 10.24 |

TABLE 3-continued

| | Example No. | Reactive monomer (b) Structure | SP value | Difference in SP value |
|---|---|---|---|---|
| | 7 | 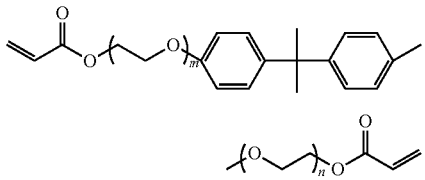 m + n = 4 | 10.19 | 0.07 |
| | 8 | 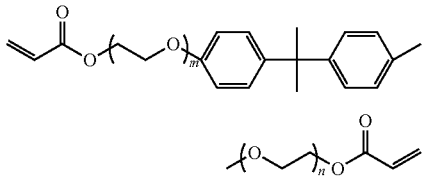 m + n = 10 | 9.91 | 0.35 |
| | 9 | 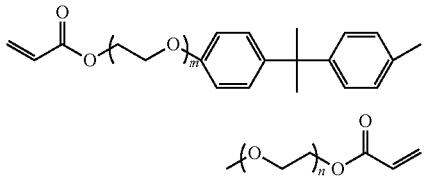 m + n = 2 | 10.35 | 0.11 |

TABLE 4

| Example No. | Polymeric electron transfer material (a): Reactive monomer having charge transport property Structure | Mass % | Reactive monomer having no charge transport property Structure | Mass % | SP value | Reactive monomer (b) Structure | SP value | Difference in SP value |
|---|---|---|---|---|---|---|---|---|
| 10 | 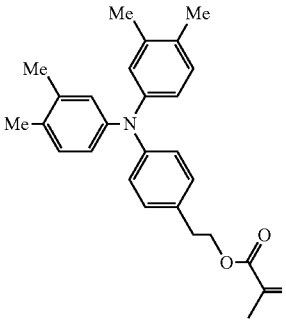 | 80 | 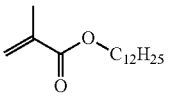 | 20 | 8.70 | 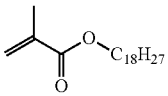 | 8.67 | 0.03 |

TABLE 4-continued
| Example No. | Polymeric electron transfer material (a): Reactive monomer having charge transport property: Structure | Mass % | Reactive monomer having no charge transport property: Structure | Mass % | SP value | Reactive monomer (b): Structure | SP value | Difference in SP value |
|---|---|---|---|---|---|---|---|---|
| 11 | 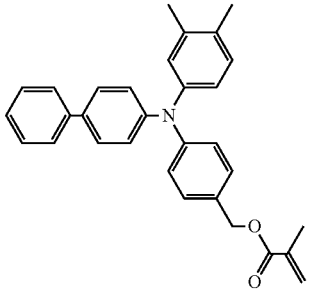 | 80 | 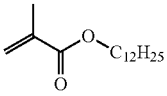 | 20 | 8.70 | 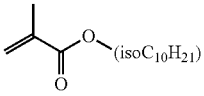 | 8.62 | 0.08 |
| 12 | 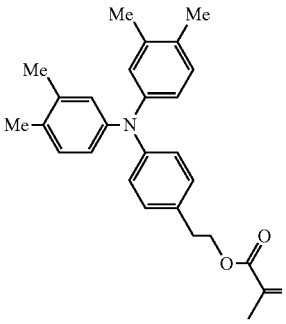 | 85 | 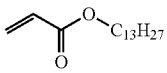 | 15 | 8.69 | 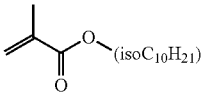 | 8.62 | 0.07 |

TABLE 5
| Example No. | Polymeric electron transfer material (a): Reactive monomer having charge transport property: Structure | Mass % | Reactive monomer having no charge transport property: Structure | Mass % | SP value | Reactive monomer (b): Structure | SP value | Difference in SP value |
|---|---|---|---|---|---|---|---|---|
| 13 | 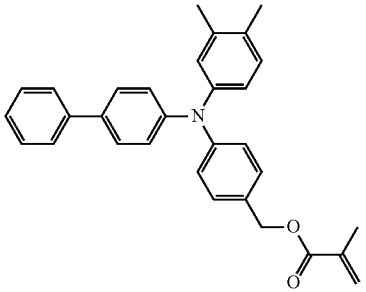 | 75 | 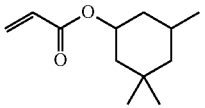 | 25 | 8.73 | 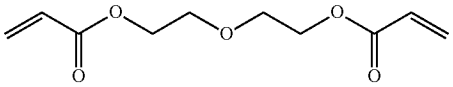 | 9.84 | 1.11 |
| 14 | 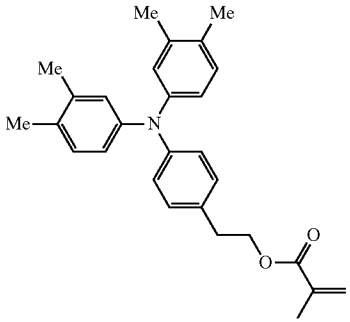 | 90 | 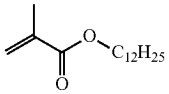 | 10 | 8.70 | 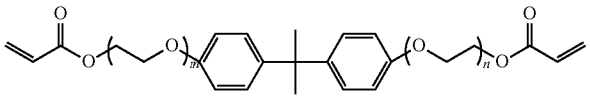 m + n = 2 | 10.26 | 1.56 |

TABLE 5-continued
| Example No. | Polymeric electron transfer material (a): Reactive monomer having charge transport property: Structure | Mass % | Reactive monomer having no charge transport property: Structure | Mass % | SP value | Reactive monomer (b): Structure | SP value | Difference in SP value |
|---|---|---|---|---|---|---|---|---|
| 15 | 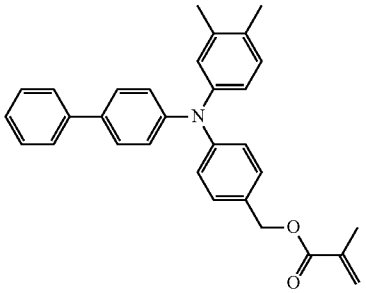 | 80 | 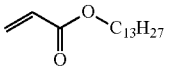 | 20 | 8.69 | 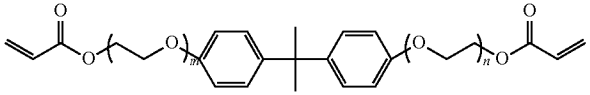 m + n = 2 | 10.26 | 1.57 |
| 16 | 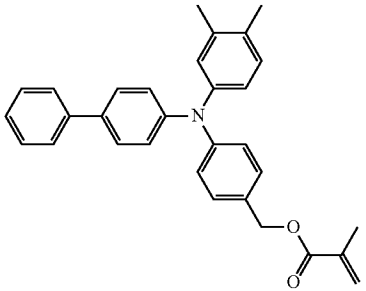 | 50 | 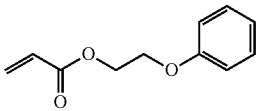 | 50 | 10.12 | IV-18 | 10.62 | 0.50 |

TABLE 6
| Comparative Example No. | Polymeric electron transfer material (a): Reactive monomer having charge transport property — Structure | Mass % | Reactive monomer having no charge transport property — Structure | Mass % | SP value | Reactive monomer (b) — Structure | SP value | Difference in SP value |
|---|---|---|---|---|---|---|---|---|
| 1 | 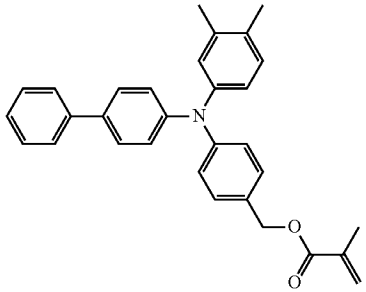 | | — | | — | 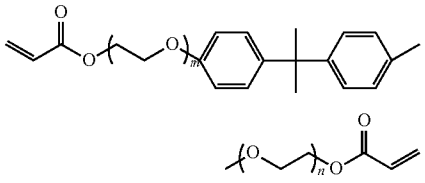 m + n = 2 | 10.26 | — |
| 2 | 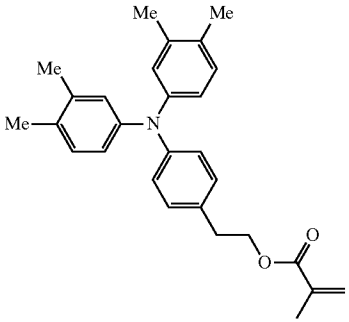 | 80 | 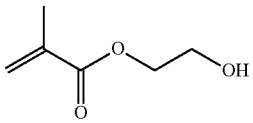 | 20 | 12.06 | 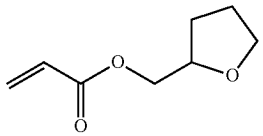 | 9.99 | 2.07 |

TABLE 6-continued
| Comparative Example No. | Polymeric electron transfer material (a): Reactive monomer having charge transport property: Structure | Mass % | Reactive monomer having no charge transport property: Structure | Mass % | SP value | Reactive monomer (b): Structure | SP value | Difference in SP value |
|---|---|---|---|---|---|---|---|---|
| 3 | 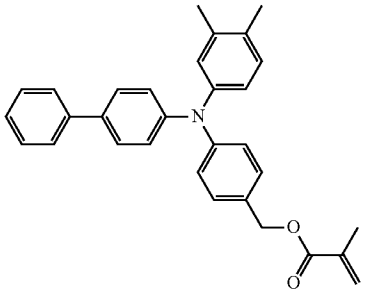 | 60 | 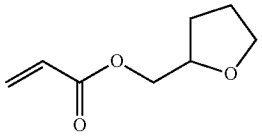 | 40 | 9.99 | 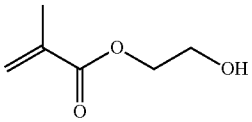 | 12.06 | 2.07 |
| 4 | 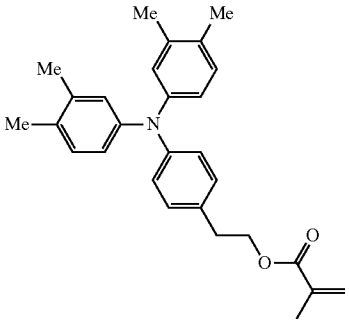 | 90 | 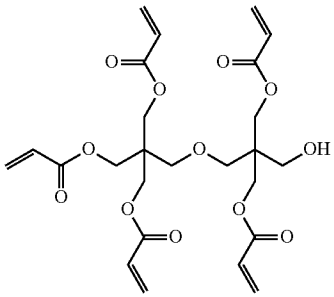 | 10 | 11.11 | 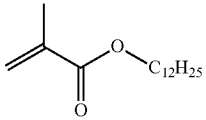 | 8.70 | 2.41 |

(Method for Evaluating Photoconductors)

—Evaluation of Printing Using Photoconductors—

Printing evaluation is conducted by mounting the electrophotographic photoconductors prepared in Examples and Comparative Examples onto DocuCentre Color 400CP (product of Fuji Xerox Co., Ltd.).

Figure 5:
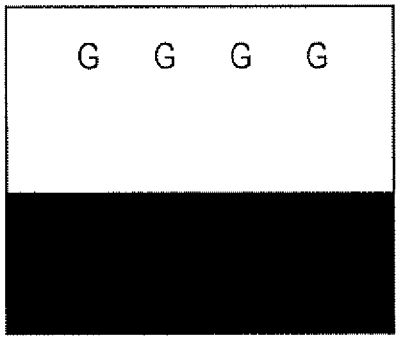
FIG. 5 is a diagram showing the standard for evaluation regarding image deletion and white streaks.

First, an image evaluation pattern shown in FIG. 5 is output at a low temperature and a low humidity (20° C., 25% RH) and the output is assumed to be "evaluation image 1". Then a black solid pattern is output continuously on 10000 sheets and then the image evaluation pattern is output. The output is assumed to be "evaluation image 2". After the electrophotographic photoconductors are left in a low-temperature, low-humidity (20° C., 25% RH) environment for 24 hours, the image evaluation pattern is output. This output is assumed to be "evaluation image 3". Then a black solid pattern is output continuously on 10000 sheets in a high humidity (28° C., 65% RH) environment and then the image evaluation pattern is output. The output is assumed to be "evaluation image 4". After the electrophotographic photoconductors are left in a high humidity (28° C., 65% RH) environment for 24 hours, the image evaluation pattern is output. This output is assumed to be "evaluation image 5". Then the electrophotographic photoconductors are returned to a low-temperature, low-humidity (20° C., 25% RH) environment, a black solid pattern is output continuously on 30000 sheets, and the image evaluation pattern is output. The output is assumed to be "evaluation image 6".

<Long-Term Image Stability>

Evaluation of long-term image stability is conducted by comparing evaluation image 6 with evaluation image 2 and evaluating the deterioration of the image quality by visual observation.

A+: Excellent

A: Good (No change is observed by visual observation but changes are observed in enlarge images)

B: Deterioration of image quality is observed but the image quality is still allowable C: Image quality deteriorated to a level that would cause a problem <Evaluation Regarding Image Deletion and White Streaks>

Evaluation regarding image deletion and white streaks is conducted by comparing evaluation image 3 with evaluation image 2 and evaluation image 5 with evaluation image 4 and evaluation of the deterioration of the image quality by visual observation.

A+: Good

A: Fair with few deletion and/or white streaks

B: Deletion and/or white streaks are slightly noticeable

C: Deletion and/or white streaks are clearly noticeable

<Electrical Characteristics>

The photoconductor is negatively charged with a scorotron charger while applying 700 V to a grid in a low-temperature, low-humidity (10° C., 15% RH) environment and the charged photoconductor is subjected to flash exposure at a radiant exposure of 10 mJ/m$^2$ using a 780 nm semiconductor laser. Ten seconds after completion of the exposure, the potential (V) at the surface of the photoconductor is measured and the observed value is assumed to be the value of the rest potential.

A++: −50 V or more

A+: −100 V or more and less than −50 V

A: −200 V or more and less than −100 V

B: −300 V or more and less than −200 V

C: less than −300 V

<Mechanical Strength>

The extent of occurrence of scratches on the surface of the photoconductor after the runs is visually observed.

A+: No scratches are visually observed after output of image 6

A: Scratches are not visually observed after output of image 4 but are observed after output of image 6

B: Entire surface is scratched during output of image 4

C: Entire surface is scratched during output of image 2

The results are summarized in Table 7.

TABLE 7

| | Long-term image stability | Image deletion and white streaks | Electrical characteristics | Mechanical strength |
|---|---|---|---|---|
| Example 1 | A | A | A++ | A |
| Example 2 | A | A | A++ | A |
| Example 3 | A | A | A++ | A |
| Example 4 | A | A | A+ | |
| Example 5 | A+ | A+ | A+ | A+ |
| Example 6 | A | A | A | A+ |
| Example 7 | A+ | A+ | A++ | A+ |
| Example 8 | A+ | A+ | A+ | A+ |
| Example 9 | A+ | A+ | A+ | A+ |
| Example 10 | A | A+ | A+ | A |
| Example 11 | A | A+ | A++ | A |
| Example 12 | A | A+ | A++ | A |
| Example 13 | A | A | A+ | A+ |
| Example 14 | A | A | A+ | A+ |
| Example 15 | A | A | A+ | A+ |
| Example 16 | A | A | A+ | A+ |
| Comparative Example 1 | B | B | A | B |
| Comparative Example 2 | C | B | C | A |
| Comparative Example 3 | C | B | C | B |
| Comparative Example 4 | C | B | C | A |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoconductor comprising:

a conductive substrate; and an outermost surface layer on the conductive substrate, the outermost surface layer containing a copolymer (a) that includes a constitutional unit represented by general formula (1) below derived from a reactive monomer having charge transport property and a constitutional unit represented by general formula (2) below derived from a reactive monomer having no charge transport property:

(1)

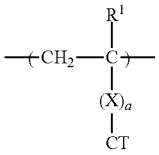

(2)

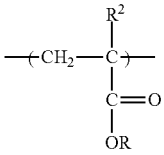

where, in general formulae (1) and (2),

R represents an organic group having no charge transport property;

$R^1$ and $R^2$ each independently represent hydrogen or an alkyl group having 1 to 4 carbon atoms;

X represents a divalent organic group having 1 to 10 carbon atoms;

a represents 0 or 1; and

CT represents an organic group having a charge transport skeleton, and a polymer prepared by polymerizing, in the presence of the copolymer (a), a reactive monomer (b) that has a solubility parameter (SP value) different from a solubility parameter (SP value) of the reactive monomer having no charge transport property by about 2 $(cal/cm^3)^{1/2}$ or less, wherein a ratio of a constitutional unit derived from the reactive monomer having no charge transport property in the copolymer (a) is about 10 mass % or less.

2. The electrophotographic photoconductor according to claim 1, wherein the reactive monomer having no charge transport property and constituting the copolymer (a) has the same structure as the reactive monomer (b).

3. The electrophotographic photoconductor according to claim 1, wherein both the reactive monomer having no charge transport property and constituting the copolymer (a) and the reactive monomer (b) have an alkylene oxide group.

4. The electrophotographic photoconductor according to claim 1, wherein both the reactive monomer having no charge transport property and constituting the copolymer (a) and the reactive monomer (b) have a bisphenol skeleton.

5. The electrophotographic photoconductor according to claim 1, wherein both the reactive monomer having no charge transport property and constituting the copolymer (a) and the reactive monomer (b) have an alkyl group having 6 or more carbon atoms.

6. The electrophotographic photoconductor according to claim 1, wherein the reactive monomer having charge transport property and constituting the copolymer (a) is a compound represented by general formula (A) below:

(A)

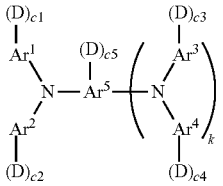

where, in formula (A), $Ar^1$ to $Ar^4$ may be the same or different and each independently represent a substituted or unsubstituted aryl group;

$Ar^5$ represents a substituted or unsubstituted aryl group or a substituted or unsubstituted arylene group;

D represents a side chain having a reactive group;

c1 to c5 each independently represent an integer of 0 to 2;

k represents 0 or 1; and the total number of D is 1 to 6.

7. The electrophotographic photoconductor according to claim 1, wherein the reactive monomer (b) has two or more polymerizable groups.

8. The electrophotographic photoconductor according to claim 1, wherein the reactive monomer (b) is a compound represented by general formula (B) below:

(B)

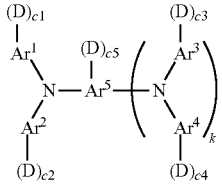

where, in formula (B), $Ar^1$ to $Ar^4$ may be the same or different and each independently represent a substituted or unsubstituted aryl group;

$Ar^5$ represents a substituted or unsubstituted aryl group or a substituted or unsubstituted arylene group;

D represents a side chain having a reactive group;

c1 to c5 each independently represent an integer of 0 to 2;

k represents 0 or 1; and the total number of D is 1 to 6.

9. The electrophotographic photoconductor according to claim 1, wherein the outermost surface layer of a photosensitive layer contains fluorine-based particles.

10. A method for preparing the electrophotographic photoconductor according to claim 1, the method comprising:

applying a coating solution for forming an outermost surface layer of the electrographic photoconductor onto the electrophotographic photoconductor to form a coating layer, the coating solution containing a copolymer (a) that includes a constitutional unit represented by general formula (1) below derived from a reactive monomer having charge transport property and a constitutional unit represented by general formula (2) below derived from a reactive monomer having no charge transport property:

(1)

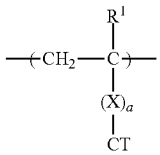

-continued (2)

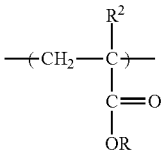

where, in general formulae (1) and (2),

R represents an organic group having no charge transport property;

$R^1$ and $R^2$ each independently represent hydrogen or an alkyl group having 1 to 4 carbon atoms;

X represents a divalent organic group having 1 to 10 carbon atoms; a represents 0 or 1; and CT represents an organic group having a charge transport skeleton, and a reactive monomer (b) that has a solubility parameter (SP value) different from a solubility parameter (SP value) of the reactive monomer having no charge transport property by about 2 $(cal/cm^3)^{1/2}$ or less; and heating the coating layer of the coating solution applied on the conductive substrate at an oxygen concentration of about 1000 ppm or less and a temperature of about 130° C. or higher.

11. The method according to claim 10, wherein the coating solution contains a polymerization initiator.

12. The method according to claim 11, wherein the polymerization initiator is a thermal polymerization initiator.

13. The method according to claim 12, wherein the thermal polymerization initiator has a molecular weight of about 250 or more.

14. A process cartridge comprising:

the electrophotographic photoconductor according to claim 1, wherein the process cartridge is detachably attachable to an image forming apparatus.

15. An image forming apparatus comprising:

the electrophotographic photoconductor according to claim 1;

a charging device that charges the electrophotographic photoconductor;

a latent image-forming device that forms an electrostatic latent image on a surface of the charged electrophotographic photoconductor;

a developing device that forms a toner image by developing the electrostatic latent image formed on the surface of the electrophotographic photoconductor with a toner; and a transfer device that transfers the toner image formed on the surface of the electrophotographic photoconductor onto a recording medium.

* * * * *